US012637913B2

(12) United States Patent
Baker et al.

(10) Patent No.: US 12,637,913 B2
(45) Date of Patent: May 26, 2026

(54) DRILLING AUTOMATION SYSTEM

(71) Applicant: TRANSOCEAN SEDCO FOREX VENTURES LIMITED, Hamilton (BM)

(72) Inventors: Jason Baker, Houston, TX (US); Barry Braniff, Houston, TX (US); Michael Coady, Houston, TX (US); Shane McClaugherty, Houston, TX (US); Scott McKaig, Houston, TX (US); Keith Boughton, Houston, TX (US)

(73) Assignee: TRANSOCEAN SEDCO FOREX VENTURES LIMITED, Hamilton (BM)

( * ) Notice: Subject to any disclaimer, the term of this patent is extended or adjusted under 35 U.S.C. 154(b) by 0 days.

(21) Appl. No.: 19/196,394

(22) Filed: May 1, 2025

(65) Prior Publication Data

US 2025/0277413 A1 Sep. 4, 2025

Related U.S. Application Data

(62) Division of application No. 18/029,307, filed as application No. PCT/US2021/052556 on Sep. 29, 2021, now Pat. No. 12,291,930.

(Continued)

(51) Int. Cl.
*E21B 19/20* (2006.01)
*E21B 19/16* (2006.01)

(52) U.S. Cl.
CPC ..... *E21B 19/165* (2013.01); *E21B 19/20* (2013.01)

(58) Field of Classification Search
CPC ..... E21B 19/165; E21B 19/20
See application file for complete search history.

(56) References Cited

U.S. PATENT DOCUMENTS

| | | | |
|---|---|---|---|
| 9,016,382 | B2 | 4/2015 | Braxton |
| 2004/0188098 | A1 | 9/2004 | Schulze-Beckinghausen et al. |

(Continued)

FOREIGN PATENT DOCUMENTS

| | | | |
|---|---|---|---|
| CN | 207093808 | U | 3/2018 |
| KR | 20160099325 | A | 8/2016 |
| WO | 2019173842 | A1 | 9/2019 |

OTHER PUBLICATIONS

International Search Report and Written Opinion issued Jul. 7, 2022 in International Application No. PCT/US2021/052556.
Office Action issued Aug. 6, 2024 in U.S. Appl. No. 18/029,307.

*Primary Examiner* — Taras P Bemko
(74) *Attorney, Agent, or Firm* — Panitch Schwarze Belisario & Nadel LLP

(57) ABSTRACT

The system for automating well construction operations includes a plurality of sensors, such as a fingerboard latch position sensor for providing position of a fingerboard latch, a stick-up height sensor for determining a height of a portion of a tubular section extending from a well center, a pipe handler rotation sensor for detecting a position of a pipe handler, a bell guide clearance sensor for measuring a distance between a bell guide and a tool joint, a link tilt position sensor for measuring an angle of a bail with respect to a top drive, an elevator latch status sensor for detecting whether an elevator latch is open or closed, and a power slips sensor for detecting whether a power slips is open or closed. The system includes a controller in communication with the plurality of sensors and configured to command one or more equipment based on inputs from the sensors.

3 Claims, 33 Drawing Sheets

Related U.S. Application Data

(60) Provisional application No. 63/159,300, filed on Mar. 10, 2021, provisional application No. 63/084,822, filed on Sep. 29, 2020.

(56) References Cited

U.S. PATENT DOCUMENTS

| | | | |
|---|---|---|---|
| 2006/0243488 | A1 | 11/2006 | Pietras |
| 2010/0135750 | A1 | 6/2010 | Tarique |
| 2012/0038486 | A1 | 2/2012 | Sinclair et al. |
| 2012/0173218 | A1 | 7/2012 | Shafer et al. |
| 2016/0017674 | A1 | 1/2016 | Richardson et al. |
| 2017/0314369 | A1 | 11/2017 | Rosano et al. |
| 2019/0063165 | A1 | 2/2019 | Wiedecke et al. |
| 2021/0010334 | A1 | 1/2021 | Finlay |
| 2021/0054701 | A1 | 2/2021 | Holck |
| 2021/0071486 | A1 | 3/2021 | Botnan et al. |

DRILLING AUTOMATION SYSTEM

CROSS-REFERENCE TO RELATED APPLICATIONS

This application is a divisional application of U.S. patent application Ser. No. 18/029,307, entitled "Drilling Automation System," currently pending, which entered the national stage on Mar. 29, 2023 from International Patent Application No. PCT/US2021/052556, filed on Sep. 29, 2021, which claims priority to and the benefit of U.S. Provisional Patent Application No. 63/084,822, filed on Sep. 29, 2020, and U.S. Provisional Patent Application No. 63/159,300, filed on Mar. 10, 2021, the disclosures of all of which are hereby incorporated by reference in their entireties.

TECHNICAL FIELD

The present disclosure generally relates to well construction processes and, in particular, to a system for automating the well construction using sensors and a controller for controlling operations of rig equipment.

BACKGROUND

Currently, when operating rig equipment, due to a lack of suitable rig sensors and a centralized controller for controlling operations of rig equipment, human intervention is often necessary and becomes an impediment to maximum efficiency and safety. Designing an automated system for well construction is important for maximizing efficiency and safety of well construction operations such as drilling, tripping, or riser running operations. However, to date, an automated control system has not been implemented or designed for well construction.

SUMMARY

The automated system described herein relies on inputs from various sensors of rig equipment (or rig sensors positioned at various locations on the rig). When the data from the rig sensors are accurately determined, the well construction control system can be autonomously actuated, and human interference can be minimized. In addition, by providing a direct feedback to a control system of the rig equipment, the control system will provide a means to provide "closed-loop" feedback to interlocks to prevent Health & Safety Executive (HSE) dropped object events. Such "closed-loop" feedback provides a significant impact on the overall time of the process, as well as minimizes the possibility of personnel time that would otherwise have to be involved.

Consistent with a disclosed embodiment, a system for automating tripping drill pipe during a well construction includes a plurality of sensors. The plurality of sensors includes a fingerboard latch position sensor disposed on a fingerboard latch and configured to provide a position of the fingerboard latch, a stick-up height sensor disposed on or around a drill floor and configured to detect a height from the drill floor to a tool joint of an existing drill pipe that is secured in a well center, a pipe handler rotation sensor disposed on a pipe handler and configured to detect a position and/or rotation of the pipe handler, a bell guide clearance sensor disposed on a top drive or in a derrick and configured to measure a distance between a bell guide and the tool joint, a link tilt position sensor disposed on a bail hanging from the top drive and configured to measure an angle of the bail with respect to the top drive, an elevator latch status sensor disposed on an elevator and configured to detect whether an elevator latch is open or closed, and a power slips sensor disposed on a power slips and configured to detect whether the power slips is open or closed. Further, the system for automating tripping drill pipe includes a controller in communication with the plurality of sensors and configured to receive a signal from each sensor and provide an input for commanding at least one of a pipe racker, a doping system, an iron roughneck, the top drive, the elevator, the elevator latch, a drawworks, or the power slips.

Further, in some embodiments, the pipe racker is configured to: (a) lift and retract an incoming stand of drill pipe after the fingerboard latch position sensor confirms that the fingerboard latch is raised, and (b) raise the incoming stand of drill pipe based on a signal from the stick-up height sensor and extend the incoming stand of drill pipe to the well center.

Further, in some embodiments, the doping system is configured to clean and dope the incoming stand after the pipe racker has stopped lifting and retracting the incoming stand.

Further, in some embodiments, the iron roughneck has a carriage and is configured to: (a) adjust a height of the carriage based on a signal from the stick-up height sensor, and (b) initiate a spin/torque sequence to connect the incoming stand of drill pipe to the existing drill pipe.

Further, in some embodiments, the top drive dolly is configured to extend based on a confirmation from the bell guide clearance sensor that the bell guide is clear of the tool joint.

Further, in some embodiments, the elevator latch is configured to: (a) close around the existing drill pipe when the link tilt position sensor confirms that the top drive is in a target position, and (b) open based on a confirmation from the power slips sensor that the power slips is closed.

Further, in some embodiments, the drawworks is configured to: (a) take weight of the drill pipe when the iron roughneck is clear, and (b) lower the drill pipe based on a confirmation from the power slips sensor that the power slips is open.

Further, in some embodiments, the power slips is configured to: (a) open when the drawworks takes weight of the drill pipe, and (b) close when the drawworks has completed lowering the drill pipe to a connection height.

Consistent with another disclosed embodiment, a method of automating tripping drill pipe during a well construction operation includes confirming that a fingerboard latch is raised using a fingerboard latch position sensor, raising an incoming stand of drill pipe by a pipe racker based on a signal from a stick-up height sensor, the stick-up height sensor being disposed on or around a drill floor and configured to detect a height from the drill floor to a tool joint of an existing drill pipe that is secured in a well center, adjusting a height of a carriage in an iron roughneck based on a signal from the stick-up height sensor, confirming a position of a top drive based on a signal from a pipe handler rotation sensor, confirming that a bell guide is clear of the tool joint based on a signal from a bell guide clearance sensor, confirming that an elevator is in a target position based on a signal from a link tilt position sensor, confirming that an elevator latch is closed based on a signal from the elevator latch status sensor, and confirming that a power slips is open or closed based on a signal from a power slips sensor.

Further, in some embodiments, the method includes after the fingerboard latch is confirmed to be raised cleaning and doping the incoming stand of drill pipe using a doping system.

Further, in some embodiments, the method includes extending a dolly when the bell guide is confirmed to be clear of the tool joint.

Further, in some embodiments, the method includes closing the elevator latch when the elevator is confirmed to be in a target position.

Further, in some embodiments, the method includes lowering the drill pipe by a drawworks when the power slips is confirmed to be open.

Further, in some embodiments, the method includes opening the elevator latch when the power slips is confirmed to be closed.

Further, in some embodiments, the method includes repeating the steps of the method until a desired number of stands are connected for a required depth.

Consistent with another disclosed embodiment, a system for automating stand building during a well construction operation includes a plurality of sensors. The plurality of sensors includes a catwalk machine cart position sensor disposed on a catwalk machine cart and configured to detect a position of the catwalk machine cart, a catwalk machine tail in arm position sensor disposed on a catwalk machine tail in arm and configured to detect a position of the catwalk machine tail in arm, wherein combination of the catwalk machine cart position sensor and the catwalk machine tail in arm position sensor is configured to provide a position and/or height of a first drill pipe joint, an elevator tilt angle sensor disposed on an elevator and configured to detect a position and/or angle of the elevator, an elevator latch status sensor disposed on the elevator and configured to detect whether an elevator latch is open or closed, a power slips sensor disposed on a power slips and configured to detect whether the power slips is open or closed, and a stick-up height sensor disposed on or around a drill floor and configured to detect a height from the drill floor to a tool joint. The system for automating stand building further includes a controller in communication with the plurality of sensors and configured to receive a signal from each sensor and provide an input for commanding at least one of the catwalk machine cart, the catwalk machine tail in arm, the elevator, the elevator latch, the iron roughneck, the drawworks, the power slips, or the first drill pipe joint.

Further, in some embodiments, the controller is configured to confirm the position and/or height of the first drill pipe joint, confirm the position and/or angle of the elevator, confirm that the power slips is open or closed, and confirm the position of the catwalk machine tail in arm.

Further, in some embodiments, after the position and angle of the elevator is confirmed to be correct, the controller is further configured to initiate or alert a driller to initiate a programmed sequence of tasks to close the elevator on the first drill pipe joint, raise the first drill pipe joint by a drawworks, guide the first drill pipe joint to a well center by the catwalk machine tail in arm using the signal from the catwalk machine tail in arm position sensor, open the power slips, retract the catwalk machine tail in arm, lower the first drill pipe joint by the drawworks into the power slips, close the power slips, connect a second drill pipe joint to the first drill pipe joint, or a combination thereof.

Consistent with another disclosed embodiment, a method of automating stand building during a well construction operation, includes confirming a position and height of a first drill pipe joint using a catwalk machine cart position sensor and a catwalk machine tail in arm position sensor, the catwalk machine cart position sensor being configured to detect a position of the catwalk machine cart, the catwalk machine tail in arm position sensor being configured to detect a position of the catwalk machine tail in arm, confirming a position and angle of an elevator, closing the elevator on the first drill pipe joint, raising the first drill pipe joint by a drawworks, guiding the first drill pipe joint to a well center based on a signal from the catwalk machine tail in arm position sensor, confirming that a power slips is open by using a power slips sensor, lowering the first drill pipe joint into the power slips, closing the power slips, and confirming that the power slips is closed by using the power slips sensor.

Further the method includes receiving a second drill pipe joint from the catwalk machine tail in arm, closing the elevator on the second drill pipe joint, raising the second drill pipe joint by the drawworks, lowering the second drill pipe joint to stab with the first drill pipe joint in the power slips, and connecting the second drill pipe joint to the first drill pipe joint.

Further the connecting is performed by the iron roughneck.

Further the method includes repeating the steps of the method until a desired number of drill pipe joints is connected.

Consistent with another disclosed embodiment, a system for automating riser running during a well construction operation includes a plurality of sensors. The plurality of sensors includes a riser spider dogs position sensor disposed on riser spider dogs and configured to detect whether the riser spider dogs are open or closed, a riser catwalk machine trolley position sensor disposed on a riser catwalk machine trolley and configured to detect a position of the riser catwalk machine trolley, a riser skate position sensor disposed on a riser skate and configured to detect a position of the riser skate, a tilt ramp position sensor disposed on a tilt ramp and configured to detect a position of the tilt ramp, wherein combination of the riser catwalk machine trolley position sensor, the riser skate position sensor, and the tilt ramp position sensor is configured to provide a position and/or height of an incoming riser joint, a riser running tool angle sensor disposed on the riser running tool and configured to detect an angle of the riser running tool, a riser running tool locking confirmation sensor is configured to detect the locking status of the riser running tool, and a manipulator arm position sensor disposed on a manipulator arm and configured to detect a position of the manipulator arm. Further, the system for automating riser running includes a controller in communication with the plurality of sensors and configured to receive a signal from each sensor and provide an input for commanding at least one of the riser spider dogs, the riser catwalk machine trolley, the riser skate, the tilt ramp, the running tool, or the manipulator arm.

Further, in some embodiments, the controller is configured to confirm that the riser spider dogs are closed using the riser spider dogs position sensor, thereby locking an existing riser joint, confirm the position and/or height of the incoming riser joint with the combination of the riser catwalk machine trolley position sensor, the riser skate position sensor, and the tilt ramp position sensor, thereby permitting the incoming riser joint to be fed to a stabbing guide, confirm locking of the running tool on the incoming riser joint using the riser running tool locking confirmation sensor, confirm alignment of the incoming riser joint with the existing riser joint by using a camera, and confirm that the riser spider dogs are open using the riser spider dogs position sensor, after the incoming riser joint is connected to the existing riser joint.

Further, in some embodiments, the controller is configured to initiate or alert a driller to initiate a programmed sequence of tasks to feed the incoming riser joint to a stabbing guide by using the tilt ramp and the manipulator arm, lock the running tool on the incoming riser joint, remove a hole cover from the existing riser joint, connect the incoming riser joint to the existing riser joint, raise a drawworks, open the spider dogs, or a combination thereof.

Further, in some embodiments, after the incoming riser joint is connected to the existing riser joint, the controller is configured to alert the driller that the riser is ready to run.

Consistent with another disclosed embodiment, a method of automating riser running during a well construction operation includes confirming that the riser spider dogs are closed, thereby indicating that an existing riser joint is locked, confirming a position and/or height of the incoming riser joint by using a combination of a riser catwalk machine trolley position sensor, a riser skate position sensor, and a tilt ramp position sensor, the riser catwalk machine trolley position sensor being configured to detect a position of a riser catwalk machine trolley, the riser skate position sensor being configured to detect a position of a riser skate, and the tilt ramp position sensor being configured to detect a position of a tilt ramp. Further, the method includes initiating or alerting a driller to initiate a first programmed sequence of tasks to: (a) feed the incoming riser joint to a stabbing guide, and (b) lock a running tool on the incoming riser joint. Further, the method includes confirming locking of the riser running tool on the incoming riser joint by using a riser running tool locking confirmation sensor, confirming an angle of the riser running tool by using a riser running tool angle sensor, confirming alignment of the incoming riser joint with the existing riser joint by using a camera, initiating or alert the driller to initiate a second programmed sequence of tasks to: (a) connect the incoming riser joint to the existing riser joint, (b) raise a drawworks, and (c) open the spider dogs, and confirming that the riser spider dogs are open using a riser spider dogs position sensor, after the incoming riser joint is connected to the existing rider joint.

Further, in some embodiments, the method includes, after the incoming riser joint is connected to the existing riser joint, alerting the driller that the riser is ready to run.

Further, in some embodiments, the first programed sequence includes removing a hole cover from the existing riser joint.

Further, in some embodiments, the method includes repeating the steps of the method until a desired number of riser joints is connected for a required depth.

Consistent with another disclosed embodiment, a system for automating mud valve line-up confirmation during a well construction operation includes a plurality of sensors. The plurality of sensors includes a first mud valve status sensor disposed on or adjacent to a first mud valve and configured to detect a status of the first mud valve and a second mud valve status sensor disposed on or adjacent to a second mud valve and configured to detect a status of the second mud valve. Further, the system for automating mud valve line-up confirmation includes a controller in communication with the plurality of sensors and configured to receive a signal from each sensor and provide an input to a drilling system regarding line-up status of the first and second sensors.

Further, in some embodiments, the first or second mud valve is selected from a crossover valve from a standpipe to a choke manifold, an isolation valve between an active standpipe and a spare standpipe, a mud pump valve, a choke manifold valve for a choke-and-kill line, and a splitter valve on a choke manifold.

Further, in some embodiments, the first or second mud valve is one of a gate valve or a butterfly valve, wherein the first or the second mud valve is either manual or hydraulically actuated.

Further, in some embodiments, the system for automating mud valve line-up confirmation is configured to confirm correct valve line-up prior to flushing of a choke-and-kill line.

Consistent with another disclosed embodiment, a method of automating mud valve line-up confirmation during a well construction operation includes confirming a position of a first mud valve using a first mud valve status sensor, confirming a position of a second mud valve using a second mud valve status sensor, and determining that the mud valve line-up is correct if a predetermined lineup state is achieved prior to start of a mud transfer.

Further, in some embodiments, the first or second mud valve is selected from a crossover valve from a standpipe to a choke manifold, an isolation valve between an active standpipe and a spare standpipe, a mud pump valve, a choke manifold valve for a choke-and-kill line, and a splitter valve on a choke manifold.

Further, in some embodiments, the first or second mud valve is a gate valve that is either manual or hydraulically actuated.

Further, in some embodiments, the determination is made prior to flushing of a choke-and-kill line.

Consistent with another disclosed embodiment a system for automating tripping casing during a well construction operation includes a plurality of sensors. The plurality of sensors includes a fingerboard latch position sensor disposed on a fingerboard latch and configured to provide a position of the fingerboard latch, a stick-up height sensor disposed on or around a drill floor and configured to detect a height from the drill floor to a casing joint, a bell guide clearance sensor disposed on a top drive or in a derrick and configured to measure a distance between a bell guide and the casing joint, a casing elevator latch status sensor disposed on a casing elevator and configured to detect whether a casing elevator latch is open or closed, and a casing slips status sensor disposed on a casing slips and configured to detect whether the casing slips is open or closed. Further, the system for automating tripping casing includes a controller in communication with the plurality of sensors and configured to receive a signal from each sensor and provide an input for commanding at least one of a pipe racker, a casing tong, a top drive dolly, the casing elevator latch, a drawworks, or the casing slips.

Further, in some embodiments, the pipe racker is configured to: (a) lift and retract an incoming joint of casing after the fingerboard latch position sensor confirms that the fingerboard latch is raised, and (b) raise the incoming joint based on a signal from the stick-up height sensor and extend the incoming joint to a well center.

Further, in some embodiments, the casing tong is configured to (a) adjust a height of the carriage based on a signal from the stick-up height sensor, and (b) initiate a casing tong spin/torque sequence to connect the incoming joint with the existing joint to make the casing.

Further, in some embodiments, the top drive dolly is configured to extend based on a confirmation from the bell guide clearance sensor that the bell guide is clear of the top of the existing joint.

Further, in some embodiments, the casing elevator latch is configured to: (a) close around the casing when the casing tong torque sequence is completed, and (b) open based on a confirmation from the casing slips status sensor that the casing slips is closed.

Further, in some embodiments, the drawworks is configured to: (a) take weight of the casing when the casing tong is clear of the well center, and (b) lower the casing based on a confirmation from the casing slips status sensor that the casing slips is open.

Further, in some embodiments, the casing slips is configured to: (a) open when the drawworks takes weight of the casing, and (b) close when the drawworks has completed lowering the casing to a connection height.

Consistent with another disclosed embodiment a method of automating tripping a casing during a well construction operation includes confirming that a fingerboard latch is raised using a fingerboard latch position sensor, raising an incoming joint of casing by a pipe racker based on a signal from a stick-up height sensor, the stick-up height sensor being disposed on or around a drill floor and configured to detect a height from the drill floor to a casing joint, adjusting a height of a carriage in a casing tong based on a signal from the stick-up height sensor, confirming that a bell guide is clear of a top of the incoming joint based on a signal from a bell guide clearance sensor, confirming that a casing elevator latch is closed based on a signal from a casing elevator latch status sensor, and confirming that a casing slips is open or closed based on a signal from a casing slips status sensor.

Further, in some embodiments, the method includes, after the fingerboard latch is confirmed to be raised, lifting and retracting the joint of casing using the pipe racker.

Further, in some embodiments, the method includes extending a dolly when the bell guide is confirmed to be clear of the top of the incoming joint.

Further, in some embodiments, the method includes closing the casing elevator latch when a spin/torque sequence of the casing tong to connect the incoming joint to the existing joint is completed.

Further, in some embodiments, the method includes lowering the casing by a drawworks when the casing slips is confirmed to be open.

Further, in some embodiments, the method includes opening the casing elevator latch when the casing slips is confirmed to be closed.

Further, in some embodiments, the method includes repeating the steps of the method until a required number of casing connections is made.

Consistent with another disclosed embodiment a system for automating use of a hand slips during a well construction operation includes a hand slips status sensor disposed on the hand slips and configured to detect whether the hand slips is open or closed, and a controller in communication with the hand slips status sensor and configured to receive a signal from the hand slips status sensor and provide an input to a drilling system regarding the status of the hand slips.

Further, in some embodiments, after confirming that the hand slips is closed, the controller is configured to initiate or alert the drilling system to initiate a programmed sequence of tasks to lower a drawworks to transfer weight of a drill string from an elevator to the hand slips, open an elevator, raise a top drive, or a combination thereof.

Further, in some embodiments, the hand slips is manual or powered.

Consistent with another disclosed embodiment a method of automating use of a hand slips during a well construction operation includes confirming that the hand slips is closed by using a hand slips status sensor, lowering a drawworks to transfer weight of a drill string from an elevator to the hand slips, opening the elevator, and raising a top drive via the drawworks.

Further, in some embodiments, the hand slips is manual or powered.

Consistent with another disclosed embodiment a system for automating tripping tubing during a well construction operation includes a plurality of sensors. The plurality of sensors includes a fingerboard latch position sensor disposed on a fingerboard latch and configured to provide a position of the fingerboard latch, a stick-up height sensor disposed on or around a drill floor and configured to detect a height from the drill floor to a tubing connection, a bell guide clearance sensor disposed on a top drive or in a derrick and configured to measure a distance between a bell guide and a tubing connection, a tubing elevator latch status sensor disposed on a tubing elevator and configured to detect whether a tubing elevator latch is open or closed, and a tubing spider status sensor disposed on a tubing spider and configured to detect whether the tubing spider is open or closed. Further, the system for automating tripping tubing includes a controller in communication with the plurality of sensors and configured to receive a signal from each sensor and provide an input for commanding at least one of a pipe racker, a tubing tong, a top drive dolly, the tubing elevator latch, a drawworks, or the tubing spider.

Further, in some embodiments, the pipe racker is configured to: (a) lift and retract an incoming joint of tubing after the fingerboard latch position sensor confirms that the fingerboard latch is raised, and (b) raise the incoming stand based on a signal from the stick-up height sensor and extend the incoming stand to a well center.

Further, in some embodiments, the tubing tong is configured to (a) adjust a height of the carriage based on a signal from the stick-up height sensor, and (b) initiate a tubing tong spin/torque sequence to connect the incoming stand to the existing stand to make the tubing.

Further, in some embodiments, the top drive dolly is configured to extend based on a confirmation from the bell guide clearance sensor that the bell guide is clear of the top of the existing stand.

Further, in some embodiments, the tubing elevator latch is configured to: (a) close around the tubing before the tubing tong torque sequence starts, and (b) open based on a confirmation from the tubing spider status sensor that the tubing spider is closed.

Further, in some embodiments, the drawworks is configured to: (a) take weight of the tubing when the tubing tong is clear of the well center, and (b) lower the tubing based on a confirmation from the tubing spider status sensor that the tubing spider is open.

Further, in some embodiments, the tubing spider is configured to: (a) open when the drawworks takes weight of the tubing, and (b) close when the drawworks has completed lowering the tubing to a connection height.

Consistent with another disclosed embodiment a method of automating tripping tubing during a well construction operation includes confirming that a fingerboard latch is raised using a fingerboard latch position sensor, raising an incoming joint of tubing by a pipe racker based on a signal from a stick-up height sensor, the stick-up height sensor being disposed on or around a drill floor and configured to detect a height from the drill floor to a tubing connection, adjusting a height of a carriage in a tubing tong based on a signal from the stick-up height sensor, confirming that a bell guide is clear of a top of the stand based on a signal from a bell guide clearance sensor, confirming that a tubing elevator latch is closed based on a signal from a tubing elevator latch status sensor, and confirming that a tubing spider is open or closed based on a signal from a tubing spider status sensor.

Further, in some embodiments, the method includes, after the fingerboard latch is confirmed to be raised lifting and retracting the existing stand using the pipe racker.

Further, in some embodiments, the method includes extending a dolly when the bell guide is confirmed to be clear of the top of the existing stand.

Further, in some embodiments, the method includes closing the tubing elevator latch before a spin/torque sequence of the tubing tong to connect the incoming stand to the existing stand starts.

Further, in some embodiments, the method includes lowering the tubing by a drawworks when the tubing spider is confirmed to be open.

Further, in some embodiments, the method includes opening the tubing elevator latch when the tubing spider is confirmed to be closed.

Further, in some embodiments, the method includes repeating the steps of the method until a desired number of stands is connected for a required depth.

The foregoing general description and the following detailed description are exemplary and explanatory only and are not restrictive of the claims.

BRIEF DESCRIPTION OF THE DRAWINGS

The skilled artisan will understand that the drawings primarily are for illustrative purposes and are not intended to limit the scope of the inventive subject matter described herein. The drawings are not necessarily to scale; in some instances, various aspects of the inventive subject matter disclosed herein may be shown exaggerated or enlarged in the drawings to facilitate an understanding of different features. In the drawings, like reference characters generally refer to like features (e.g., functionally similar and/or structurally similar elements).

DETAILED DESCRIPTION

Aspects of the present disclosure are related to an automated system for well construction operations. Automating well construction operations includes automating tripping drill pipe, automating stand building, automating riser running, automating a mud valve line-up confirmation, automating tripping casing, automating use of a hand slips, as well as automating tripping tubing during well construction.

Figure 1A:
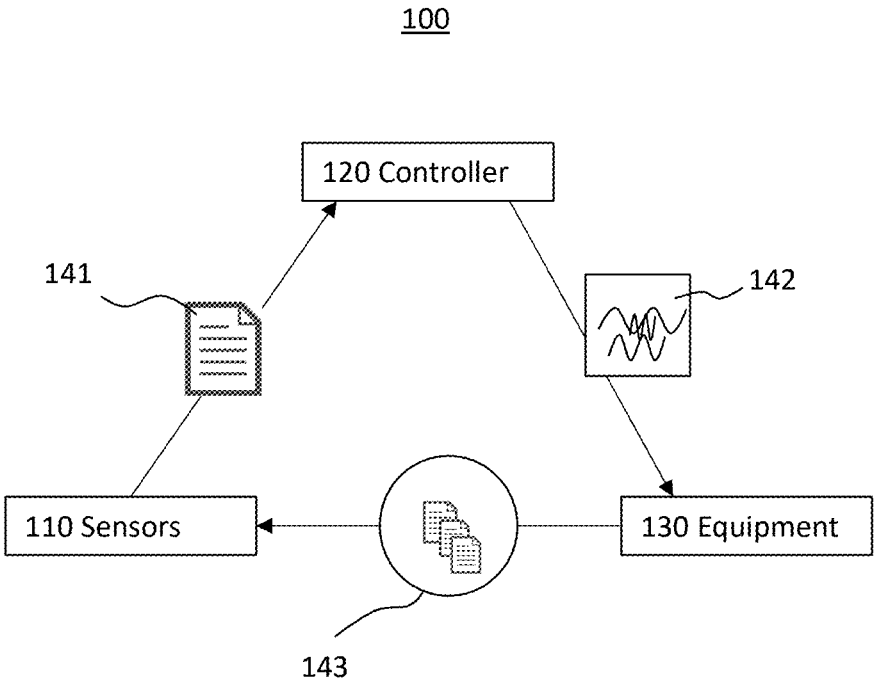
FIG. 1A is an example diagram of a system for automating well construction according to an embodiment.

FIG. 1A shows an example diagram of a system 100 for automating well construction, according to an embodiment. An example system includes drilling equipment 130, which may include any suitable drilling equipment (e.g., a top drive, a pipe racker, an iron roughneck, elevators, a power slips, and the like, as further described below). Equipment 130 (herein also referred to as machines 130, or, when a particular machine is discussed, a machine 130) is configured to receive input signals 142 from a controller 120, and upon receiving input signals 142, execute one or more well construction operations 143. At any time during well construction (or after completion of the well construction), a set of sensors 110 is configured to collect data 141 and transmit the data to controller 120. Based on received data 141, controller 120 is configured to determine new input signals 142 that are needed to be sent to equipment 130. In an example embodiment, data 141 may indicate if machine 130 need to have operational parameters changed for proper operation of machine 130. For example, data 141 may indicate that machine 130 is overheated, or is not positioned correctly, thus, requiring adjustment of the operation of machine 130 (e.g., a position of a top drive may be adjusted for proper positioning of a stand of a drill pipe, as further described below). Alternatively, if data indicates that no changes in operations of machine 130 is required, a planned input signal may be sent to equipment 130.

In various embodiments, sensors 110 may be any suitable sensors for determining operation of equipment 130. For example, sensors 110 may include temperature sensors, pressure sensors, torque sensors, air quality sensors, gas sensors, tension sensors, location sensors, orientation sensors, tilt sensors, acceleration sensors, or any other suitable sensors. For example, location and orientation sensors may be used to determine positions and orientations of drilling equipment 130 such as an elevation height of an elevator, an orientation and placement of a section of a drill pipe, a position of an iron roughneck, and a position and an orientation of a pipe racker (as further described below). Location and orientation sensors may include any suitable sensors for determining location and orientation of various machines 130. In some cases, location and orientation sensors may be part of machines 130 and in other cases, the location and orientation sensors may be sensors installed at various locations at a drilling rig. For example, when location and orientation sensors are part of machine 130, these sensors may include gyroscopes for determining rotations of machine 130, as well as accelerometers for determining translations of machine 130. Alternatively, when location and orientation sensors are installed at various places of the drilling rig, these sensors may be distance measurement sensors (e.g., optical sensors such as Lidars, cameras capable of triangulation, time-of-flight based devices, and the like, for determining distances to machine 130), near field communication devices (e.g., Bluetooth devices for determining a strength of a signal from an emitter located on machine 130). Some sensors may include RFID tags (for determining proximity to a particular machine 130).

Besides location measuring sensors, sensors 110 may include pressure sensors for measuring interactions between machines 130 and drilling equipment (e.g., drill pipes, casing pipes, and the like). For example, pressure sensors may be used to determine pressure exerted by a power slips configured to hold a drill pipe in place, as further described below). Additionally, pressure sensors may be used to determine the weight of various drilling equipment (e.g., weight of a casing pipe or a drill pipe). In an example embodiment, pressure sensors are installed adjacent to surfaces of machines 130 that experience changes in surface pressure.

Further, as described above, any other suitable sensors may be present (e.g., thermal imaging cameras for determining temperature of different machines 130, audio sensors for determining noise (e.g., abnormal noise) emitted by equipment 130, cameras, chemical sensors, such as gas detectors for detecting a gas leak, electrical sensors (for determining current/voltage characteristics of various equipment 130), viscosity sensors (for determining viscosities of various fluid, such as oil, used by equipment 130), or any other suitable sensors.

In some cases, controller 120 is configured to determine whether data 141 indicates an abnormal operation of equipment 130. The abnormal operation may be indicated if one of the parameters reported by sensors 110 is outside the normal range for operation of equipment 130. For example, if a temperature of a particular part of equipment 130 is outside the expected range, controller 120 may determine that the equipment 130 is malfunctioning. In some cases, if pressures detected by sensors 110 are outside a normal range, equipment 130 may be determined to be operated abnormally. In some cases, controller 120 may determine that a motion of equipment 130 is outside the normal motion characteristics (e.g., if an elevator supporting a drill pipe is descending rapidly, the motion may be faster than the allowable range of motions for the elevator). Further, controller 120 may determine that an electrical current associated with one or more machines 130 is above the threshold value, based on the related data from electrical sensors.

In some cases, data from multiple sensors 110 may be combined to determine an accurate characteristic of an equipment 130. Such data from multiple sensors 110 may provide redundancy and ensure that a particular one of the sensors is not malfunctioning. For example, if one of sensors 110 indicated an abnormal operation of equipment 130, other sensors for determining operation of equipment 130 are used for confirmation that equipment 130 is operating abnormally (e.g., outside the expected range of operational parameters). If such a confirmation is not achieved, the particular one of sensors 110 may be tested to determine whether the sensor is malfunctioning. In an example embodiment, the sensor may be tested by performing an operation of equipment 130 and determining if the sensor correctly detected the operation (e.g., a location sensor may be tested by moving the equipment 130 by a predetermined amount and testing that the location sensor correctly determined the amount of motion of the equipment 130).

Further, in some cases, a redundancy in equipment 130 may be used. If one of the machines 130 is determined to be malfunctioning, another machine 130 may be used to take over a task of the malfunctioning machine.

In some cases, environmental factors (e.g., factors other than malfunctioning equipment) may influence data 141 from sensors 110. For example, based on a sea conditions (when drilling offshore), the well construction operations may be adjusted. In some cases, a heave compensation is used, and data received from various sensors are adjusted based on the position of a rig relative to the ocean floor. In some cases, well construction operations may be stopped until the sea conditions improve.

Figure 1B:
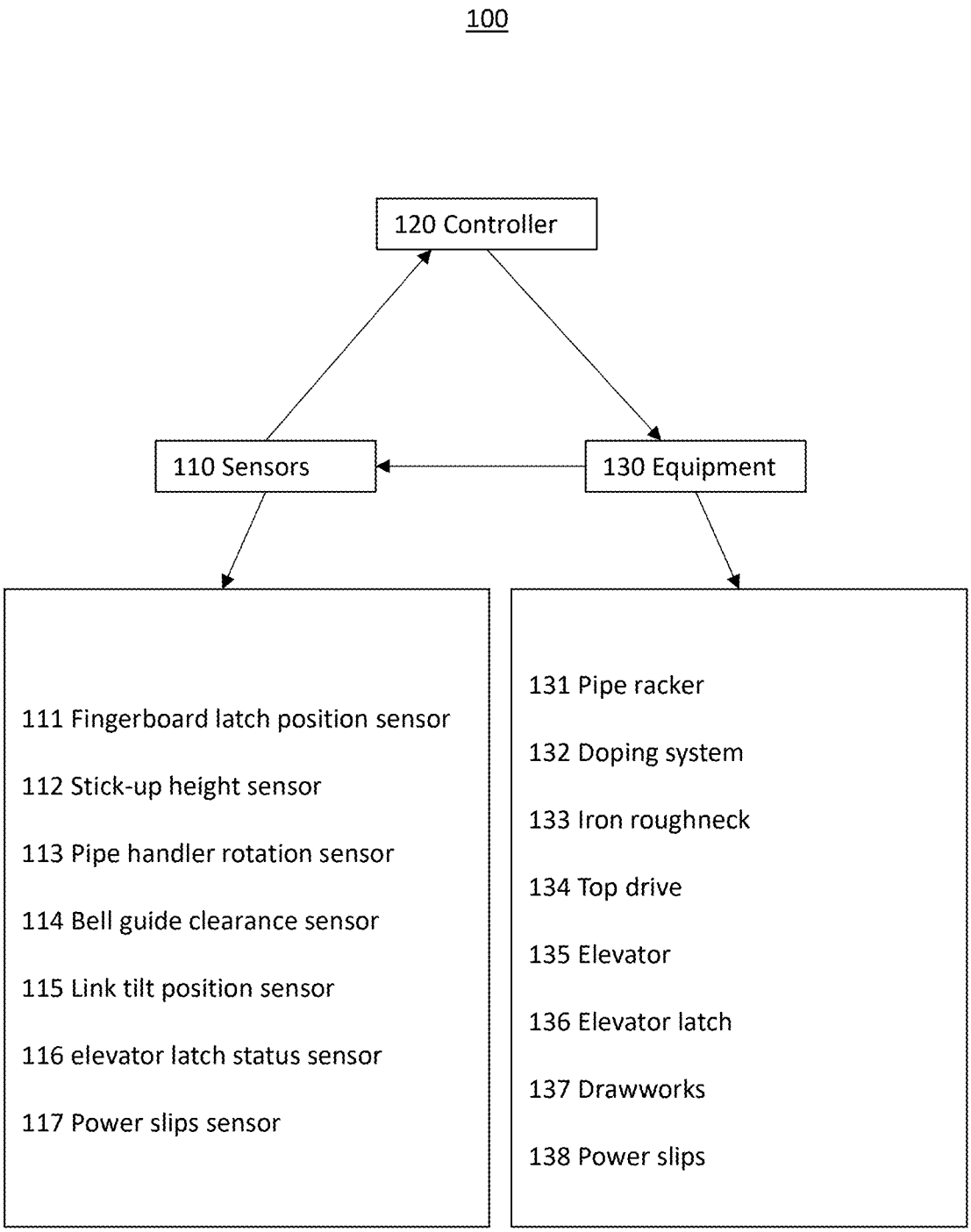
FIG. 1B is an example diagram of a system for automating tripping drill pipe during well construction according to an embodiment.

FIG. 1B shows an example diagram of a system 100 for automating tripping drill pipe during a well construction. An example drill pipe is assembled by connecting together multiple drill pipe segments using suitable connection elements, further discussed herein. In some, cases multiple drill pipe segments may be connected into stands, and the stands may be connected together to form a drill pipe. In an example embodiment system 100 includes a set of sensors 110 configured to determine various parameters of operation of equipment 130. Equipment 130 may include any suitable equipment that can be used for tripping drill pipe during the well construction.

In the example embodiment, as shown in FIG. 1B, equipment 130 includes a pipe racker 131, a doping system 132, an iron roughneck 133, a top drive dolly 134, an elevator 135, an elevator latch 136, a drawworks 137, and a power slips 138.

Pipe racker 131 is used for retrieving drill pipe segments, or the stands formed from drill pipe segments from a storage location (e.g., a fingerboard as further discussed below). In an example embodiment, pipe racker 131 is a robotic system configured to pick up a stand of drill pipe from the fingerboard and bring the stand (or a segment of the drill pipe) to be picked up by an elevator 135. In an example implementation, pipe racker 131 is configured to (a) lift and retract an incoming stand of drill pipe after the fingerboard latch position sensor confirms that the fingerboard latch is raised, (b) raise the incoming stand of drill pipe based on a signal from the stick-up height sensor (as further described below) and extend the incoming stand of drill pipe to a rig well center (herein, also referred to as a well center) located on a drill floor.

Further, pipe racker 131 is configured to take the stand and position it above a rig well center such that the stand may be connected to another section of the drill pipe (located below the stand and in the rig well center). Pipe racker 131 is configured to hold the stand and to translate the stand in vertical and horizontal directions and, in some cases, orient the stand at a required angle relative to a vertical direction. For example, the stand may be carried vertically or horizontally, or at any other orientation relative to the vertical direction, by pipe racker 131.

In various cases, a stand of the drill pipe may be cleaned and lubricated by doping system 132 after being picked up by pipe racker 131 (and before being picked up by elevator 135). In an example embodiment, elevator 135 may latch to the incoming stand after pipe racker 131 and iron roughneck connect the incoming stand to an existing stand of drill pipe located at the well center. In an example implementation, doping system 132 may lubricate a connection region of the stand. For example, when the connection region of the stand includes a threaded connection, the thread may be lubricated. Doping system 132 is configured to clean and dope the incoming stand after the pipe racker has stopped lifting and retracting the incoming stand.

In an example embodiment of well construction, a first segment (or a first stand or an existing stand) of drill pipe is held in place by power slips 138. For example, power slips 138 is configured to hold the first stand of drill pipe at a rig well center location such that a second stand of drill pipe (or an incoming stand) may be connected to a connection region of the first stand. (Herein, the rig well center is a location at the center of the well, but above the well. For example, the rig well center is located on a rig above the well. In some cases, the drill pipe connects the rig well center and the well, and in other cases, the drill pipe extends from the rig well center towards the well.) In an example implementation, the second stand and the first stand are connected via a threaded connection (e.g., the second stand may be screwed onto the first stand via the threaded connection). Power slips 138 is configured to keep the first stand in place while the second stand is being connected to the first stand. Once the second stand is connected, and while being held by elevator latch 136, power slips 138 may be opened to allow an assembly of the first and the second stand to move vertically downwards toward the well. Power slips 138 is configured to: (a) open when drawworks 137 takes weight of the drill pipe, and (b) close when drawworks 137 has completed lowering the drill pipe to a connection height.

In various embodiments of well construction, drawworks 137 is configured to move top drive 134 and elevator 135 in a vertical direction by means of cables. For example, drawworks 137 includes a motor, transmission system (for changing a speed of elevator 135), and a set of cables and pulleys for moving elevator 135 up or down. Additionally, a set of rails may be used to move elevator 135 horizontally. In some cases, drawworks 137 is configured to: (a) take weight of the drill pipe when iron roughneck 133 is clear, and (b) lower the drill pipe based on a confirmation from power slips sensor 117 that power slips 138 is open.

In some cases, a stand of a drill pipe may be picked up by a top drive 134 configured to hold and rotate the drill pipe. In various embodiments, top drive 134 is a device used for well constructions, as known in the art of drilling. In an example implementation, to guide top drive 134, top drive 134 is connected to a top drive dolly (the dolly may be a system of rails along which top drive 134 is configured to move).

Further, equipment 130 includes iron roughneck 133 configured to connect two segments of a drill pipe (or two stands of the drill pipe). In an example implementation, iron roughneck 133 is configured to secure a first stand of the drill pipe located in the rig well center and rotate a second stand of the drill pipe such that the second stand is connected to the first stand via a threaded connection. Iron roughneck 133 is configured to provide sufficient torque to the second stand, while holding the first stand, such that the second stand is tightly coupled to the first stand. While connecting the first and the second stands, the second stand may be supported by pipe racker 131 and/or elevator 135, while the first stand may be also (e.g., in addition to being secured by iron roughneck 133) secured by power slips 138. In an example implementation, iron roughneck 133 includes a carriage and is configured to: (a) adjust a height of the carriage based on a signal from the stick-up height sensor (the stick-up height sensor is further discussed below), and (b) initiate a spin/torque sequence to connect the incoming stand of drill pipe to the existing drill pipe.

As described above, various embodiments of an automated system for well constructions include sensors 110 for monitoring operations of equipment 130 and for providing data to controller 120. In the example embodiment of system 100, as shown in FIG. 1B, sensors 110 include fingerboard latch position sensor 111, stick-up height sensor 112, pipe handler rotation sensor 113, bell guide clearance sensor 114, link tilt position sensor 115, elevator latch status sensor 116, and power slips sensor 117.

Figure 20:
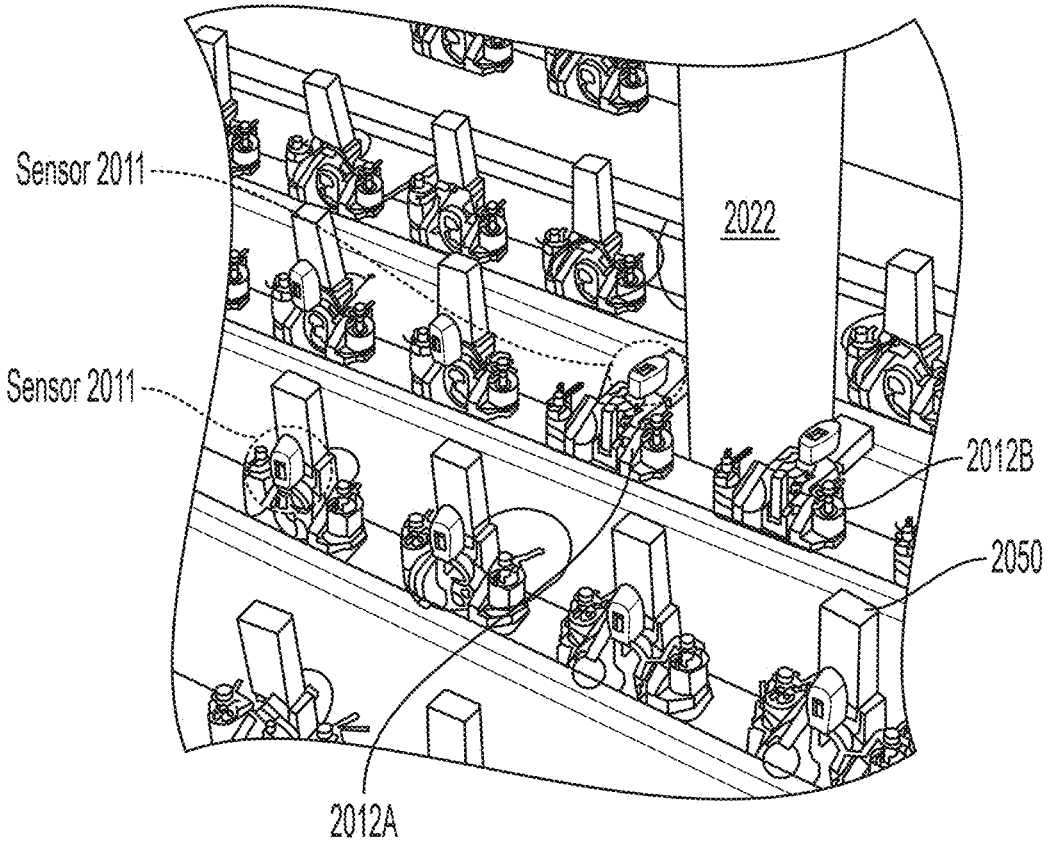
FIG. 20 is an example fingerboard for holding drill pipe stands according to an embodiment.

Fingerboard latch position sensor 111 is a sensor configured to determine whether a latch on a fingerboard is open or closed. When a fingerboard latch is closed, it is configured to couple to a stand of the drill pipe (e.g., via forces of friction and via exerting pressure on a surface of the stand) and prevent the stand from being removed from the fingerboard. Fingerboard latch position sensor 111 can be an accelerometer, a potentiometer, or an angle sensor. Sensing the position of the fingerboard latch permits automation interlock and the control of pipe racker 131 arms when retrieving or storing tubulars (e.g., a stand of drill pipe) in the fingerboard. Further, fingerboard latch position sensor 111 removes the need for 'spotters' to confirm the status of the fingerboard latch. In an example embodiment, one or more latches may be used simultaneously (e.g., be in a closed position) to prevent the stand form being removed from the fingerboard. For example, one latch may be coupled to a first side (e.g., a left side) of the stand, and another latch may be coupled to a second side (e.g., a right side) of the stand. In some cases, more than two latches may be used to couple to the stand to prevent the stand from being removed from the fingerboard. In some cases, latches may be configured to support the stand in an upright position (e.g., prevent the stand from falling out of the fingerboard.) An example fingerboard 2050 and example latches 2012A and 2012B are shown in FIG. 20. As seen in FIG. 20, latches 2012A and 2012B are configured to support a stand 2022 in an upright position. FIG. 20 also shows schematically sensors 2011, which may be the same as fingerboard latch position sensor 111, as shown in FIG. 1B. Sensors 2011 are configured to determine whether a particular latch is open or closed, and transmit an associated open/closed position for that particular latch to a controller (e.g., controller 120, as shown in FIG. 1B). When a fingerboard latch is open (or several fingerboard latches are open), the stand may be removed from the fingerboard via pipe racker 131. Thus, fingerboard latch position sensor 111 (or sensors 2111) are configured to provide a position of the fingerboard latch (the position being open or closed). In some embodiments, fingerboard latch position sensor 111 is Latch Hawk® by Salunda.

Figure 15:
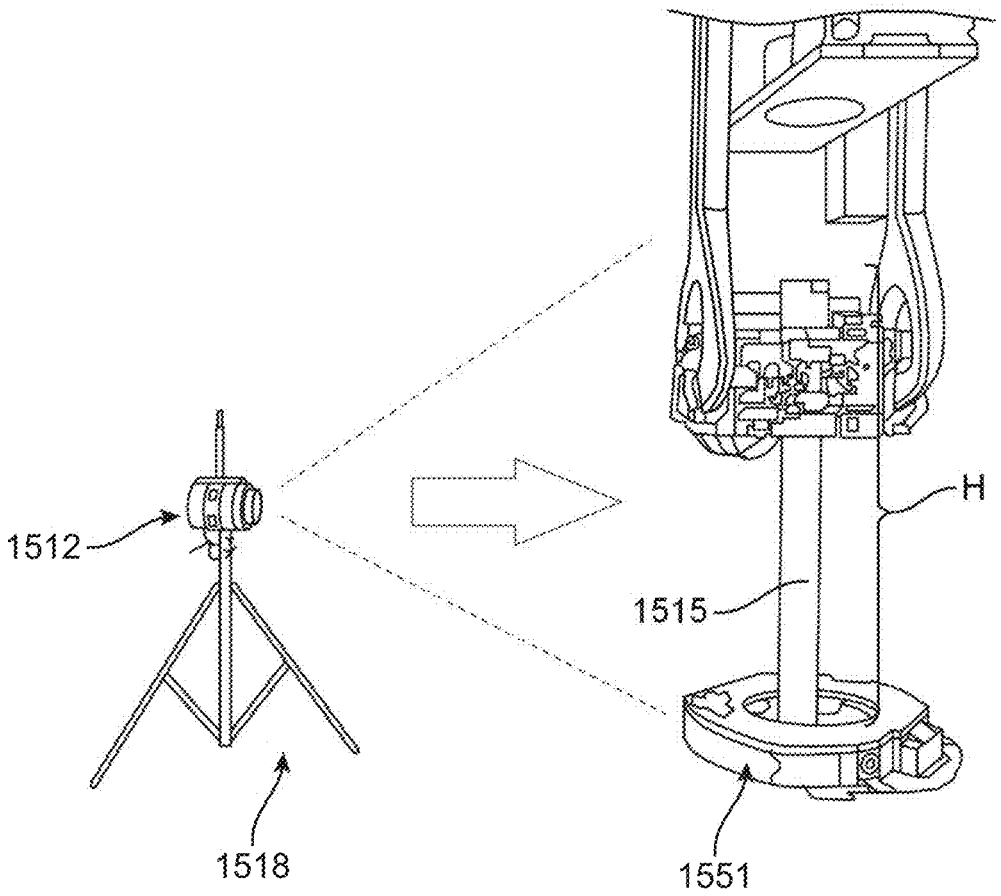
FIG. 15 is an example of a stick-up height sensor for determining a height of a tubular segment secured at a well center according to an embodiment.

Besides fingerboard latch position sensor 111, the example embodiment of system 100 includes a stick-up height sensor 112. Automating the height adjustment of pipe handling equipment removes the requirement of having a person manually adjust the equipment and the time take to do the task. A person is also removed from the hazardous area where adjustment of iron roughneck 133 may take place. An example stick-up height sensor 1512 is shown in FIG. 15 and is configured to measure a height H of a drill pipe portion 1515. In an example embodiment, stick-up height sensor 1512 is the same as the stick-up height sensor 112, as shown in FIG. 1B. During well construction, the measurement of height H is needed to determine a height at which the next stab of drill pipe needs to be transported for connecting with drill pipe portion 1515, as shown in FIG. 15. Stick-up height sensor 112 may be any suitable sensor for determining a height of the drill pipe portion to which the next stab of the drill pipe needs to be connected. For example, stick-up height sensor 112 may be a Lidar, a time-of-flight measuring device, a device having a camera, a device having multiple lasers or cameras that can be used in for a triangulation procedure, an ultrasound device, and/or combination thereof. In some cases, near field communication (NFC) devices may be used as well. In other cases, stick-up height sensor 112 may be a system of sensors capable of submitting data to controller 120. In some cases, the system of sensors may be configured to exchange data, with at least one sensor in the system of sensors capable of submitting data to controller 120. In some implementations, stick-up height sensor 112 is disposed on or around a drill floor (e.g., a floor surface surrounding the rig well center) and configured to detect a height from the drill floor to a tool joint (the tool joint corresponds to a top portion of the drill pipe) of an existing drill pipe (e.g., the drill pipe located in the well center) that is secured in the well center using, for example, power slips 138. An example drill floor 1518 and an example rig well center 1551 is shown in FIG. 15.

In an example embodiment, once the height H (as shown in FIG. 15) is determined, controller 120 is configured to operate pipe racker 131 to pick up a stand of the drill pipe and lower it such that a lower end of the stand is at a height H, and is capable of being connected to an upper end of the portion of the drill pipe located in the rig well center (e.g., portion 1515, as shown in FIG. 15, and herein referred to as a stump). Further, pipe racker 131 is configured to stab the stand into the stump. Subsequently, an iron roughneck is configured to connect the stand and the stump, as further described below.

In various embodiments, elevator 135 latches to the stand using an elevator latch 136 once the stand is connected to the stump. Further, elevator 135 is configured to hoist the drill pipe once power slips 138 that is holding the stump is opened. In some cases, elevator 135 and elevator latch 136 for handling stands of drill pipe are connected to a top drive 134. In an example embodiment, top drive 134 may additionally engage with a stand of a drill pipe via a pipe handler (e.g., the pipe handler may be a suitable device for holding securely the stand of the drill pipe). Further, in some implementations, top drive 134 is configured to rotate the pipe handler, thus rotating axially the stand that is being held by the pipe handler. In the example embodiment, as shown in FIG. 1B, pipe handler is configured to be rotated, and the rotations of the pipe handler are configured to be monitored by pipe handler rotation sensor 113. In an example implementation, pipe handler rotation sensor 113 is configured to be disposed on the pipe handler and configured to detect one of a position or a rotation of the pipe handler or combination thereof. Further, pipe handler rotation sensor 113 may be configured to determine a rate of rotation of the pipe handler, and/or motion of the pipe handler (e.g., how quickly the pipe handler is moving up or down during the rotation of the pipe handler). In some embodiments, pipe handler rotation sensor 113 is a rotary encoder.

Figure 25A:
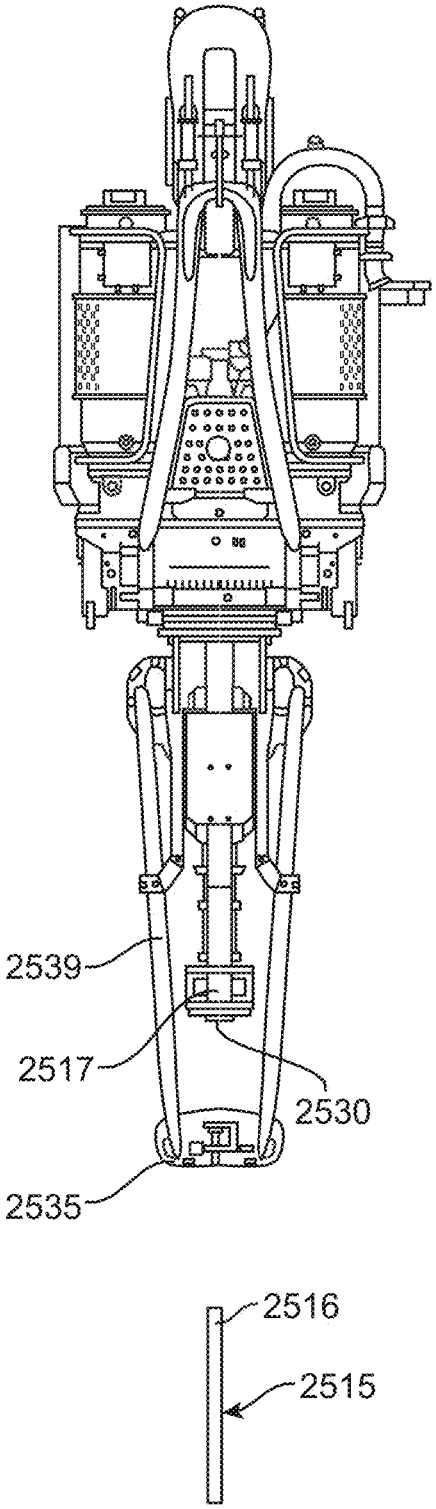
FIG. 25A is an example of a top drive supporting an elevator according to an embodiment.
Figure 25B:
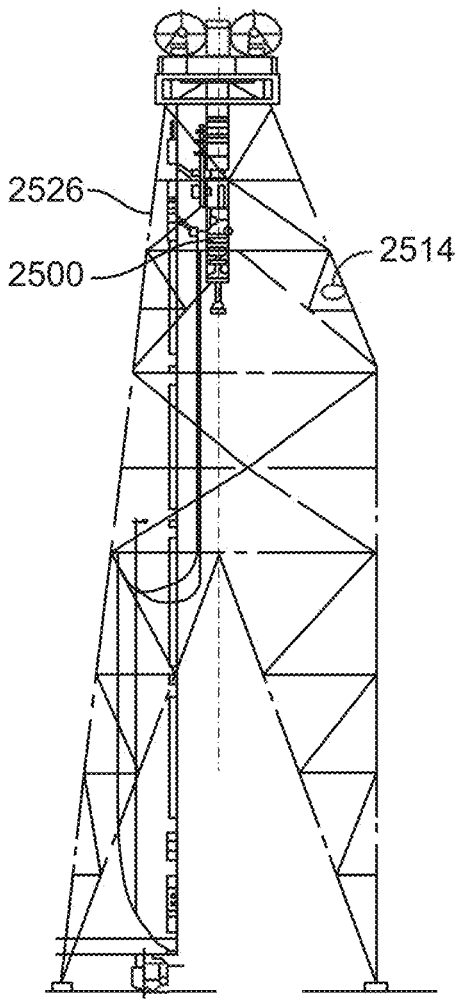
FIG. 25B is an example of a derrick configured to support a sensor for measuring a position of a bell guide according to an embodiment.

Further, in the example embodiment, system 100 includes a bell guide clearance sensor 114 on a top drive 134 or attached to a derrick and configured to measure a distance between a bell guide and a tool joint. An example top drive 2500 and a bell guide 2530 is shown in FIG. 25A, and FIG. 25B shows an example derrick 2526 with bell guide clearance sensor 2514 attached to derrick 2526. Bell guide clearance sensor 2514 may be structurally the same as bell guide clearance sensor 114 and may function in the same way as bell guide clearance sensor 114. As shown in FIG. 25A, bell guide 2530 is a structure at a bottom portion of pipe handler 2517. A conventional bell guide is a rigid and generally inverted, funnel-shaped housing that may be coupled to the bottom of pipe handler 2517 and used to engage and steer the top end of a stand (e.g., a top end 2516 of a stand 2515, as shown in FIG. 25A) into the bore of the tapered bowl beneath the gripping zone of top drive 2500. In an example embodiment, elevator 2535 may be structurally the same as elevator 135 (shown in FIG. 1B) and may function the same as elevator 135. As elevator 2535 is latched around the pipe, top drive 2500 is lowered over top end 2516 of stand 2515, top end 2516 engages the sloped interior surface of bell guide 2530 prior to being coupled to a shaft of top drive 2500. As seen in FIG. 25A, pipe handler 2517 may be placed above elevator 2535 and may be configured to connect to top end 2516 (herein also referred to as a top portion 2516 or upper portion 2516) of stand 2515 of a drill pipe. In an example implementation, top end 2516 is also referred to as a tool joint. Further, the tool joint is referred to a top portion 2516 of stand 2515.

In various embodiments, it is important to determine whether top drive 2500 is kept clear from top portion 2516, and such determination is accomplished by bell guide clearance sensor 2514. In an example implementation, bell guide clearance sensor 2514 is configured to determine the distance between a bell guide (e.g., bell guide 2530) and a tool joint (e.g., top end 2516). Bell guide clearance sensor 2514 may be implemented as an optical sensor (e.g., Lidar, one or more lasers, one or more cameras, and the like). In some cases, bell guide clearance sensor 2514 may take images that may be processed by a controller (e.g., controller 120, as shown in FIG. 1B) via a computer vision algorithm. In an example implementation, a dolly of a top drive (e.g., top drive 2500) is configured to extend based on a confirmation from bell guide clearance sensor 2514 that the bell guide is clear of top end 2516.

Returning to FIG. 1B, in the example embodiment, system 100 includes a link tilt position sensor 115. In an example implementation, link tilt position sensor 115 is disposed on a bail hanging from a top drive and configured to measure an angle of a bail (e.g., bail 2539) with respect to a top drive (e.g., top drive 2500). Link tilt position sensor 115 permits controller 120 to receive confirmation that the bails have returned to float position, and it is safe to hoist drawworks 137 and top drive 134. In addition, link tilt position sensor 115 permits controller 120 to receive confirmation that the elevator 135 is at the correct angle to receive tubulars and latch. FIG. 25A shows an example of a bail 2539 configured to support elevator 2535. In an example, a particular angle of bail 2539 is selected to receive and handle various tubulars (e.g., to receive stands of drill pipe from a pipe racker). In an example implementation, when receiving a stand from a pipe racker, a bail may be angled, and an elevator may pick up the stand via coupling to the stand using an elevator latch. Subsequently an angle of the bail is changed (e.g., angle of the bail becomes zero, indicating that the elevator is directly at the bottom of a top drive). In some embodiments, link tilt position sensor 115 is disposed elsewhere besides the bail hanging from the top drive. For example, link tilt position sensor 115 may be disposed on a surface of the top drive (e.g., a surface of the top drive adjacent to the bail), or on any other part of the drilling structure or equipment (e.g., on a derrick) which provides an unobscured view of the bail. Similar to a bell guide clearance sensor 114, link tilt position sensor 115 may be implemented as an optical sensor (e.g., Lidar, one or more lasers, one or more cameras, and the like). In some cases, link tilt position sensor 115 may take images that may be processed by a controller (e.g., controller 120, as shown in FIG. 1B) via a computer vision algorithm to determine angle for the bail. In some cases, link tilt position sensor 115 can be an angle sensor or a potentiometer.

Further, in the example embodiment, system 100 includes an elevator latch status sensor 116 configured to detect whether the elevator latch is open or closed. Elevator latch status sensor 116 permits controller 120 to receive confirmation that it is safe to hoist drawworks 137 and take weight of drill pipe from power slips 138. Sensing the status of the elevator latch 136 permits automation interlock and the control of drawworks 137 and power slips 138—drawworks 137 will not be allowed to hoist while elevator latch 136 is not closed, and power slips 138 will not be allowed to open, thereby removing the need for a 'spotter' to confirm the status of the elevator latch. Elevator latch status sensor 116 can be disposed on any portion of elevator 135. In one example implementation, elevator latch status sensor 116 may be disposed on an elevator latch. Alternatively, elevator latch status sensor 116 may be a pressure sensor disposed at the elevator latch. In various implementations, elevator latch status sensor 116 may be any suitable sensor (e.g., optical sensor, pressure sensor, proximity sensor, and the like).

Additionally, system 100 includes a power slips sensor 117. Power slips sensor 117 is configured to detect whether the power slips 138 is open or closed. Power slips sensor 117 permits controller 120 to receive confirmation that power slips 138 is closed (set) and it is safe for the power slips 138 to take full weight of the drill pipe, or that powers slips 138 is fully open and thus unhindered movement of the drill pipe through power slips 138 is allowed. Accordingly, controller 120 will not open elevator 135 if power slips 138 is not set/closed (thus holding weight), thereby removing the need for a 'spotter' to confirm the status of power slips 138. Similar to elevator latch status sensor 116, power slips sensor 117 may be a potentiometer, an optical sensor, a pressure sensor, or any other type of sensor for determining whether power slips 138 is open or closed (e.g., an electrical sensor). In an example implementation, power slips sensor 117 is disposed on power slips. In an example implementation, elevator latch 136 is configured to: (a) close around a drill pipe (e.g., existing stand of drill pipe that is inserted in a rig well center) when link tilt position sensor 115 confirms that top drive 134 is in a position, and (b) open based on a confirmation from power slips sensor 117 that power slips 138 is closed.

As described above, controller 120 is configured to be in communications with sensors 110 and configured to receive a signal from each sensor from sensors 110 and provide an input for commanding at least one of pipe racker 131, pipe handler, doping system 132, iron roughneck 133, top drive 134, top drive dolly, elevator 135, elevator latch 136, drawworks 137, or power slips 138.

Figure 2A:
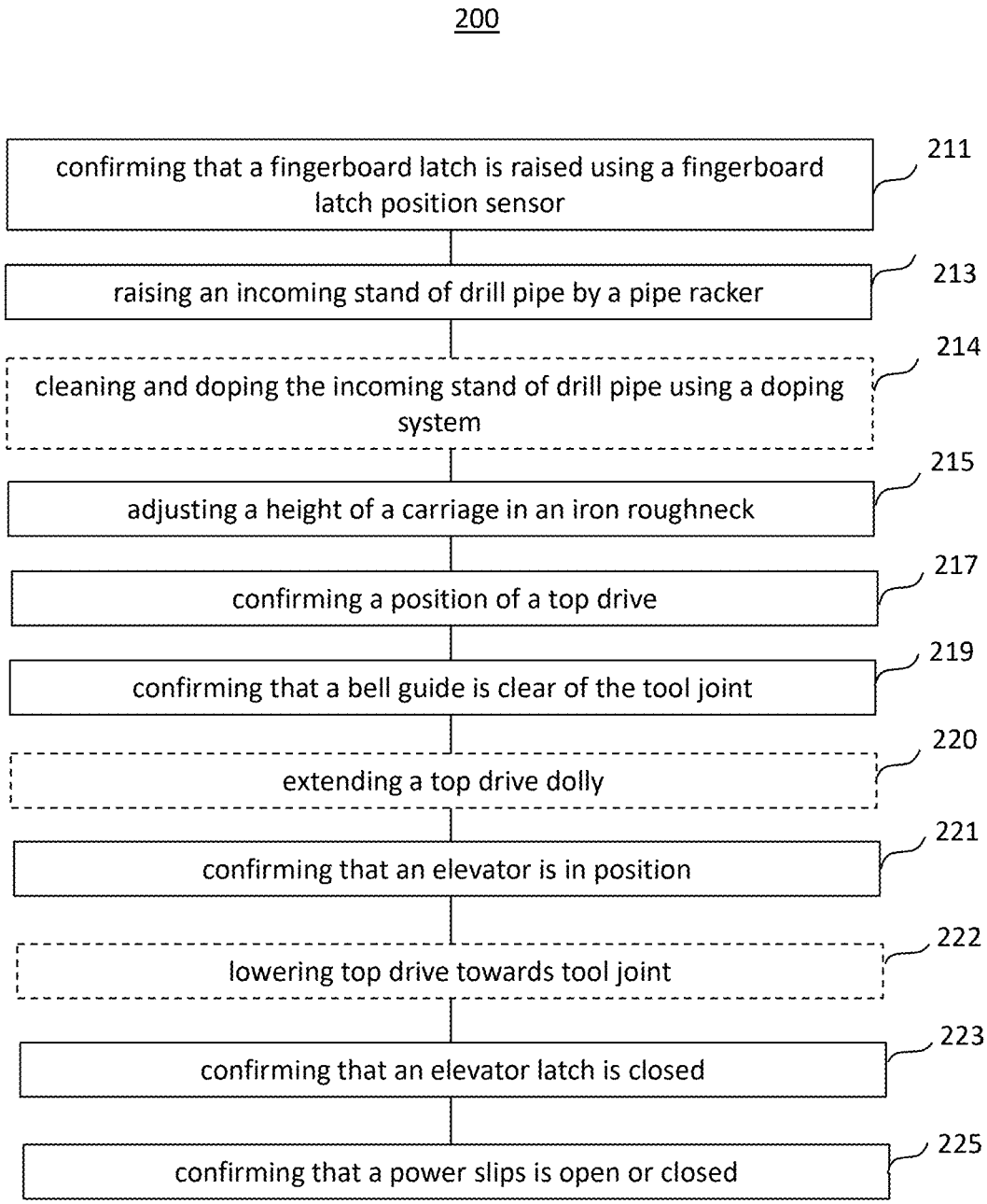
FIG. 2A is an example process for automating tripping drill pipe during well construction according to an embodiment.

FIG. 2A shows an example process 200 for automating tripping drill pipe during well construction, according to an embodiment. Steps of process 200 may be performed by a suitable controller (e.g., controller 120, as shown in FIG. 1A or 1B).

Prior to starting process 200, a human operator (herein, referred to as a driller) configures the automated system to perform a trip in sequence. The driller may input a depth that needs to be reached by a drill pipe. In some cases, system 100, as shown in FIGS. 1A and 1B is configured to perform a self-check and to confirm that all pre-requisites have been met. Subsequently, system 100 alerts the driller that the trip in sequence is ready to proceed. The driller then may push a 'Start' button on the user interface (UI) and system 100 will begin the trip in sequence.

At step 211 of process 200, controller 120 is configured to confirm that a fingerboard latch is raised using a fingerboard latch position sensor. In some cases, position of more than one fingerboard latches may be confirmed. If the fingerboard latch is raised (herein also referred to as opened), at step 213, an incoming stand of drill pipe (e.g., the stand of drill pipe from the fingerboard) is raised (or picked) by a pipe racker. In an example implementation, raising an incoming stand of drill pipe by a pipe racker is based on a signal from a stick-up height sensor, which is configured to detect a height from the drill floor to a tool joint of an existing drill pipe that is secured in a well center. In an example implementation, the stick-up height sensor is disposed on or around a drill floor. At step 213, the pipe racker is configured to position itself at the correct fingerboard slot ready to retrieve a stand of a drill pipe (in some cases, if the pipe racker is already at the correct fingerboard slot, no repositioning of the pipe racker is required). The pipe racker arms are configured to extend to retrieve the stand, while one or more fingerboard latches are raised, and status confirmed with a fingerboard latch position sensor. As part of step 213, the pipe racker lifts and retracts the stand, and turns and travels to designated cleaning and doping location. At an optional step 214, the pipe racker is paused allowing for the stand of drill pipe to be cleaned and doped by a doping system. As described before, doping includes lubricating various parts of the stand. In an example implementation of step 214, controller 120 of system 100 is configured to start a cleaning and doping procedure after the pipe racker has stopped. Once the doping is complete, the racker may turn, and travel to a rig well center. The pipe racker is configured to raise the stand of drill pipe based on feedback from the stick-up height sensor and extend the stand to the rig well center.

At step 215, a carriage of an iron roughneck is adjusted, based on a signal from the stick-up height sensor. For example, when the stick-up height sensor indicates that the carriage is below a top portion of a stand of drill pipe located in a rig well center (herein, for brevity, referred to as an existing drill pipe), the carriage of the iron roughneck is elevated. Alternatively, if the stick-up height sensor indicates that the carriage is above a top portion of a stand of drill pipe located in a rig well center, the carriage of the iron roughneck is lowered. Otherwise, the carriage is neither elevated nor lowered. As part of step 215, the stand is stabbed into the top portion of the existing drill pipe being held by power slips, and at confirmation of a successful stab, controller 120 is configured to initiate the roughneck spin/torques sequence.

At step 217, of process 200, controller 120 is configured to confirm a position of a top drive based on a signal from a pipe handler rotation sensor (herein also referred to as a pipe handler position sensor). The pipe handler position sensor is configured to indicate that the top drive is in a correct position (e.g., above the top portion of the stand that is now connected to the existing drill pipe). Further at steps 219 and 221 other sensors are used to confirm that the top drive is in correct position. For example, at step 219, controller 120 uses information from a bell guide clearance sensor to confirm that a bell guide is clear of the tool joint, and at step 221, controller 120 is configured to confirm that elevator 135 is in a correct position based on a signal from a link tilt position sensor. For example, when the link tilt position sensor indicates that bails are positioned vertically (e.g., angle formed by bails is zero), controller 120 determines that top drive 134 and elevator 135 is in a correct position and that it can be extended by a top drive dolly. Once the top drive is in correct position (after completing steps 219 and 221), the top drive is lowered towards the tool joint at step 222 (e.g., the top drive is extended by a top drive dolly toward the tool joint) such that the elevator can latch around the tool joint. At step 223, controller 120 is configured to confirm that the elevator latch is closed based on a signal from an elevator latch status sensor, and at step 225, controller 120 is configured to confirm (e.g., determine) that a power slips is open or closed based on a signal from a power slips sensor.

In various embodiments, process 200 includes additional and/or optional steps as indicated by step boxes having dashed lines. Herein, unless specified otherwise, dashed lines used around boxes for method steps imply that these steps are either optional or additional. For example, step 214 may be optional, as described above.

Figure 2B:
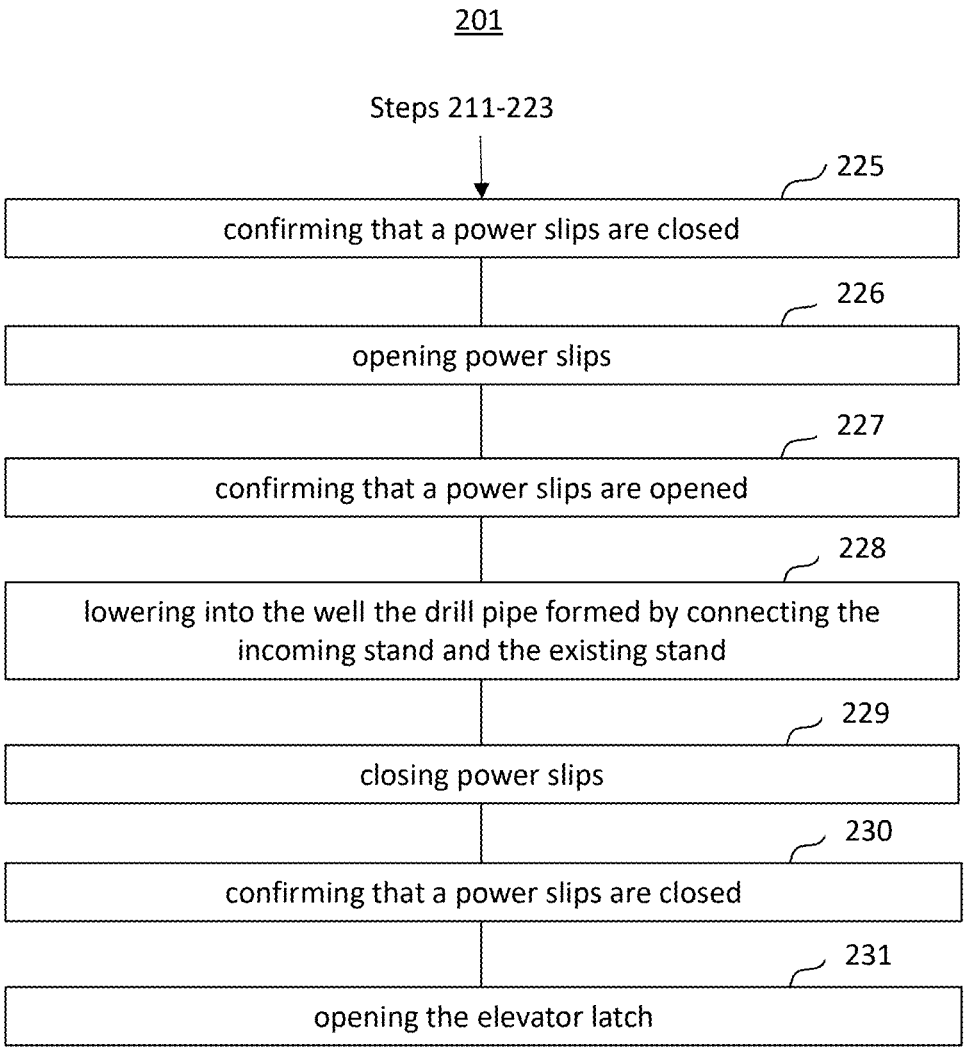
FIG. 2B are additional steps of the process, as shown in FIG. 2A, for automating tripping drill pipe during well construction according to an embodiment.

Additional steps of process 200 are further illustrated in FIG. 2B. For example, after step 225 of process 200, controller 120 is configured to open power slips 138 at step 226 and confirm that the power slips 138 is open at step 227. At step 228, controller 120 is configured to instruct elevator 135 to lower (using drawworks) the drill pipe, while the pipe racker is retrieving the next stand of drill pipe. After completion of step 228 (e.g., when the drill pipe is lowered), at step 229, controller 120 is configured to secure the extending portion of the drill pipe at the well center via power slips 138. At step 230, controller 120 is configured to confirm that power slips 138 is closed, and upon receiving such a confirmation, at step 231 opening elevator latch 136, thus releasing the drill pipe. In various embodiments, the elevator controlled by drawworks will not lower the stand until a confirmation that power slips is open is received by controller 120. Further, controller 120 will not open elevator latch 136 unless power slips 138 is confirmed to be closed and are securing the drill pipe located in the well center.

It should be appreciated that the steps of process 200 may be repeated until a desired number of stands is connected for a required depth of the well.

Figure 2C:
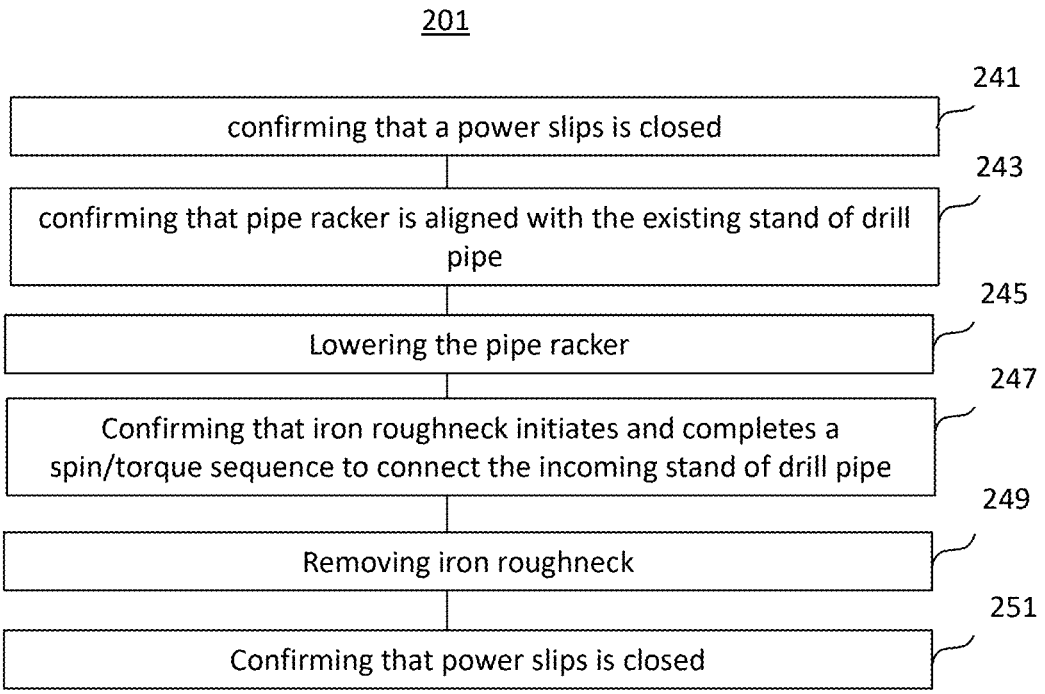
FIG. 2C is another example process for automating tripping drill pipe during well construction according to an embodiment.

FIG. 2C shows another example process 201 that includes connecting an incoming stand with a stump of the existing stand secured at a well center. In an example embodiment, once power slips is confirmed to be closed at step 241, pipe racker 131 is configured to align the stand of drill pipe held by pipe racker 131 with the top portion of the existing drill pipe at step 243, and at step 245, pipe racker 131 is configured to be lowered such that a lower portion of the stand stabs the top portion of the existing drill pipe. In an example embodiment, for aligning the lower portion of the stand and the top portion of the existing pipe, a stab guide may be used. Alternatively, in some cases, an iron roughneck may be used for gripping and centralizing the lower portion of the stand to allow it to be inserted into the top portion of the existing pipe. At step 247, an iron roughneck is configured to initiate and complete a spin/torque sequence to connect the incoming stand of drill pipe (e.g., the stand carried by pipe racker 131) to the existing stand of drill pipe. Upon completion of step 247, at step 249, an iron roughneck is removed, and at step 251, controller 120 is configured to confirm that power slips is closed.

Figure 3:
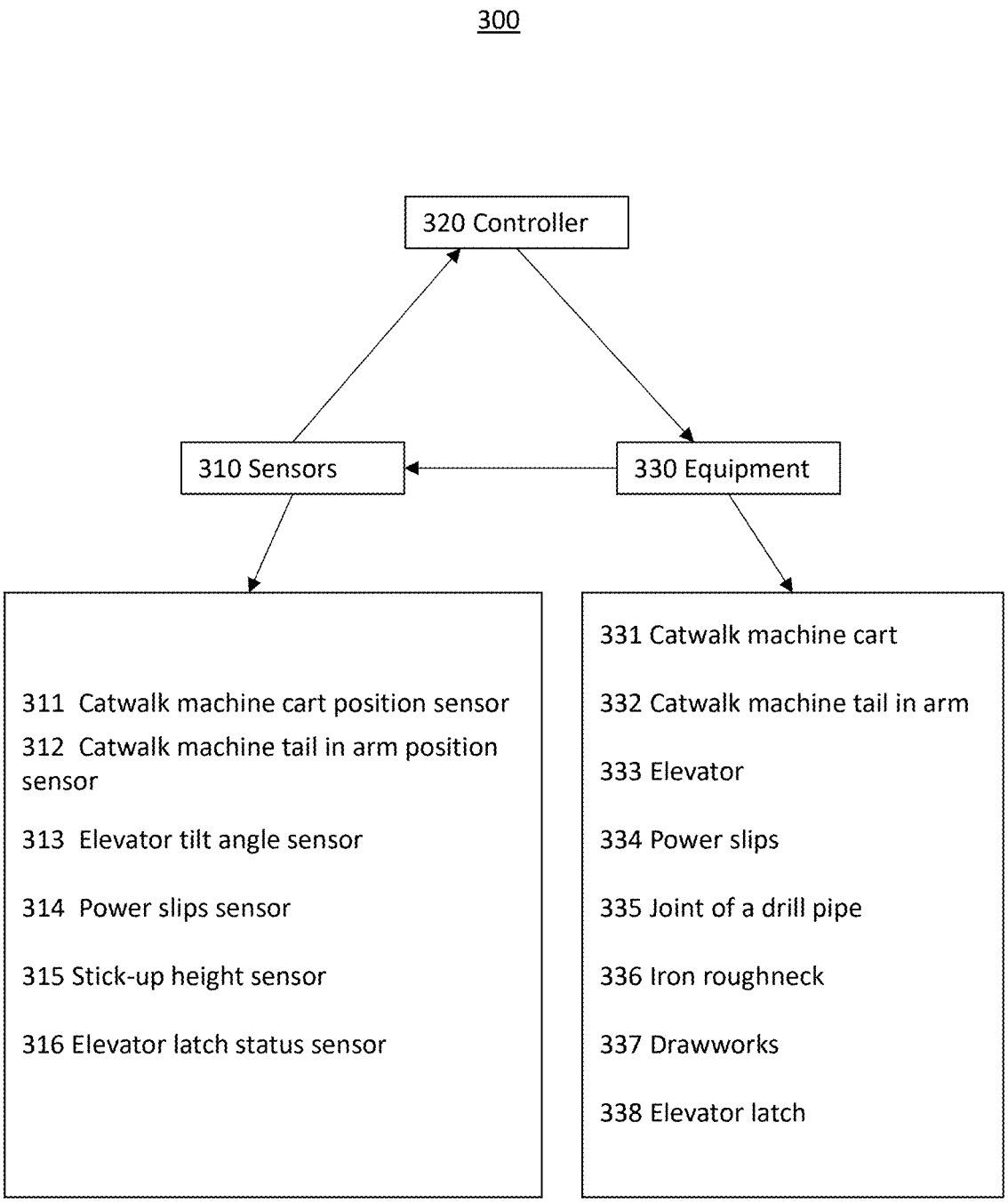
FIG. 3 is an example diagram of a system for automating stand building during well construction according to an embodiment.

FIG. 3 shows an example diagram of a system 300 for automating stand building during well construction, according to an embodiment. An example stand is assembled by connecting together multiple drill pipe segments. In an example embodiment system 300 includes a set of sensors 310 configured to determine various parameters of operation of equipment 330. Equipment 330 may include any suitable equipment that can be used for stand building during the well construction.

In the example embodiment, as shown in FIG. 3, equipment 330 includes catwalk machine cart 331, catwalk machine tail in arm 332, elevator 333, power slips 334, iron roughneck 336, drawworks 337, and elevator latch 338. In various embodiments, the equipment 330 also includes joints of drill pipes (e.g., a joint of a drill pipe 335, as shown in FIG. 3).

Catwalk machine cart 331 is configured to move tubulars (e.g., drill pipes, or other tubulars) along a catwalk towards a drill floor. In an example embodiment, the tubulars may be placed in catwalk machine cart 331 via a suitable pipe handling equipment such as a crane. For example, the catwalk manipulation arm is configured to retrieve tubulars from a storage location and place them onto catwalk machine cart 331.

Catwalk machine trail in arm 332 is configured to pick up the tubulars from catwalk machine cart 331 and prepare them to be picked up by elevator 333. In an example embodiment, elevator 333 may be structurally and functionally the same as elevator 135 shown in FIG. 1B. The tubulars then may be placed by elevator 135 into a suitable receiving housing on a drill floor (note that the receiving housing may be different from the rig well center, and herein, is referred to as an auxiliary rig well center or, simply, as an auxiliary well center) and secured by power slips 334 associated with that housing.

Various embodiments of automated system 300 include sensors 310 for monitoring operations of equipment 330 and for providing data to controller 320. In the example embodiment of system 300, as shown in FIG. 3, sensors 310 include catwalk machine cart position sensor 311, catwalk machine tail in arm position sensor 312, elevator tilt angle sensor 313, power slips sensor 314, a stick-up height sensor 315, and elevator latch status sensor 316. Power slip sensor 314 and stick-up height sensor 315 may be structurally and functionally the same as associated respective sensors 117 and 112, as shown in FIG. 1B.

In an example embodiment, catwalk machine cart position sensor 311 is configured to determine a position of the catwalk machine cart 331. For example, catwalk machine cart position sensor 311 may determine a position of catwalk machine cart 331 relative to a position of a fixed reference object (e.g., a well center), or relative to an elevator 333 (e.g., a movable object). Similar to other sensors discussed herein, catwalk machine cart position sensor 311 may be an encoder, an optical sensor (e.g., include Lidar, one or more cameras, a system of lasers, a time-of-flight devices, and the like), ultrasound sensors (e.g., sensors configured to generate and receive ultrasound waves), electrical sensors (e.g., sensors for detecting resistivity along a circuit), or any other suitable sensors for determining position of catwalk machine cart 331 (e.g., NFC devices configured to determine the distance based on an attenuation of a signal). In some cases, catwalk machine cart position sensor 311 may be formed from a distributed network of sensors, and in some cases, catwalk machine cart position sensor 311 may have a system of redundant sensors. It should be appreciated that description of catwalk machine cart position sensor 311 is not exclusive to catwalk machine cart position sensor 311, and various other sensors of automating system 300 (or system 100) may be formed in the same way, in a similar way or using similar technology as catwalk machine cart position sensor 311. For example, other sensors may be formed from a distributed network of sensors, and in some cases, may have a system of redundant sensors. Catwalk machine cart position sensor 311 may be part of catwalk machine cart 331, or may be placed elsewhere (e.g., on a catwalk, at a drill floor, and the like). catwalk machine cart position sensor 311 is configured to provide a position reference for controller 320 for determining a location of an end of a tubular section (e.g., a tool joint) on the catwalk machine while feeding tubulars to elevator 333. Using sensor 311 allows for removal of a human error from the task of lining up a tool joint with elevator 333. Further, automation allows for removal of an operator from the hazardous drilling floor area where the tubular sections are being handled.

In an example embodiment, catwalk machine tail in arm position sensor 312 is configured to determine a position and orientation of a particular region of catwalk machine tail in arm 332. For example, catwalk machine tail in arm position sensor 312 is configured to determine a position and an orientation of a roller and trap arm of catwalk machine tail in arm 332. The roller and trap arm is a part of catwalk machine tail in arm 332 configured to grip tubulars. Similar to catwalk machine cart position sensor 311, sensor may be an encoder, an angle sensor, an optical sensor, ultrasound sensor, electrical sensor, NFC device (e.g., Bluetooth bases sensor or radio-based sensor), and the like. In an example embodiment, catwalk machine tail in arm position sensor 312 may include a plurality of sensors (e.g., a first sensor for determining a position of the roller and trap arm and a second sensor for determining orientation of the roller and trap arm). In an example embodiment, catwalk machine tail in arm position sensor 312 may be part of catwalk machine tail in arm 332, or it may be placed elsewhere (e.g., on a drilling floor). In some cases, the second sensor for determining orientation of the roller and trap arm is located at the roller and trap arm of catwalk machine tail in arm 332, and the first sensor for determining a position of the roller and trap arm is located elsewhere (e.g., on the drilling floor). Sensor 312 provides data to controller 320 to adjust a height of the equipment receiving a tubular section from catwalk machine tail arm 332 (or height of catwalk machine tail arm 332) to connect to another tubular section that is being secured in the auxiliary well center. Using catwalk machine tail in arm position sensor 312 allows for removal of a human error from the task of manually adjusting position of various equipment for handling tubular sections. Further, automation allows for removal of an operator from the hazardous drilling floor area where the tubular sections are being handled.

Further, system 300 includes the elevator tilt angle sensor 313. Elevator tilt angle sensor 313 enables automation by transmitting data about the tilt angle of elevator 333 to controller 320. Controller receives data for the tilt angle and determines whether elevator 333 is at a correct angle to receive tubulars and whether the tilt angle is correct to use elevator latch to hold the tubulars (e.g., to latch to the tubulars). In various embodiments, controller 320 is configured not to feed tubulars to an auxiliary well center if elevator 333 is not oriented at the correct tilt angle to receive the tubulars, and/or to latch to tubulars.

In an example embodiment, a power slips sensor 314 is configured to be disposed on power slips 334 and is configured to detect whether power slips 334 is open or closed. Further, stick-up height sensor 315 is configured to be disposed on or around a drill floor and configured to detect a height from the drill floor to a tool joint of a tubular section that is being secured in the auxiliary well.

As described above, controller 320 is configured to be in communications with sensors 310 and configured to receive a signal from each sensor from sensors 310 and provide an input for commanding at least one of catwalk machine cart 331, catwalk machine tail in arm 332, elevator 333, power slips 334, iron roughneck 336, or drawworks 337. Further controller 320 is configured to operate on a joint of drill pipe 335.

In various embodiments, controller 320 is configured to confirm the position and/or height of a tool joint of a tubular section (e.g., a tool joint of a first section of a drill pipe, which, herein, is also referred to as a first joint of a drill pipe), and subsequently (or in parallel) confirm a position and/or angle of elevator 333. Further, controller 320 is configured to confirm that the power slips 334 is open or closed and confirm the position of the catwalk machine tail in arm 332.

Further, after the position and angle of elevator 333 is confirmed to be correct, controller 320 is further configured to initiate or alert a driller to initiate a programmed sequence of tasks to close elevator 333 on the tool joint of the first joint of a drill pipe, raise the first joint by a drawworks, guide the first joint to an auxiliary well center by catwalk machine tail in arm 332 using the signal from catwalk machine tail in arm position sensor 312, open power slips 334 associated with the auxiliary well center, retract catwalk machine tail in arm 332, lower the first joint using elevator 333 operated by the drawworks into the power slips 334, close the power slips 334, connect a second joint of a drill pipe to the first joint, or a combination thereof.

Figure 4:
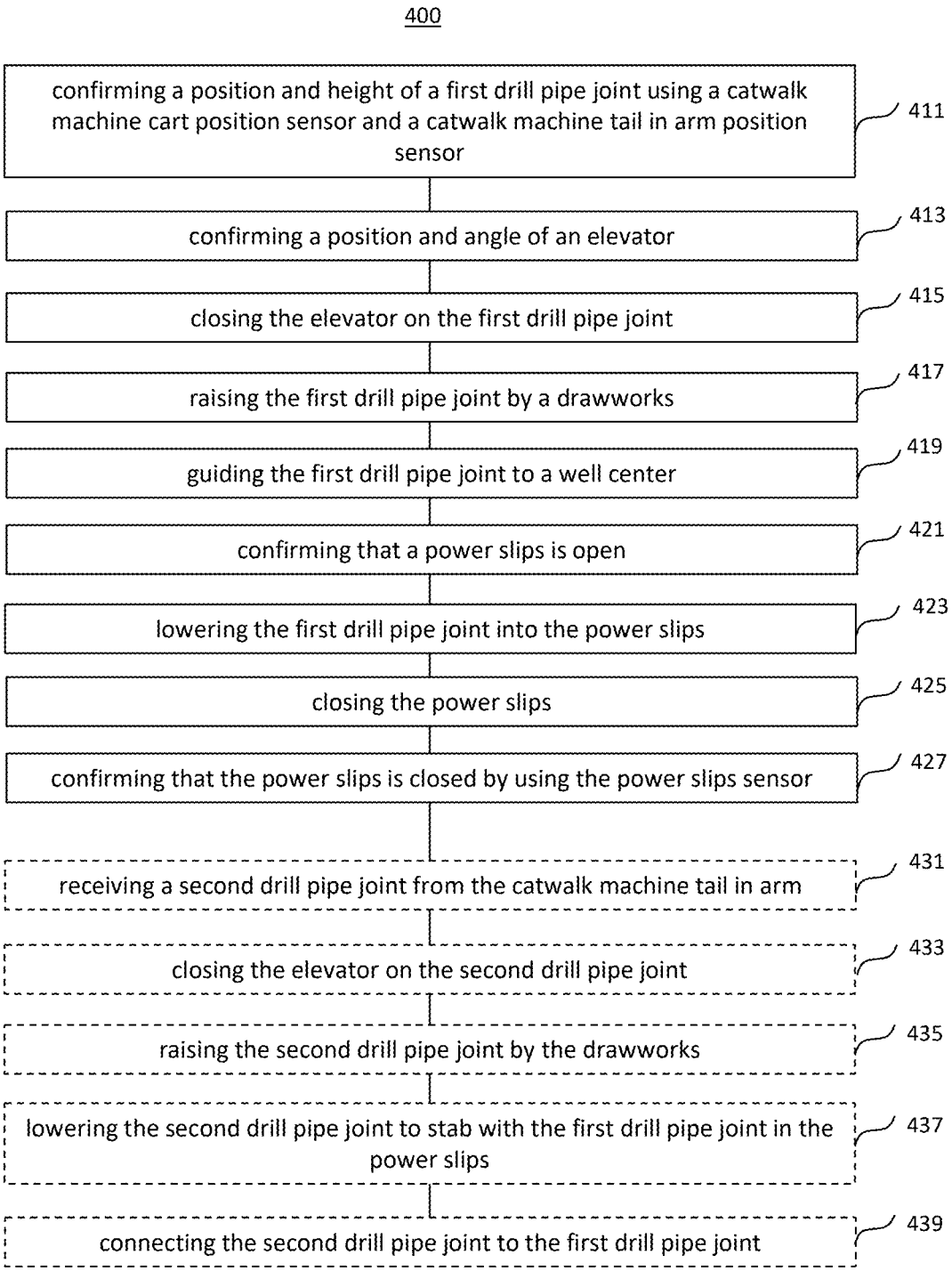
FIG. 4 is an example process for automating stand building during well construction according to an embodiment.

FIG. 4 shows an example process 400 for automating stand building during a well construction according to an embodiment. Steps of process 400 may be performed by a suitable controller (e.g., controller 320, as shown in FIG. 3).

Prior to starting process 400, a human operator (herein, referred to as a driller) configures automated system 300 (as shown in FIG. 3) to perform a stand building sequence. The driller may input a number of tubular sections (e.g., joints of a drill pipe) to build and identify a rack from which to retrieve the tubular sections. In some cases, system 300 is configured to perform a self-check and to confirm that all pre-requisites have been met. Subsequently, system 300 alerts the driller that the stand building sequence is ready to proceed. The driller then may push a 'Start' button on the user interface (UI) and system 300 will begin the stand building sequence.

At step 411 of process 400, controller 320 is configured to confirm a position and height of a first segment of a drill pipe (the first drill pipe joint) using a catwalk machine cart position sensor (e.g., catwalk machine cart position sensor 311) and a catwalk machine tail in arm position sensor (e.g., catwalk machine tail in arm position sensor 312). In some cases, as described above, multiple sensors may be used to achieving a redundancy in determining the position and height of a first segment of a drill pipe. Further, determining the position and the height of the first joint includes determining orientation of the first joint.

Following step 411, at step 413 controller 320 is configured to confirm a position of an angle of an elevator (e.g., elevator 333, as shown in FIG. 3). As described above, a tilt angle of elevator 333 is selected for elevator 333 to be able to receive the first joint and to latch to the first joint.

At step 415 of process 400, controller 320 submits a command signal to elevator 333 to close elevator 333 on the first drill pipe joint (e.g., elevator 333 is configured to latch to the first drill pipe joint upon receiving a command from controller 320).

At step 417, after latching to the first drill pipe joint, elevator 333 is configured to raise the first drill pipe joint with a use of drawworks.

At step 419, controller 320 is configured to submit a command either to elevator 333, to catwalk machine tail in arm, or combination thereof to guide the first drill pipe joint to an auxiliary well center (or, in some cases, to a well center). In an example implementation, the guiding of the first drill pipe is accomplished via a signal from a catwalk machine tail in arm position sensor (e.g., sensor 312, as shown in FIG. 3). For example, sensor 312 is configured to indicate position and orientation of a roller and trap arm of a catwalk machine tail in arm (e.g., arm 332, as shown in FIG. 3), and indicate a position and orientation of the first drill pipe, thus, providing the guiding for the first drill pipe joint. In some cases, elevator 333 may be configured to hold a first end of the first drill pipe joint, and catwalk machine tail in arm 332 may be configured to hold a second end of the first drill pipe joint. In some cases, while the second end may be held by catwalk machine tail in arm 332, arm 332 may allow the first drill pipe joint to be moved relative to arm 332 (e.g., arm may support the first drill pipe joint, but may not latch to the first drill pipe joint).

At step 421, after bringing the first pipe joint to an auxiliary well center, controller 320 is configured to confirm that a power slips (e.g., power slips 334) associated with that well center is open. The status of whether power slips 334 is open or closed is indicated by a power slip sensor 314.

At step 423, controller 320 is configured to guide elevator 333 to lower the first drill pipe joint into the power slips, and at step 425, after the first drill pipe joint is put in place into the auxiliary well center, controller 320 is configured to close power slips 334. Further, at step 427, controller 320 is configured to confirm that power slips 334 is closed by using the power slips sensor.

In various embodiments, process 400 may include additional and/or optional steps. For example, additional steps of process 400 are further illustrated in FIG. 4 by dashed lines. For example, after step 427 of process 400, at step 431, controller 320 facilitates receiving a second drill pipe joint from the catwalk using catwalk machine tail in arm 332. For example, controller 320 submits signals for catwalk machine tail in arm 332 to pick up the second drill pipe joint. In an example implementation of process 400, controller 320 may employ machine vision to guide arm 332 towards the second drill pipe joint, and to pick up the second drill pipe joint. Alternatively, arm 332 may be operated by a human operator once controller 320 determines that the second drill pipe joint needs to be picked.

As part of step 431, the second drill pipe joint is brought to elevator 333 (provided that elevator 333 released a previously held first drill pipe joint) by arm 332. At step 433, elevator 333 is configured to latch to the second drill pipe joint, and at step 435, elevator 333 is configured to raise the second drill pipe joint, wherein the rising is facilitated by drawworks. At step 437, elevator 333 is configured to lower the second drill pipe joint to stab with the first drill pipe joint that is being held in power slips 334. It should be appreciated that various actions of elevator 333 are determined by controller 320 based on output of sensors 310.

At step 439 controller 320 is configured to instruct an iron roughneck to connect the first and the second drill pipe joints by rotating the second drill pipe joint relative to the first drill pipe joint. The iron roughneck may be the same (or different) roughneck as iron roughneck 133, as shown in FIG. 1B. For example, iron roughneck 133 may be configured to serve both a well center and an auxiliary well center. Alternatively, for the auxiliary well center a second iron roughneck may be used. It should be appreciated that steps of process 400 may be repeated until a desired number of drill pipe joints is connected.

Figure 5:
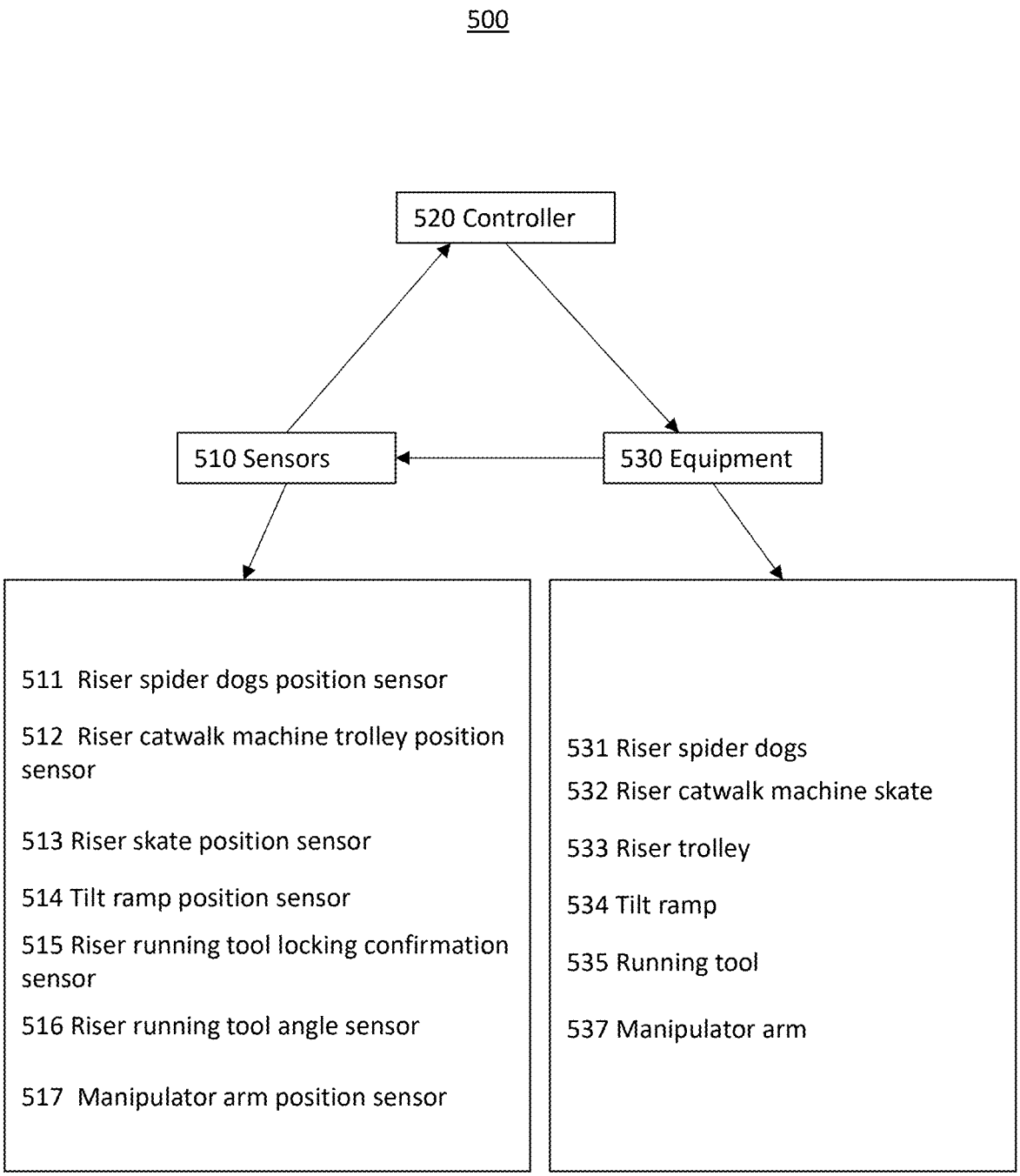
FIG. 5 is an example diagram of a system for automating riser running during well construction according to an embodiment.

FIG. 5 shows an example diagram of a system 500 for automating riser running during well construction, according to an embodiment. An example riser is assembled by connecting together multiple riser segments (herein, also referred to as riser joints). In an example embodiment, system 500 includes a set of sensors 510 configured to determine various parameters of operation of equipment 530. Equipment 530 may include any suitable equipment that can be used for riser running during well construction.

In the example embodiment, as shown in FIG. 5, equipment 530 includes riser spider dogs 531, a riser catwalk machine skate 532, a riser trolley 533, a tilt ramp 534, a running tool 535, and a manipulator arm 537. In various embodiments, the equipment 530 also includes riser joints.

Riser spider dogs 531 are configured to hold a riser joint in place in at a rig well center, via coupling to the riser joint (e.g., riser spider dogs 531 are configured to press into the riser joint, to hold riser joint in place). Riser catwalk machine skate 532 is configured to transport a riser joint from a suitable storage location along a catwalk towards a drill floor, and riser trolley 533 is configured to move relative to riser catwalk machine skate 532 and transport a riser joint to the drilling floor. In an example implementation, riser trolley 533, travels on rails between the pipe-deck area and a well center. Riser trolley 533 may be loaded horizontally with a riser joint in its aft-most position. Riser trolley 533 may be configured to travel forward via rack and pinion drives to present a horizontal riser joint at the drilling floor. Tilt ramp 534 together with manipulator arm 537 are configured to lift the riser joint and hand it to running tool 535.

Various embodiments of automated system 500 include sensors 510 for monitoring operations of equipment 530 and for providing data to controller 520. In the example embodiment of system 500, as shown in FIG. 5, sensors 510 include a riser spider dogs position sensor 511, a riser catwalk machine trolley position sensor 512, a riser skate position sensor 513, a tilt ramp position sensor 514, a riser running tool locking confirmation sensor 515, a riser running tool angle sensor 516, and a manipulator arm position sensor 517.

Riser spider dogs position sensor 515 is configured to indicate whether riser spider dogs 531 are open or closed. Riser spider dogs 531 are closes when they are securing a riser joint in a spider at a well center. Riser spider dogs position sensor 515 permits controller 520 to receive confirmation that the riser is locked and supported by the spider, or that the dogs are fully open and thus the unhindered movement of riser through the spider is allowed. Automation based on riser spider dogs position sensor 515 will prevent any foreign object from entering the spider gimbal work area, removes the possibility of the foreign object colliding with moving riser or traveling assembly, and removes the need for a 'spotter' to confirm the status of the riser spider dogs. In some embodiments, riser spider dogs position sensor 515 is a proximity sensor.

In an example embodiment, riser catwalk machine trolley position sensor 512 may be structurally and/or functionally similar to catwalk machine cart position sensor 311, as shown in FIG. 3. For example, sensor 512 may determine a position of catwalk machine trolley 532 relative to a position of a fixed reference object (e.g., a well center). Similar to other sensors discussed herein, sensor 512 may be an optical sensor, ultrasound sensors, or any other suitable sensors for determining position of catwalk machine trolley 532 (e.g., NFC devices configured to determine the distance based on an attenuation of a signal). In some cases, sensor 512 may be formed from a distributed network of sensors, and in some cases, sensor 512 may have a system of redundant sensors.

Similar to riser catwalk machine trolley position sensor 512, riser skate position sensor 513 and a tilt ramp position sensor 514 are configured to sense respective positions of riser skate 533 and tilt ramp 534 respectively. At least sensor 513 may be implemented similarly as sensor 512 (e.g., an encoder or an optical sensor). Used in conjunction with riser catwalk machine trolley position sensor 512, automation removes the manual task and risk of error of lining up the riser joint with riser running tool 535 and removes a 'spotter' from the hazardous area and the risk of collision with a person as the skate moves in either direction.

In an example embodiment, tilt ramp position sensor 514 may be structurally and/or functionally similar to sensor 312. For example, sensor 514 is configured to determine a position and an orientation of a tilt ramp 534. Tilt ramp 534 and is configured to grip riser joints. Similar to other sensors, sensor 514 may be an encoder, an angle sensor, an optical sensor, ultrasound sensor, electrical sensor, NFC device (e.g., Bluetooth bases sensor or radio-based sensor), and the like. In an example embodiment, sensor 514 may include a plurality of sensors (e.g., a first sensor for determining a position of tilt ramp 534 a second sensor for determining orientation of tilt arm 534). In an example embodiment, sensor 514 may be part of tilt ramp 534, or it may be placed elsewhere (e.g., on a drilling floor). In some cases, the second sensor for determining orientation of tilt ramp 534 may be attached to tilt ramp 534, and the first sensor for determining a position of tilt ramp 534 is located elsewhere (e.g., on the drilling floor). Tilt ramp position sensor 514 provides data to controller 520 to adjust a height of the equipment receiving the riser joint from tilt ramp 534 (or height of tilt ramp 534) to connect to another riser joint that is being secured in the well center. Using tilt ramp position sensor 514 allows for removal of human errors from the task of manually adjusting position of various equipment for handling riser joints. Further, automation allows for removal of an operator from the hazardous drilling floor area where the riser joints are being handled.

Manipulator arm position sensor 517 may be configured to be structurally and/or functionally similar to the tilt ramp position sensor 514. In various embodiments, manipulator arm position sensor 517 is configured to determine a position and orientation of manipulator arm 537. For example, manipulator arm position sensor 517 is configured to determine a position and orientation of manipulator arm 537.

In an example embodiment, riser running tool angle sensor 516 is configured to determine a tilt angle of riser running tool 535 such that riser running tool 535 can receive a riser joint and latch to the riser joint. Further riser running tool locking confirmation sensor 515 is configured to provide a locking status of riser running tool 535. For example, when locking confirmation sensor 515 indicates that the riser running tool 535 is locked, a riser joint is secured by riser running tool 535 and riser running tool 535 is configured to translate and orient the riser joint.

Figure 6:
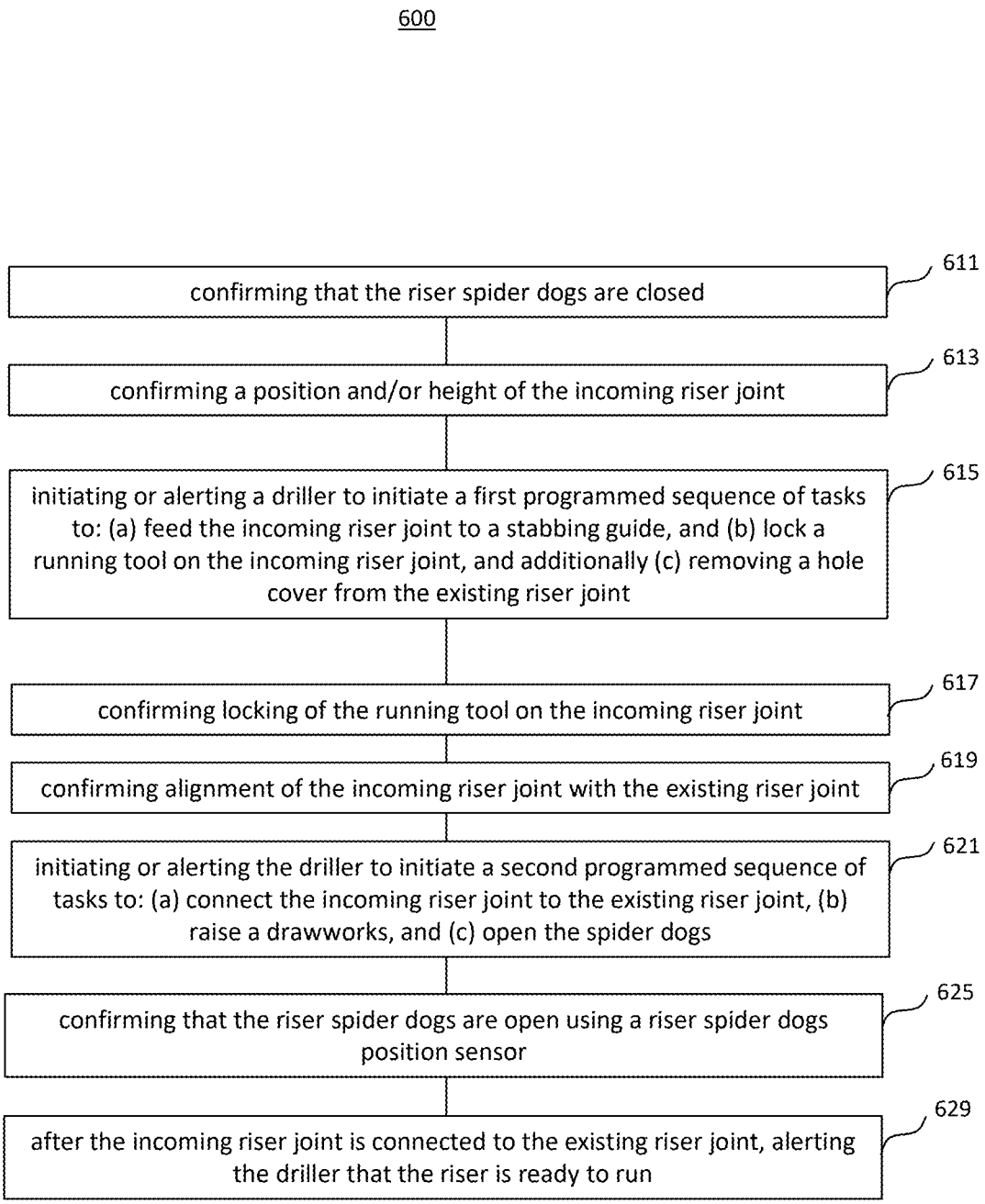
FIG. 6 is an example process for automating riser running during well construction according to an embodiment.

FIG. 6 shows an example process 600 for automating riser running during well construction, according to an embodiment. Steps of process 600 may be performed by a suitable controller (e.g., controller 520, as shown in FIG. 5).

Prior to starting process 600, a human operator (herein, referred to as a driller) configures automated system 500 (as shown in FIG. 5) to perform a riser running sequence. The driller may input a depth that needs to be reached by the riser. In some cases, system 500 is configured to perform a self-check and to confirm that all pre-requisites have been met. Subsequently, system 500 alerts the driller that the riser running sequence is ready to proceed. The driller then may push a 'Start' button on the user interface (UI) and system 500 will begin the riser running sequence.

At step 611 of process 600, controller 520 is configured to confirm that the riser spider dogs are closed, thereby indicating that an existing riser joint is locked. At step 613, controller 520 is configured to confirm a position and/or height of the incoming riser joint by using a combination of riser catwalk machine trolley position sensor 512, riser skate position sensor 513, and tilt ramp position sensor 514.

At step 615, controller 520 is configured to initiate (or alert a driller to initiate) a first programmed sequence of tasks to: (a) feed the incoming riser joint to a stabbing guide of a running tool, and (b) lock running tool 535 on the incoming riser joint. In an example embodiment, the stabbing guide is configured to connect running tool 535 with the incoming riser joint.

At step 617, controller 520 is configured to confirm locking of running tool 535 on the incoming riser joint by using riser running tool locking confirmation sensor 515.

At step 619, controller 520 is configured to confirm alignment of the incoming riser joint with the existing riser joint (e.g., the riser joint located in the well center and supported by spider dogs 531) by using a suitable alignment sensor, such as, for example, camera.

At step 621, controller 520 is configured to initiate or alert the driller to initiate a second programmed sequence of tasks to: (a) connect the incoming riser joint to the existing riser joint. In an example embodiment, once the alignment of the incoming riser joint is confirmed with the existing riser joint, the incoming riser joint is lowered to stab the existing riser joint and joined with the existing riser joint using suitable joining elements (e.g., riser bolts). Further, at step 621 the second programmed sequence of tasks includes (b) raising a drawworks, and (c) opening spider dogs 531 to allow an assembly of riser joints to be lowered into the well.

At step 625, controller 520 is configured to confirm that riser spider dogs 531 are open using a riser spider dogs position sensor, after the incoming riser joint is connected to the existing riser joint.

Additional steps of process 600 include, after the incoming riser joint is connected to the existing riser joint, alerting the driller that the riser is ready to run, according to step 629. Further, the first programed sequence includes removing a hole cover from the existing riser joint.

It should be appreciated that steps of process 600 may be repeated until a desired number of a desired number of riser joints is connected for a required water depth.

Figure 7:
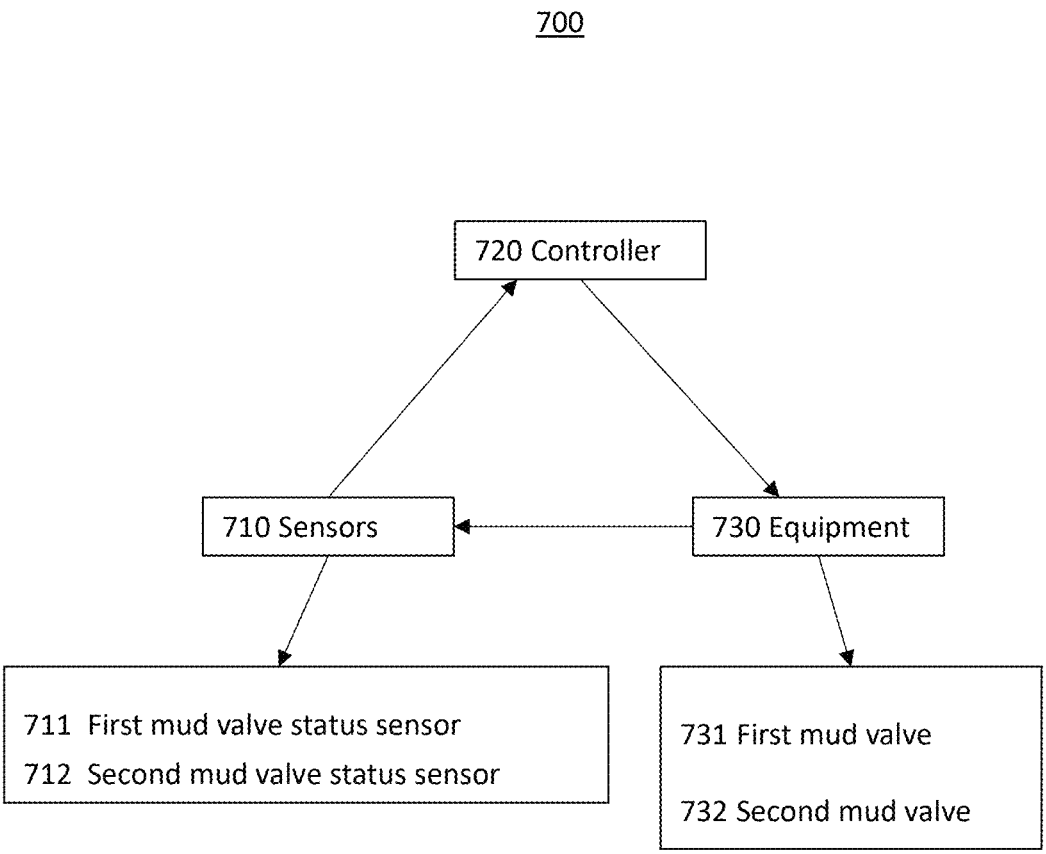
FIG. 7 is an example diagram of a system for automating a mud valve line-up confirmation according to an embodiment.

FIG. 7 shows an example diagram of a system 700 for automating a mud valve line-up confirmation during well construction, according to an embodiment. In an example embodiment system 700 includes a set of sensors 710 configured to determine various parameters of operation, of equipment 730. Equipment 730 may include any suitable equipment for controlling mud during well construction.

In the example embodiment, as shown in FIG. 7, equipment 730 includes a first mud valve 731 and a second mud valve 732. It should be appreciated that other valves associated with other fluid may be controlled by controller 720. For example, choke and kill valves may be controlled.

Various embodiments of automated system 700 include sensors 710 for monitoring operations of various valves of system 700. In an example embodiment, sensor 710 may include a first mud valve status sensor 711 and a second mud valve status sensor 712. These position sensors indicate whether valves 711 and 712 are open or closed.

In an example embodiment, first mud valve status sensor 711 is disposed on or adjacent to first mud valve 731 and configured to detect a status of first mud valve 731; and a second mud valve status sensor 712 is disposed on or adjacent to second mud valve 732 and configured to detect a status of second mud valve 732. It should be appreciated that other sensors may be present to detect the status of various other valves (e.g., choke valves or kill valves). In some embodiments, sensor 711 detects the position of first mud valve 731. In some embodiments, sensor 712 detects the position of second mud valve 732.

In various implementations, controller 720 is configured to be in communication with the plurality of sensors 710 of system 700 and configured to receive a signal from each sensor and provide an input to a drilling system regarding line-up status of the first and second sensors. Further, controller 720 may be configured to modify operations of the drilling system based on data from sensors 710.

In an example embodiment, either valve 731 or valve 732 is selected from a crossover valve from a standpipe to a choke manifold, an isolation valve between an active standpipe and a spare standpipe, a mud pump valve, a choke manifold valve for a choke-and-kill line, and a splitter valve on a choke manifold.

Further, in some implementations of system 700 valves 731 and 732 are configured to be gate valves that are either manual or hydraulically actuated. Additionally, or alternatively, other valves 731 and/or 732 may include butterfly valves, parallel and wedge gate valves, or knife valves. It should be noted that any other types of valves may be used, and such valves may have associated sensors for determining status of those valves. In some implementations, controller 720 of system 700 is configured to confirm correct valve line-up prior to flushing of a choke-and-kill line.

In various implementations of system 700, a position of a lever or a handwheel attached to a valve (e.g., valve 731 or 732) is configured to indicate the status of the valve (e.g., whether the valve is open/close or in a state between being open or closed). In various cases, sensors 711 and 712 may be placed to retrofit the sensing capabilities, however, in some implementations, direct valves status measurement are used.

Figure 8:
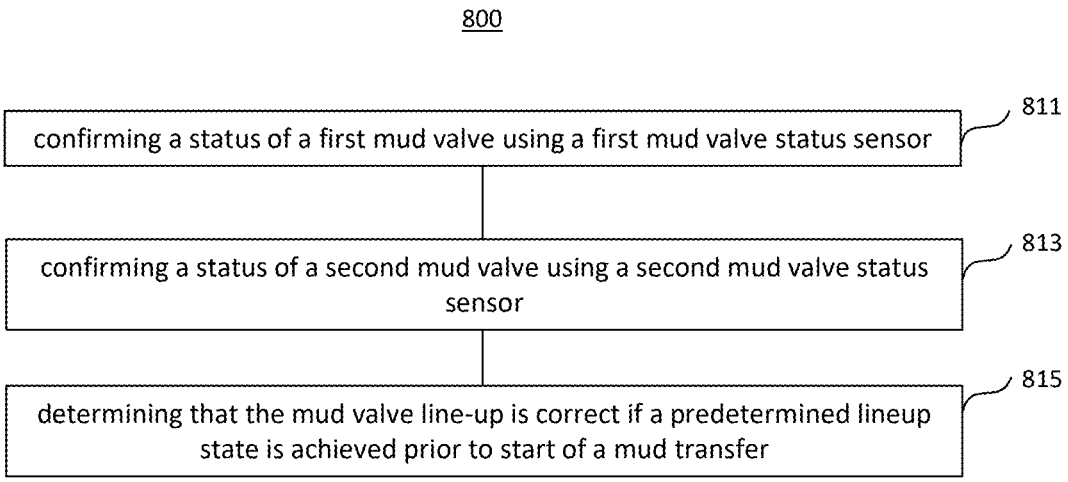
FIG. 8 is an example process for automating a mud valve line-up confirmation according to an embodiment.
Figure 19:
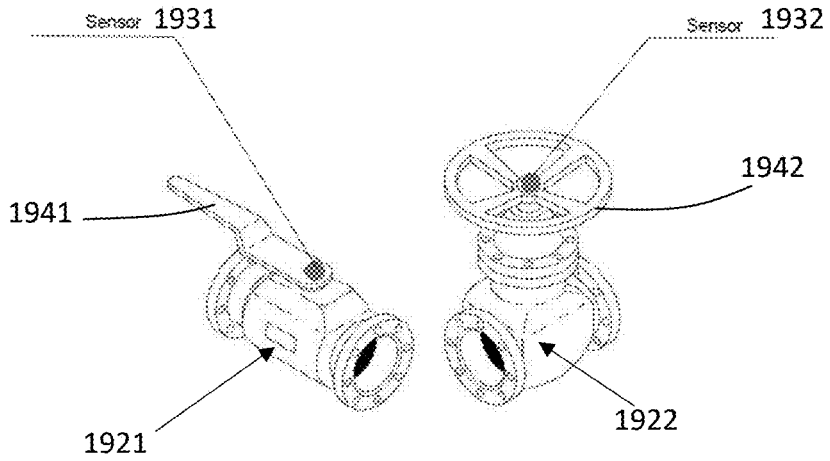
FIG. 19 shows examples of valves with associated valve sensors according to an embodiment.

FIG. 8 shows an example process 800 of automating mud valve line-up confirmation during a well construction operation. At step 811 of process 800, controller 720 is configured to confirm a state or a position of first mud valve 731 using first mud valve status sensor 711, and at step 813, controller 720 is configured to confirm a state or a position of second mud valve 732 using second mud valve status sensor 712. Further, at step 815, controller 720 is configured to determine that mud valve 731 or mud valve 732 line-up is correct based on other sensors available to system 700 (e.g., pressure sensors available to different lines such as choke-and-kill line). In various implementations, the determination that the line-up of valves 731 and 732 is correct is made prior to flushing of a choke-and-kill line. FIG. 19 shows an example location of sensors 1931 and 1932 for different configurations of mud valves. In an example, either sensor 1931 or sensor 1932 may be structurally or functionally similar to (or the same as) one of sensors 711 or 712. In an example embodiment, sensors 1931 (or 1932) may be determine a position of valve lever 1941 or a position (e.g., rotation amount) of valve wheel 1942. In some cases, sensors 1931 and/or 1932 may use accelerometer measurements, potentiometer measurements, or optical measurements.

Figure 9:
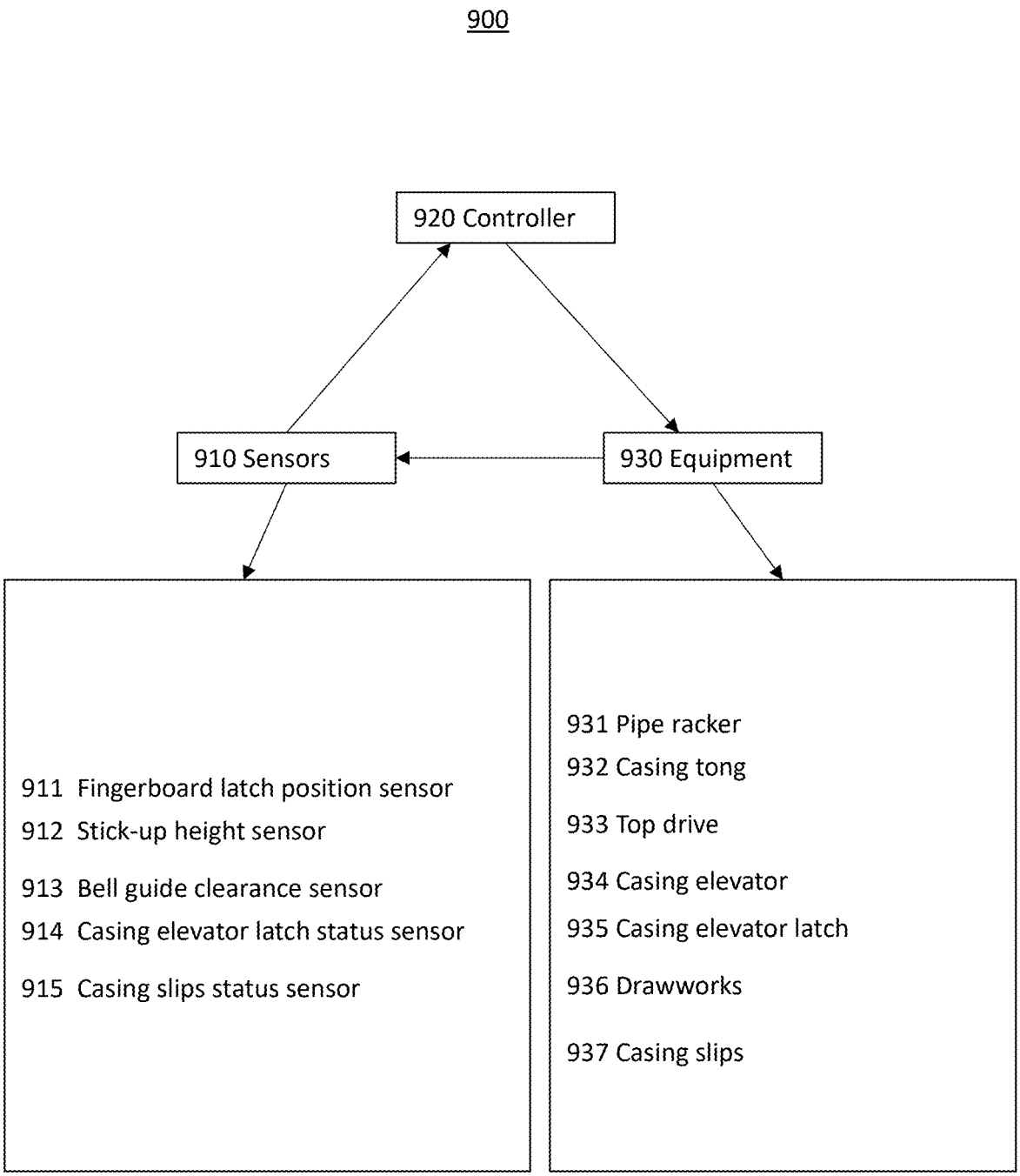
FIG. 9 is an example diagram of a system for automating tripping casing during well construction according to an embodiment.

FIG. 9 shows an example diagram of a system 900 for tripping casing during well construction, according to an embodiment. An example casing is assembled by connecting together multiple casing segments (herein, also referred to as casing joints). In an example embodiment, system 900 includes a set of sensors 910 configured to determine various parameters of operation of equipment 930. Equipment 930 may include any suitable equipment that can be used for tripping casing during well construction.

In the example embodiment, as shown in FIG. 9, equipment 930 includes pipe racker 931, casing tong 932, top drive 933, casing elevator 934, casing elevator latch 935, drawworks 936, and casing slips 937. In various embodiments, the equipment 930 also includes casing joints.

Pipe racker 931 may be similar in structure and functionality to pipe racker 131. In an example implementation pipe racker 931 is configured to handle casing tubulars, which are different in size (e.g., different in diameter and possibly in length) than stands of drill pipe or drill pipe segments. Further, top drive 933 may be similar in structure and functionality to top drive 134, as shown in FIG. 1B. Additionally, similar to elevator 135 for top drive 134, casing elevator 934 is configured to handle casing tubulars, and may lift and lower the casing tubulars (herein also referred to as casing joints). In various implementations casing elevator 934 is structurally and functionally the same or similar to elevator 135 and may be tilted by a suitable tilt angle. Further, in some cases, casing elevator 934 is located at a bottom part of top drive 933 and is suspended from top drive 933 using suitable bails. In various implementations, casing elevator 934 is configured to have a casing elevator latch 935 configured for closing or opening casing elevator 934. Elevator 934 is configured to be translated in a vertical direction by suitable drawworks 936, which may be the same or similar in structure and/or functionality to drawworks 137.

Further casing tong 932 may be similar in function to an iron roughneck. For example, casing tong 932 is configured to connect together an incoming casing segment and the existing casing segment (the existing casing segment is the casing segment secured in a well center, to which the incoming casing segment is to be connected). Similar to an iron roughneck, casing tong 932 is configured to provide torque to the incoming casing segment to connect the incoming casing segment via threaded connection to the existing casing segment. Additionally, casing tong 932 may be configured to further secure the existing casing segment (besides that casing segments being secured by casing slips 937).

In various embodiments, casing segments are joined at a rig well center. Alternatively, in some cases, similar to stands of drill pipe, casing segments may be pre-joined elsewhere (e.g., at an auxiliary well center) and form casing stands. Then the casing stands may be joined together to form casing assembly (also referred to as casing string) that can be lowered into the well. Casing segments may be held in place at a rig well center (or at an auxiliary well center) using casing slips 937. In an example embodiment, casing slips 937 may be similar in structure and/or functionality to power slips 138.

Various embodiments of automated system 900 include sensors 910 for monitoring operations of equipment 930 and for providing data to controller 920. In the example embodiment of system 900, as shown in FIG. 9, sensors 910 include fingerboard latch position sensor 911, stick-up height sensor 912, bell guide clearance sensor 913, casing elevator latch status sensor 914, and casing slip status sensor 915. In various embodiments, sensors 910 may be structurally and functionally similar to corresponding sensors 110 of system 100. For example, fingerboard latch position sensor 911 is structurally and functionally similar to fingerboard latch position sensor 111, stick-up height sensor 912 is structurally and functionally similar to stick-up height sensor 112, bell guide clearance sensor 913 is structurally and functionally similar to bell guide clearance sensor 114, casing elevator latch status sensor 914 is structurally and functionally similar to elevator latch status sensor 116, and casing slips status sensor 915 is structurally and functionally similar to power slip sensor 117.

Similar to the configuration used for drill pipe, a suitable fingerboard is configured to be used with casing segments (or casing joints). In an example implementation, fingerboard latch position sensor 911 is configured to determine whether an associated latch configured to secure a casing joint is in open or closed configuration (similar to fingerboard latch position sensor 111). Further, stick-up height sensor 911 is configured to determine a height of a portion of an existing casing segment located in a well center and extending above the well center. Bell guide clearance sensor 913 is configured to determine whether a funnel guide of the bell guide associated with top drive 933 clears a top portion of an incoming casing segment (which may be carried by pipe racker 931), casing elevator latch status sensor 914 is configured to determine a status of casing elevator latch 935, and casing slips status sensor 915 is configured to determine whether casing slips 937 is open or closed.

In an example embodiment of system 900 controller 920 is configured to maintain a communication with the plurality of sensors and configured to receive a signal from each sensor and provide an input for commanding at least one of pipe racker 931, a casing tong 932, top drive 933 and/or a top drive dolly, casing elevator 934, casing elevator latch 935, drawworks 936, or casing slips 937.

Figure 10A:
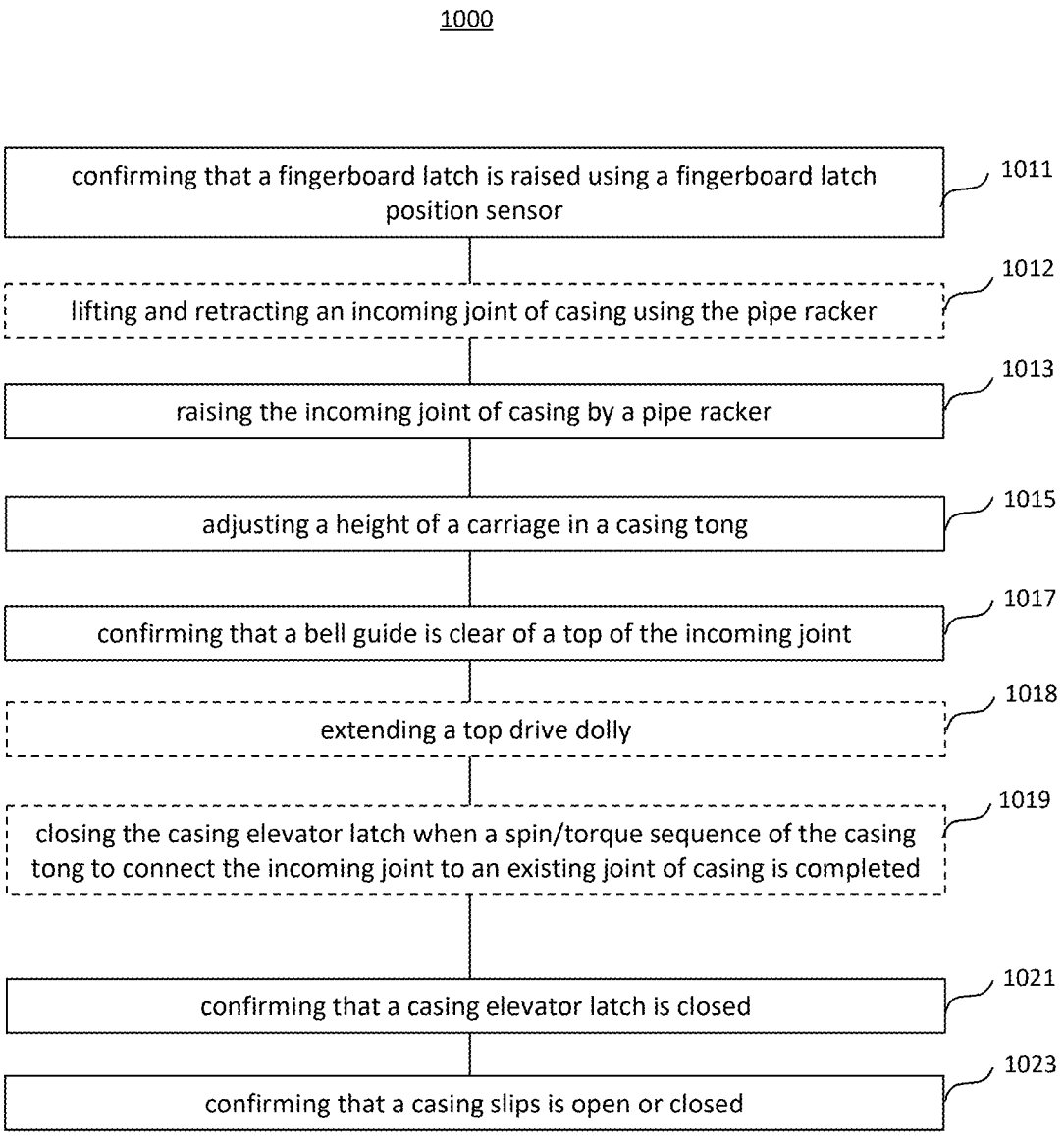
FIG. 10A is an example process for automating tripping casing during well construction according to an embodiment.

FIG. 10A shows an example process 1000 for tripping casing according to an embodiment. At step 1011 of process 1000, controller 920 is configured to confirm that a fingerboard latch is raised using a fingerboard latch position sensor. At an optional step 1012, controller 920 is configured to instruct pipe racker 931 to lift and retract an incoming joint of casing. At step 1013, controller 920 is configured to raise the incoming joint of casing by pipe racker 931 based on a signal from a stick-up height sensor. In an example implementation, the stick-up height sensor is disposed on or around a drill floor and configured to detect a height from the drill floor to a casing joint of casing segment. At step 1015, controller 920 is configured to adjust a height of a carriage in a casing tong. This step of process 1000 may be similar to a step 215 of process 200. At step 1017, controller 920 is configured to confirm that a bell guide is clear of a top of the incoming joint of casing (or casing segment) based on a signal from a bell guide clearance sensor. Step 1017 of process 1000 may be similar to a step 219 of process 200. Further, at step 1021, controller 920 is configured to confirm that a casing elevator latch is closed based on a signal from a casing elevator latch status sensor, and at step 1023, controller 920 is configured to confirm that a casing slips is open or closed based on a signal from a casing slips status sensor. Additional steps of process 1000 include a step 1018 of extending a dolly when the bell guide is confirmed to be clear of the top of the incoming stand, and an additional step 1019 of closing the casing elevator latch when a spin/torque sequence of the casing tong for connecting the incoming stand to the existing stand is completed.

Figure 10B:
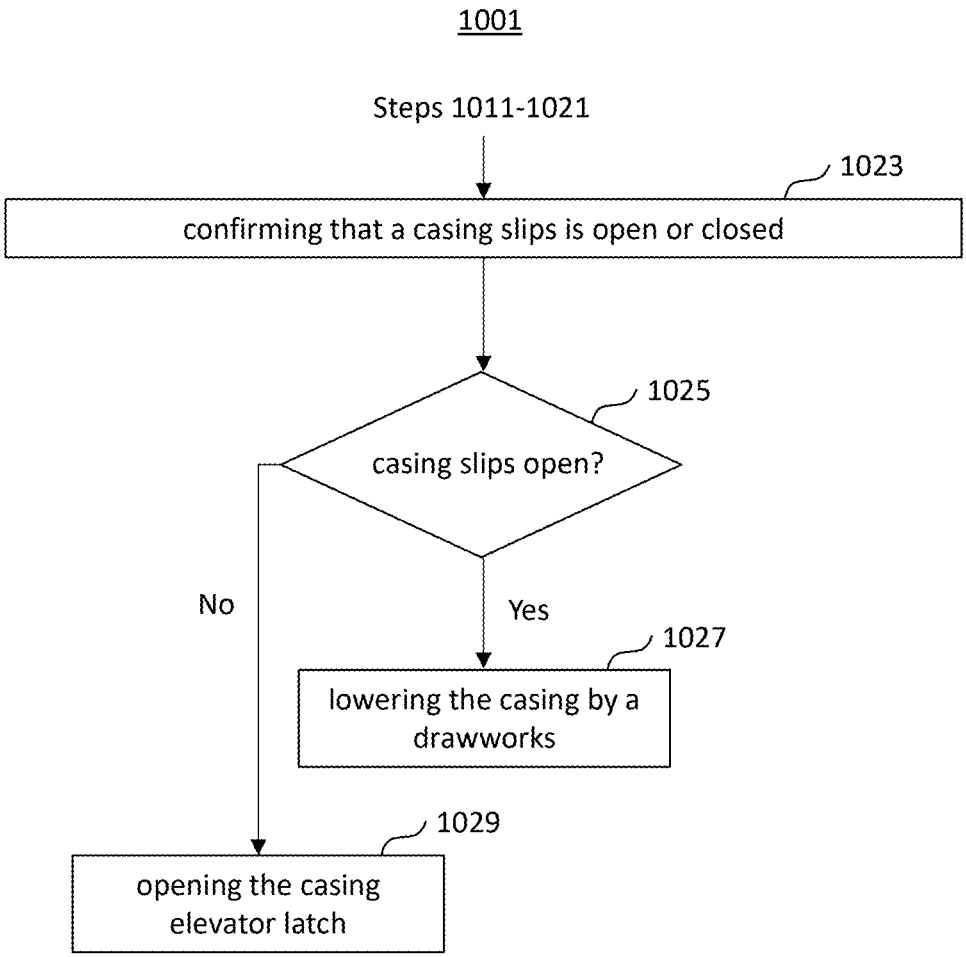
FIG. 10B are additional steps of the process, as shown in FIG. 10A, for automating tripping casing during well construction according to an embodiment.

FIG. 10B show further steps for process 1000 following step 1023. At step 1025, controller 920 is configured to determine if casing slips is open. If casing slips 937 is open (step 1025, Yes), controller 920 is configured to lower the casing segment (that is being handled by the casing elevator) using drawworks 936 at step 1027. Alternatively, if casing slips is closed (step 1025, No), the casing elevator latch is configured to open at step 1029.

It should be noted that steps of process 1000 may be repeated until a desired number of stands of casing is connected for a required well depth.

Figure 11:
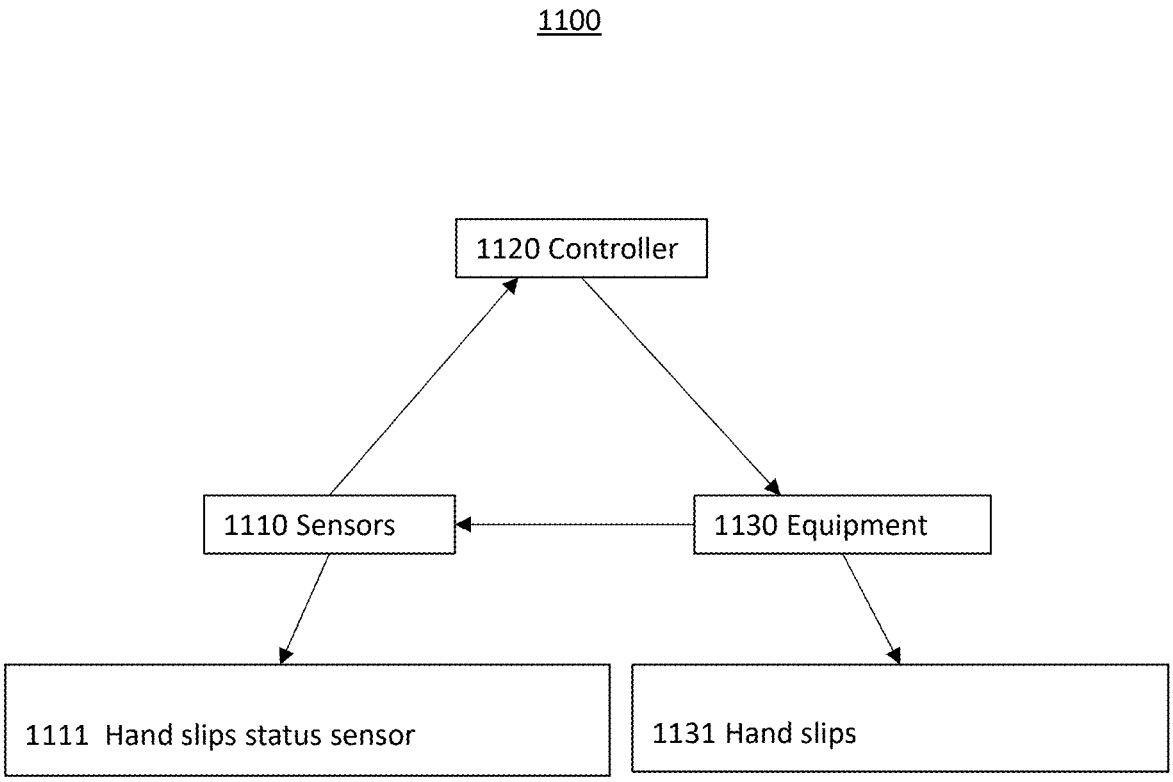
FIG. 11 is an example diagram of a system for automating use of a hand slips during well construction according to an embodiment.

FIG. 11 shows an example diagram of a system 1100 for automating the use of a hand slips during well construction, according to an embodiment. In an example embodiment, system 1100 includes a set of sensors 1110 configured to determine various parameters of operation of equipment 1130.

In the example embodiment, as shown in FIG. 11, equipment 1130 includes a hand slips 1131. Further, hand slips 1131 includes an associated hand slips status sensor 1111 for determining whether hand slips 1131 are open or closed. In an example embodiment, hand slips 1131 are configured to be operated by a human operator and may be used for securing a stand of drill pipe at a rig well center. In an example implementation, controller 1120 is configured to be in communication with hand slips status sensor 1111 and configured to receive a signal from hand slips status sensor 1111 and provide an input to a various equipment of a drilling system regarding the status of hand slips 1131. In some cases, hand slips 1131 can be manual or alternatively powered by a suitable power source (e.g., electrical source of compressed air source). In an example implementation, hand slips status sensor 1111 is disposed on hand slips 1131 and configured to detect whether hand slips 1131 is open or closed. Hand slips status sensor 1111 can be computer vision or a proximity sensor.

Figure 12:
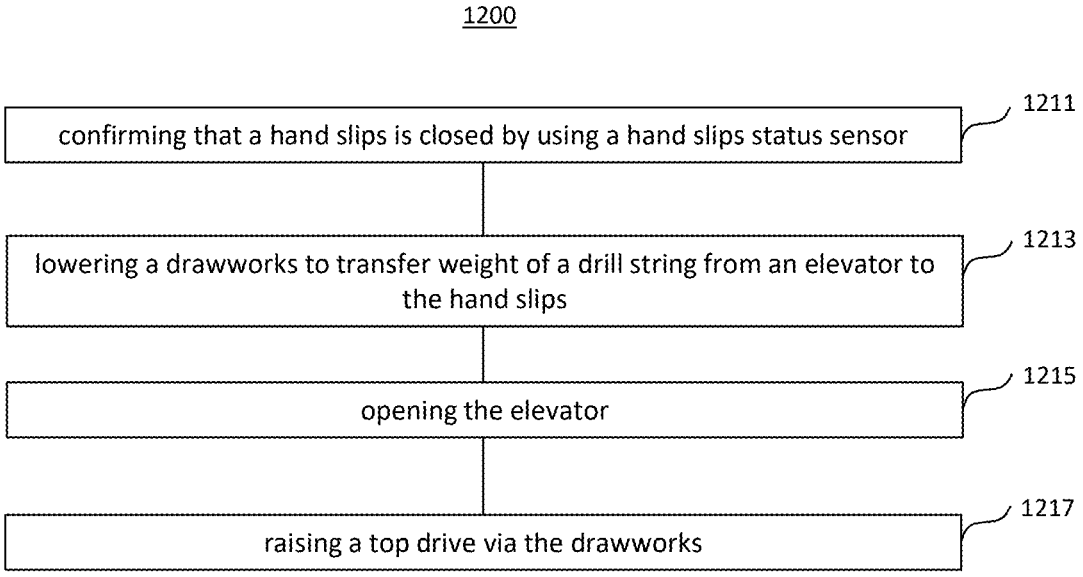
FIG. 12 is an example process for automating use of a hand slips during well construction according to an embodiment.

FIG. 12 shows an example process 1200 for operating hand slips 1131 and for automating use of hand slips 1131. At step 1211 of process 1200, controller 1120 is configured to confirm that hand slips 1131 is closed by using hand slips status sensor 1111. At step 1213, controller 1120 is configured to lower an elevator (using a drawworks associated with a top drive that is supporting the elevator) supporting a stand of a drill pipe to transfer a weight of the stand from the elevator to hand slips 1131. At step 1215, controller 1120 is configured to open an elevator latch of the elevator, and at step 1217, controller 1120 is configured to raise a top drive that supports the elevator via the drawworks.

Figure 13:
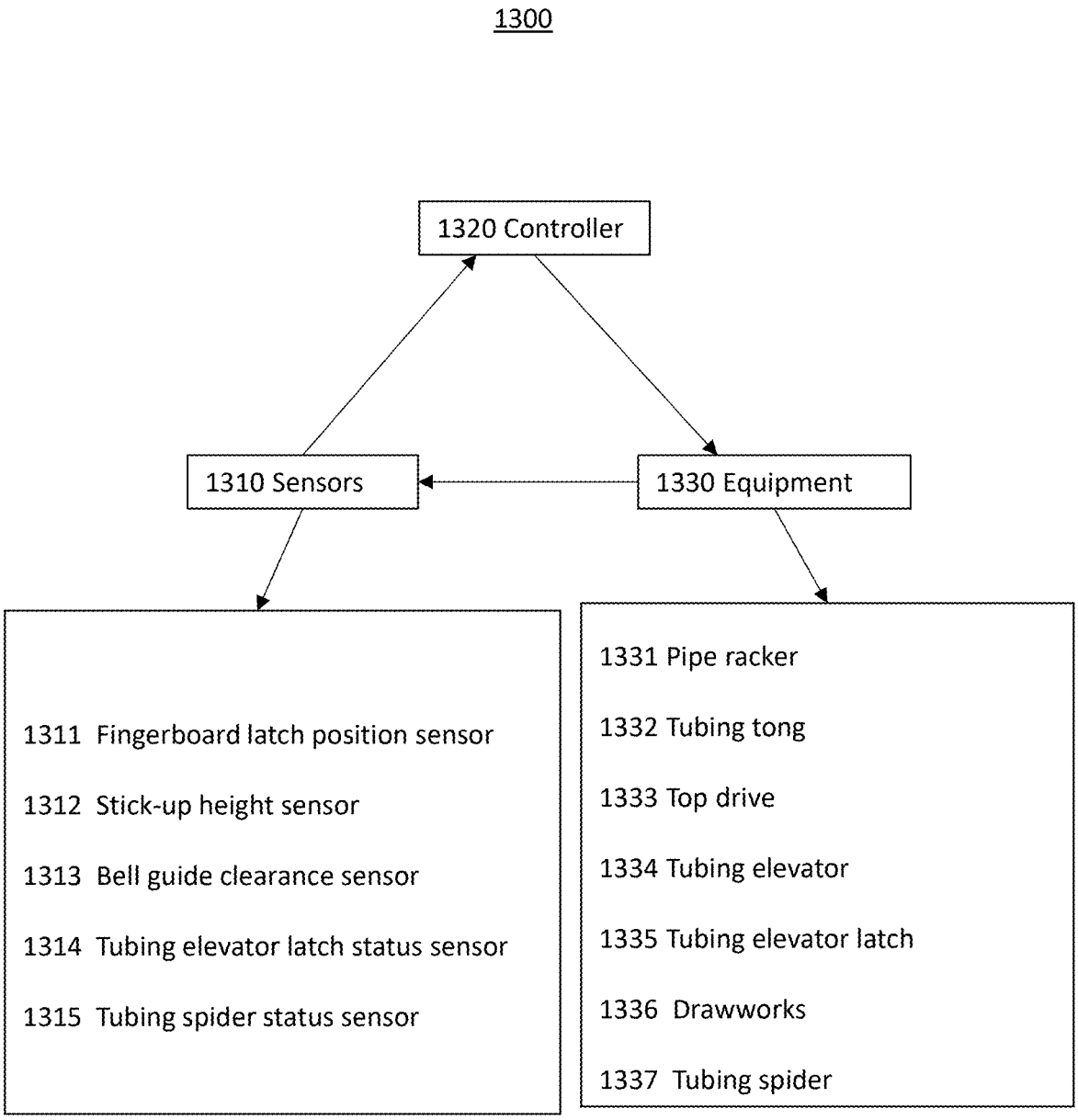
FIG. 13 is an example diagram of a system for automating tripping tubing during well construction according to an embodiment.

FIG. 13 shows an example diagram of a system 1300 for automating tripping tubing during well construction, according to an embodiment. An example tubing is assembled by connecting together multiple tubing segments (herein, also referred to as tubing joints). In general, tubing segments may be any suitable segments that are configured to be connected using any suitable means (e.g., using a threaded connection). In an example embodiment system, 1300 includes a set of sensors 1310 configured to determine various parameters of operation of equipment 1330. Equipment 1330 may include any suitable equipment that can be used for tripping tubing during well construction.

In the example embodiment, as shown in FIG. 13, equipment 1330 includes pipe racker 1331, tubing tong 1332, top drive 1333 with a top drive dolly, tubing elevator 1334, tubing elevator latch 1335, drawworks 1336, and tubing spider 1337. In an example embodiment, pipe racker 1331 is structurally and functionally similar to pipe racker 131. In an example implementation, pipe racker 1331 is configured to handle tubular segments, which are different in size (e.g., different in diameter and possibly in length) than stands of drill pipe or drill pipe segments.

Further tubing tong 1332 may be similar in operation to an iron roughneck or casing tong 932. For example, tubing tong 1332 is configured to connect together an incoming tubing segment and the existing tubing segment (the existing tubing segment is the tubing segment secured in a well center (or auxiliary well center), to which the incoming tubing segment is to be connected). Similar to an iron roughneck, tubing tong 1332 is configured to provide torque to the incoming tubing segment to connect the incoming tubing segment via, for example, a threaded connection to the existing tubing segment. Additionally, tubing tong 1332 may be configured to further secure the existing tubing segment (besides that tubing segments being secured by tubing spider 1337, as further discussed below).

Further, top drive 1333 may be similar in structure and functionality to top drive 134 or top drive 933. Additionally, similar to elevator 135 or casing elevator 934, tubing elevator 1334 is used together with top drive 1333. Tubing elevator 1334 is configured to handle tubular segments (as well as tubular assemblies of segments, herein referred to as tubular stands) and may lift and lower the tubular segments (herein also referred to as tubular joints). In various implementations tubular elevator 1334 is structurally and functionally the same or similar to elevator 135 and may be tilted by a suitable tilt angle. Further, in some cases, tubular elevator 1334 is located at a bottom part of top drive 1333 and is suspended from top drive 1333 using suitable bails. In various implementations tubular elevator 1334 is configured to have a tubular elevator latch 1335. Elevator 1334 is configured to be translated in a vertical direction by suitable drawworks 1336, which may be the same or similar in structure and/or functionality to drawworks 137.

In various embodiments, tubular segments are connected at a rig well center. Alternatively, in some cases, similar to stands of drill pipe, tubular segments may be pre-joined elsewhere (e.g., at an auxiliary well center) and form tubular stands. Then the tubular stands may be joined together to form tubular assembly that can be lowered into the well. Tubular segments may be held in place at a rig well center (or at an auxiliary well center) using tubular spider 1337. In an example embodiment, tubing spider 1337 may be similar in structure and/or functionality to a power slips. In an example embodiment, tubing spider 1337 includes spider dogs for securing a tubular segment at a rig well center.

Various embodiments of automated system 1300 include sensors 1310 for monitoring operations of equipment 1330 and for providing data to controller 1320. In the example embodiment of system 1300, as shown in FIG. 13, sensors 1310 include fingerboard latch position sensor 1311, stick-up height sensor 1312, bell guide clearance sensor 1313, tubing elevator latch status sensor 1314, and tubing spider status sensor 1315. In various embodiments sensors 1310 may be structurally and functionally similar to corresponding sensors 110 of system 100. For example, fingerboard latch position sensor 1311 is structurally and functionally similar to fingerboard latch position sensor 111, stick-up height sensor 1312 is structurally and functionally similar to stick-up height sensor 112, bell guide clearance sensor 1313 is structurally and functionally similar to bell guide clearance sensor 114, tubing elevator latch status sensor 1314 is structurally and functionally similar to elevator latch status sensor 116, and tubing spider status sensor 1315 is structurally and functionally similar to power slip sensor 117.

Similar to a configuration used for drill pipe, a suitable fingerboard is configured to be used with tubing segments (or tubing joints). In an example implementation, fingerboard latch position sensor 1311 is configured to determine whether an associated latch configured to secure a tubing joint is in open or close configuration (similar to fingerboard latch position sensor 111). Further, stick-up height sensor 1311 is configured to determine a height of a portion of an existing tubing segment located in a well center and extending above the well center. Bell guide clearance sensor 1313 is configured to determine whether a bell guide associated with tubing elevator 1334 clears a top portion of an incoming tubing segment (which may be carried by pipe racker 1331), tubing elevator latch status sensor 1314 is configured to determine a status of tubing elevator latch 1335, and tubing spider status sensor 1315 is configured to determine whether tubing spider 1337 is open or closed.

In an example embodiment of system 1300 controller 1320 is configured to maintain a communication with the plurality of sensors and configured to receive a signal from each sensor and provide an input for commanding at least one of pipe racker 1331, tubing tong 1332, top drive 1333, a dolly associated with top drive 1333, tubing elevator 1334, tubing elevator latch 1335, drawworks 1336, or a tubing spider 1337.

Figure 14A:
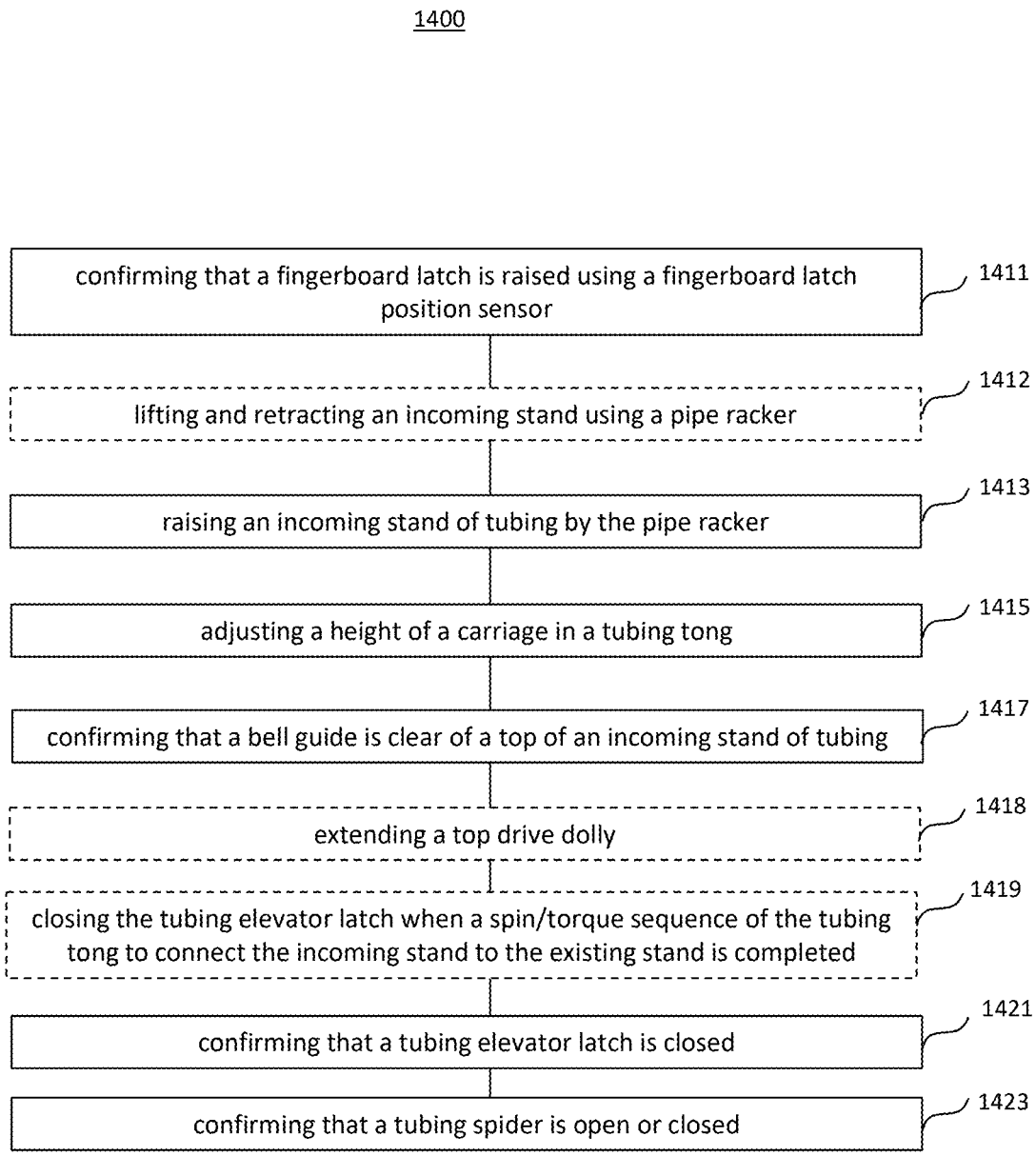
FIG. 14A is an example process for automating tripping tubing during well construction according to an embodiment.
Figure 14B:
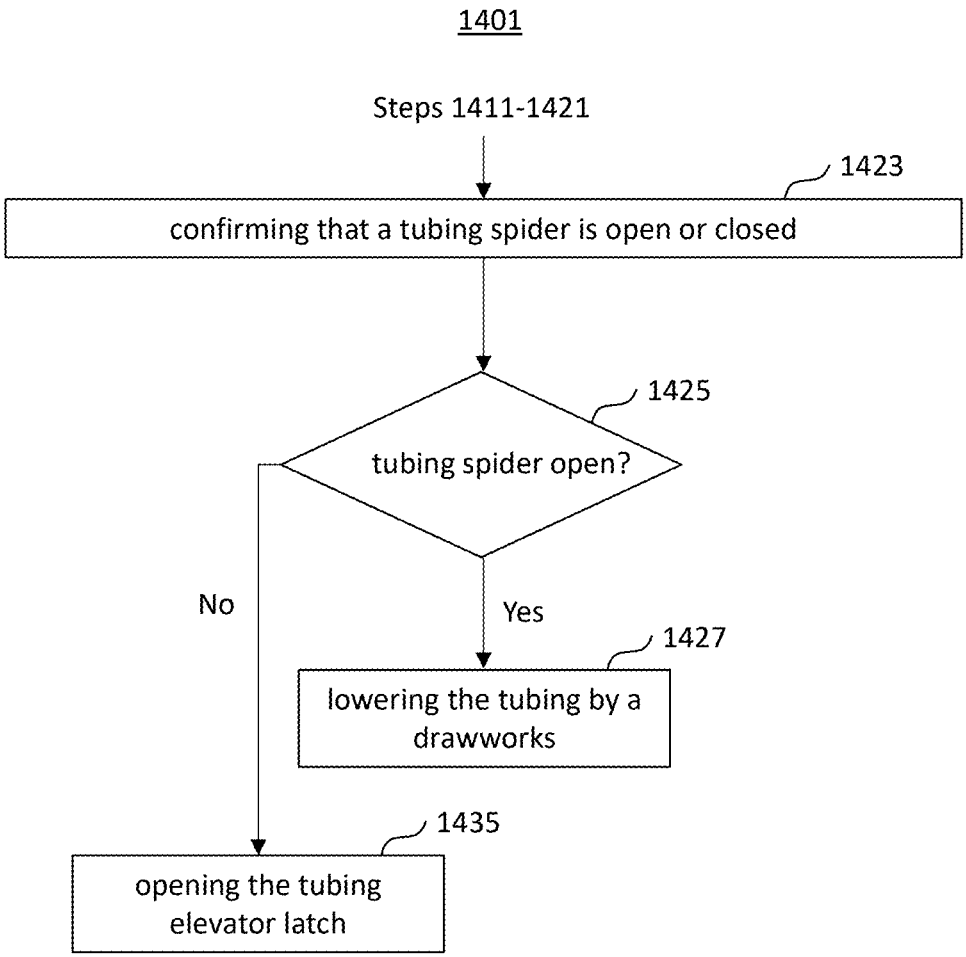
FIG. 14B are additional steps of the process, as shown in FIG. 14A, for automating tripping tubing during well construction according to an embodiment.

FIG. 14A shows an example process 1400 for tripping tubing according to an embodiment. At step 1411 of process 1400, controller 1320 is configured to confirm that a fingerboard latch is raised using a fingerboard latch position sensor. At an optional step 1412, controller 1320 is configured to instruct pipe racker 1331 to lift and retract an incoming joint of tubing. At step 1413, controller 1420 is configured to raise the incoming joint of tubing by pipe racker 1331 based on a signal from stick-up height sensor 1312. In an example implementation, stick-up height sensor 1312 is disposed on or around a drill floor and configured to detect a height from the drill floor to a tubing joint of a tubing segment that is secured at a rig well center (or secured at an auxiliary well center). At step 1415, controller 1320 is configured to adjust a height of a carriage in a tubing tong. This step of process 1400 may be similar to step 215 of process 200. At step 1417, controller 1320 is configured to confirm that a bell guide is clear of a top of the incoming joint of tubing (or tubing segment) based on a signal from a bell guide clearance sensor. Step 1417 of process 1400 may be similar to step 219 of process 200. Further, at step 1421, controller 1320 is configured to confirm that a tubing elevator latch is closed based on a signal from a tubing elevator latch status sensor, and at step 1423, controller 1320 is configured to confirm that a tubing spider is open or closed based on a signal from a tubing spider status sensor. Additional steps of process 1400 include step 1418 of extending a dolly of top drive 1333 when the bell guide is confirmed to be clear of the top of the incoming stand, and additional step 1419 of closing the tubing elevator latch when a spin/torque sequence of the tubing tong for connecting the incoming stand to the existing stand is completed. In various embodiments, additional steps of process 1400 are shown in FIG. 14B. For example, following step 1423, at step 1425, controller 1320 is configured to determine if the tubing spider is open. If tubing spider 1337 is open (step 1425, Yes), controller 1320 is configured to lower the tubing segment (that is being handled by the tubing elevator) using drawworks 1336 at step 1427. Alternatively, if tubing spider is closed (step 1425, No), the tubing elevator latch is configured to open at step 1435.

It should be noted that steps of process 1300 may be repeated until a desired number of stands of tubing is connected for a required well depth.

Further figures illustrate various machines and sensors that may be used by an automated well construction system. For example, as previously discussed, FIG. 15 depicts an example stick-up height sensor 1512 (e.g., a camera) positioned on a drill floor 1518.

Figure 16A:
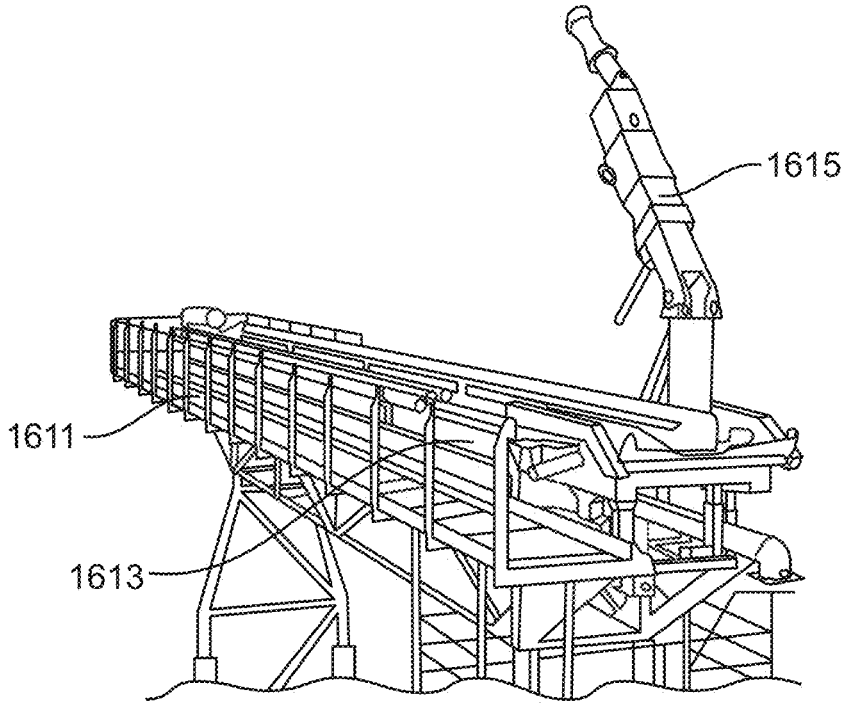
FIGS. 16A and 16B are examples of catwalk machines according to an embodiment.
Figure 16B:
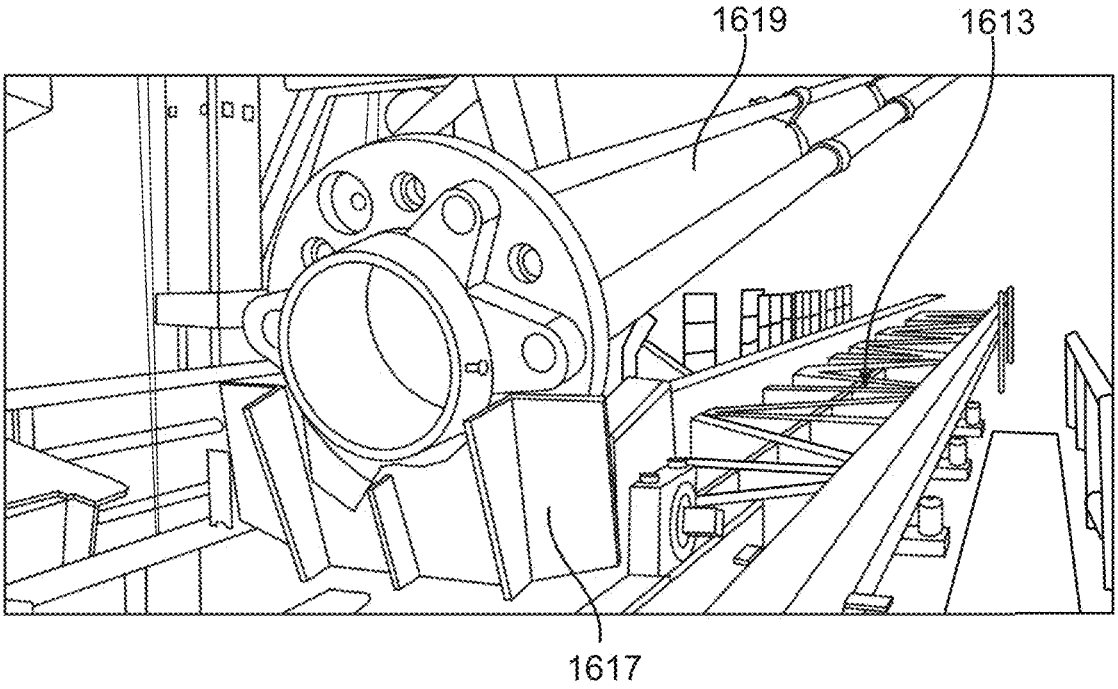

FIGS. 16A and 16B shows catwalk related equipment such as a catwalk 1611, a catwalk skate 1613, a catwalk tail in arm 1615 (see FIG. 16A), a catwalk trolley 1617 configured to move relative to catwalk 1611, and a riser 1619 being held by catwalk trolley 1617 (see FIG. 16B).

Figure 17:
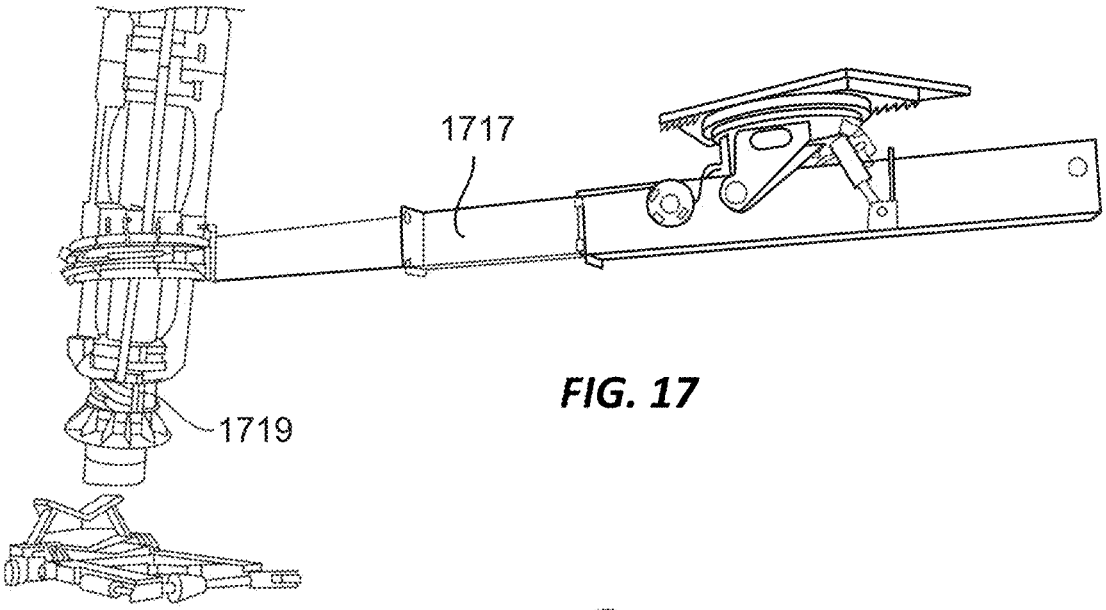
FIG. 17 is an example of a manipulator arm according to an embodiment.

FIG. 17 shows an example manipulator arm 1717 configured to transport a riser 1719. In an example embodiment, manipulator arm 1717 is configured to pick riser 1719 from a catwalk trolley and move it from a horizontal position to a vertical position (as shown in FIG. 17).

Figure 18:
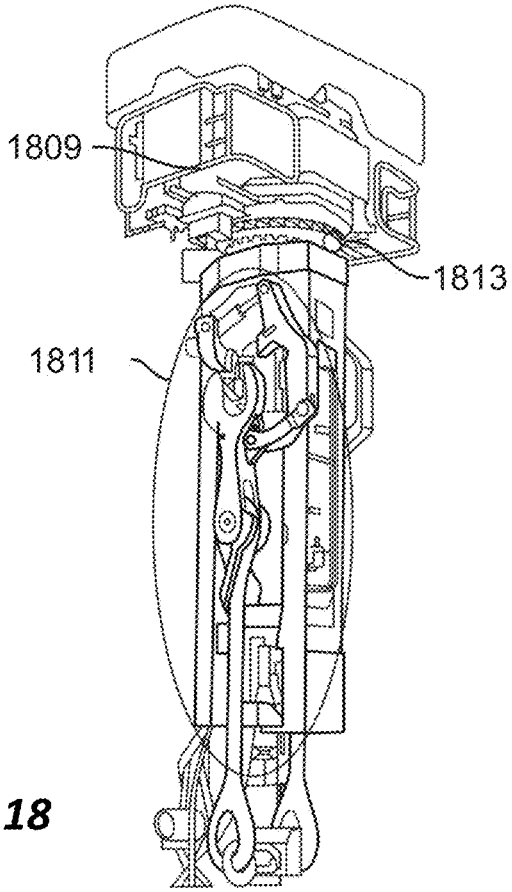
FIG. 18 is an example of a top drive with a pipe header according to an embodiment.

FIG. 18 shows an example pipe handler 1811 being part of a top drive 1809. Further, in an example embodiment, top drive 1809 includes a pipe handler rotation (or position) sensor 1813 attached to a portion of top drive 1809 and configured to monitor positions or rotations of pipe handler 1811.

Figure 21A:
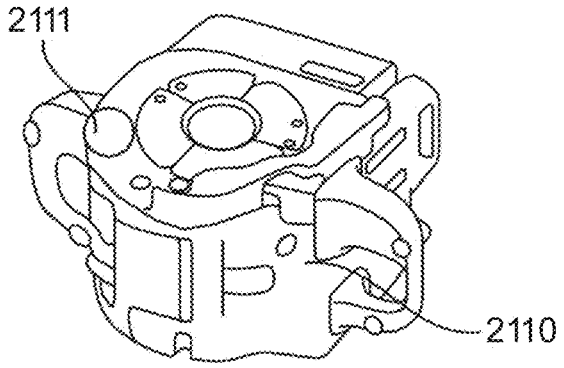
FIGS. 21A and 21B are examples of a drilling elevator according to an embodiment.
Figure 21B:
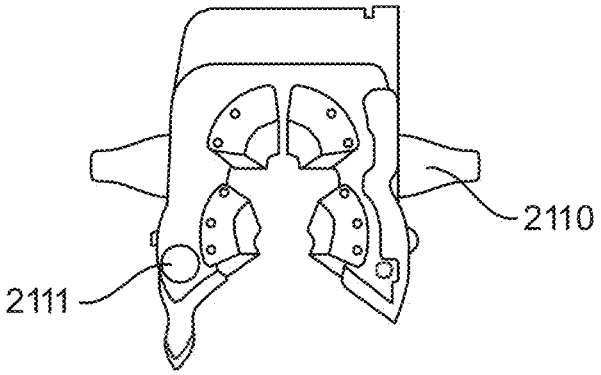

FIG. 19 shows example valves 1921 and 1922 having respective sensors 1931 and 1932 and valve lever 1941 valve wheel 1942, as discussed above. FIG. 20 shows an example fingerboard 2050, as discussed above, and FIGS. 21A and 21B depict an example drilling elevator 2110 in an open or close position. Further, drilling elevator 2110 may include an elevator latch status sensor 2111. Suitable examples of elevator latch status sensors 2111 are described in U.S. Provisional Patent Application No. 63/177,632, filed Apr. 21, 2021, titled "SYSTEM AND METHOD FOR WIRELESS DETECTION OF DRILLING ELEVATOR HEAD STATUS," the disclosure of which is incorporated herein by reference.

Figure 22A:
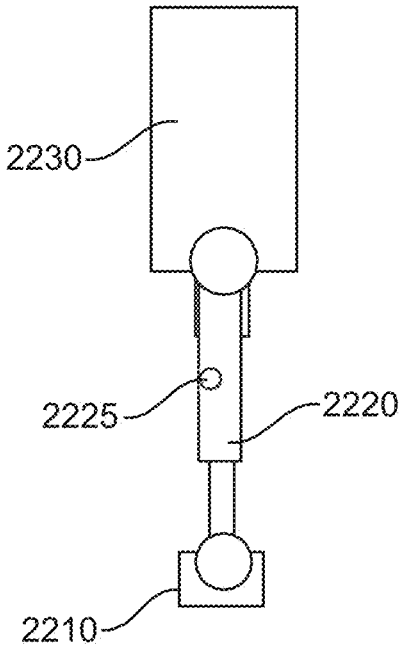
FIGS. 22A and 22B are examples of a drilling elevator capable of being tilted using bails according to an embodiment.
Figure 22B:
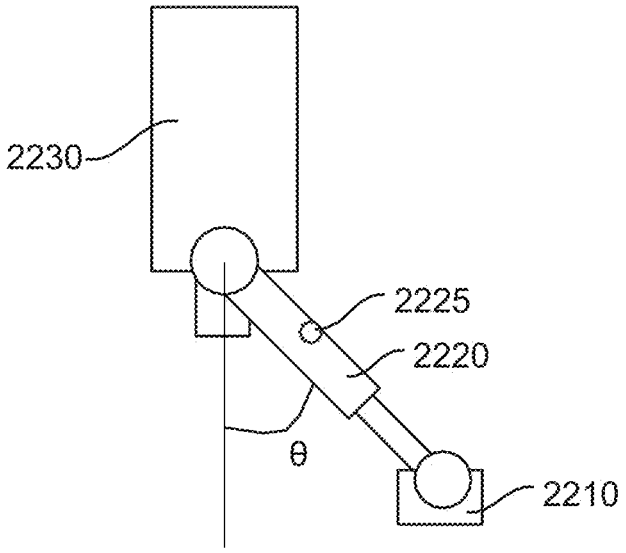

FIGS. 22A and 22B depict an example elevator 2210, which for example may be a drilling elevator, a casing elevator or a tubing elevator. Elevator 2210 is suspended from top drive 2230 using bails 2220. Further, a link tilt sensor 2225 disposed on bails 2220 is configured to determine a tilt angle of bails 2220. For example, in FIG. 22A the tilt angle is zero, and in FIG. 22B the tilt angle is a non-zero angle $\theta$.

Figure 23:
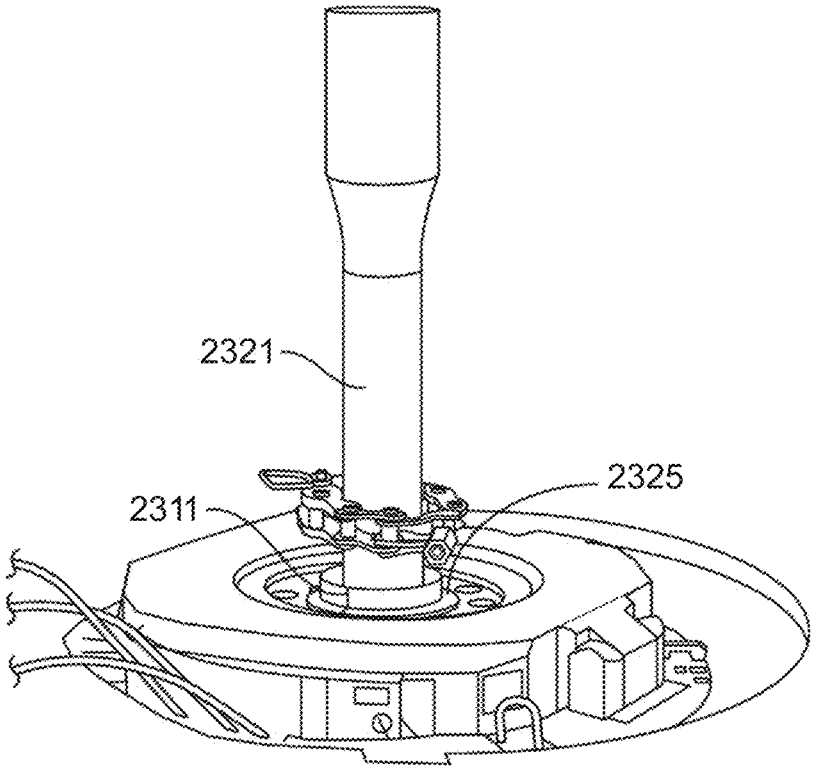
FIG. 23 is an example of a casing slip configured to secure a tubular section according to an embodiment.

FIG. 23 shows a view of casing slips 2311 configured to secure casing segment 2321. In an example embodiment, a casing slip status sensor 2325 is configured to be disposed at the casing slip 2311. In some cases, tubing spider may be similar in structure and functionality as casing slips 2311.

Figure 24:
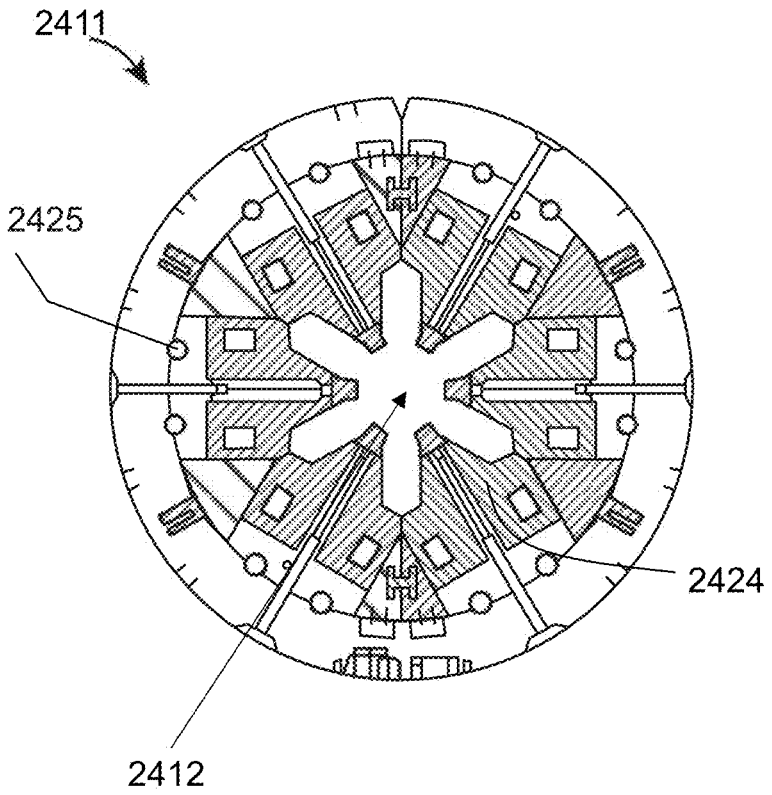
FIG. 24 is an example of a riser spider according to an embodiment.

FIG. 24 shows an example riser spider 2411 that is used for securing a riser in a well center. In an example embodiment, riser spider 2411 includes riser dogs 2424 configured to move towards a center 2412 to secure the riser, and away from center 2412 to release the riser. Spider dogs 2424 are referred to as closed when they secure the riser and are referred to as open when they are moved away from center 2412 and release the riser. In various embodiments, riser spider 2411 includes riser spider dogs position sensors 2425 configured to determine whether spider dogs 2424 are in an open or closed position.

FIG. 25A shows an example view of a top drive 2500, as well as a section of a drill pipe, as described above, while FIG. 25B shows a view of a derrick having top drive 2500, as described above.

Figure 26:
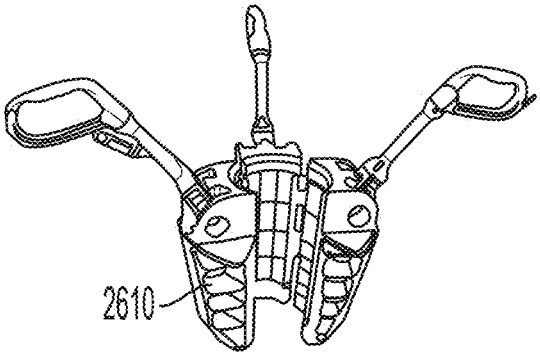
FIG. 26 is an example of a hand slip according to an embodiment.

FIG. 26 shows an example hand slips 2610 that can be operated by a human operator. For example, hand slips 2610 is configured to wrap around a casing (or tubulars) and secure the tubular segment at a well center (e.g., prevent the tubular segment from sliding below a drilling floor though an opening of the well center).

Figure 27A:
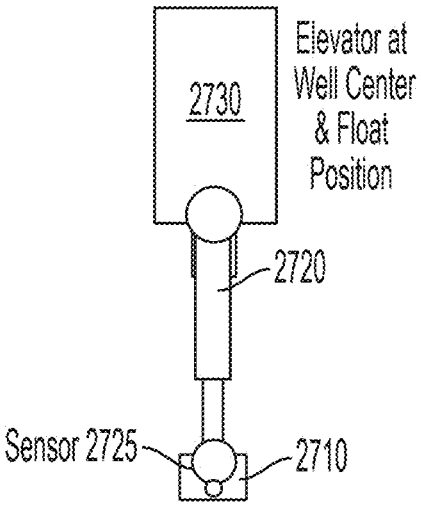
FIGS. 27A and 27B are examples of a drilling elevator supported by a top drive according to an embodiment.
Figure 27B:
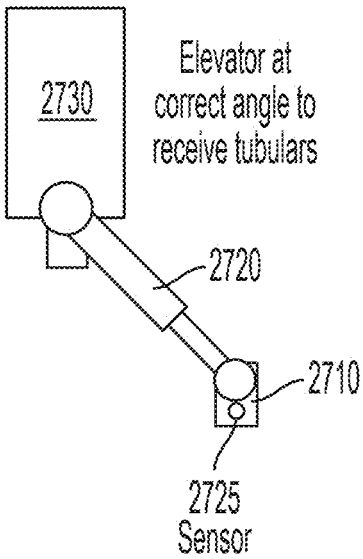

FIGS. 27A and 27B depict an example elevator 2710, which for example may be a drilling elevator, a casing elevator or a tubing elevator. Elevator 2710 is suspended from top drive 2730 using bails 2720. Further, an elevator latch status sensor 2725 is disposed on elevator 2710 and is configured to pick up a segment of a drill pipe (for a case when elevator 2710 is a drilling elevator) when a tilt angle of bails 2720 is at a target value. In an example embodiment, as shown in FIG. 27A, the tilt angle is zero and elevator 2710 may be located above a well center. FIG. 27B shows a nonzero tilt angle may be used when receiving a segment of a drill pipe. When the segment enters a bell guide of elevator 2710, elevator latch is configured to close to secure the segment at the elevator 2710.

Figure 28A:
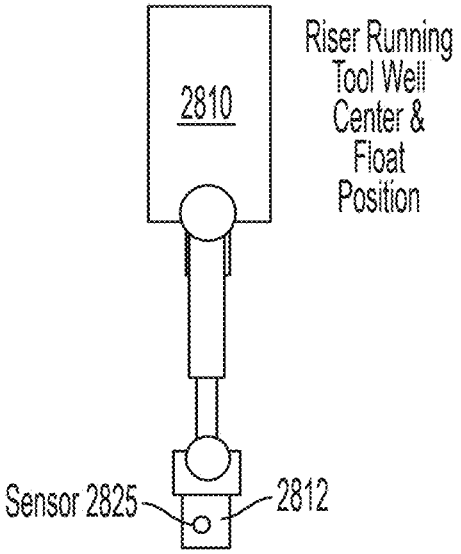
FIGS. 28A and 28B are examples of a riser running tool according to an embodiment.
Figure 28B:
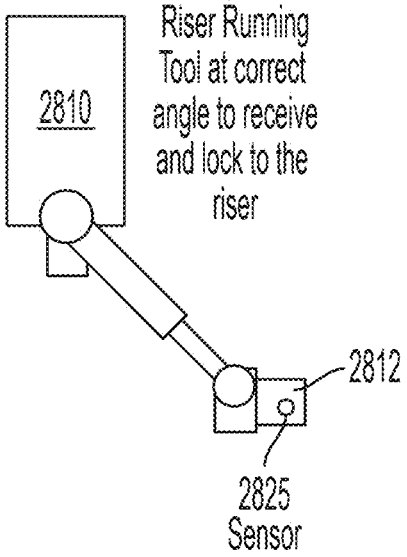

FIGS. 28A and 28B show example of a riser running tool 2810 having a stabbing guide 2712. In various implementations, stubbing guide 2812 is configured to be coupled to a riser. Further, stubbing guide 2812 is configured to be tilted by a suitable tilt angle to position and orient the riser. In an example embodiment, as described above, riser running tool 2810 includes a riser running tool sensor 2825 configured to determine a tilt angle of stubbing guide 2812 and further configured to confirm that the riser is locked to the stubbing guide 2812 of riser running tool 2810.

In various embodiments, various sensors of automation system are configured to transmit data to a controller via a wireless (or wired) communication. In an example embodiment, the sensors may interact through a network infrastructure. Due to a use of a wireless technology, the detection of the status for the machines of a drilling rig provides a means for ease of integration to the drilling control system.

As described above, and to further summarize, various machines of the drilling rig include catwalk machines used to transfer tubulars into and out of the rig floor. Tail in arm(s) mounted to the catwalk machines are used to present the tubulars (lift from horizontal and support) to allow the tubulars to be engaged by or released from a set of elevators. When picking up tubulars and during tripping operations, the tubulars are supported on elevators (different size and type of elevator for each size and type of tubular), which in turn are attached to suitable top drive with bails. The elevators are configured to latch to tubular sections and then support the weight of that tubular section (or series of tubular sections).

In various implementations, tubular sections (or tubulars) are connected to a suitable top drive which supports the weight of all suspended tubulars, provides rotation and a provides a conduit for high pressure fluids to be pumped into the well through those tubulars. In various embodiments, bails may be of fixed lengths, made from a suitable metal (e.g., steel) which are connected to/supported by the top drive at the top and connected to a set of elevators at the bottom. In various embodiments, when picking up tubulars, the bails can be pushed out at an angle by the link tilt in order to allow a tubular to be engaged. In various embodiments either slips (of different size and type of slips for each size and type of tubular) or suitable spiders are used to support the weight of the tubulars suspended in the rotary table (e.g., the rotary table may be part of a well center). As described above, various tubulars are laterally supported in a setback area by a fingerboard. The fingerboard includes rows with slots for each tubular. Further fingerboard includes fingerboard latch mechanisms for keeping each tubular in a specific slot. As described above, a pipe racker is used to pick up and tubulars between the well center and the setback area. For example, the pipe racker is configured to engage with a stand or a tubular in the setback area. After the pipe racker is engaged, the latches on the fingerboard are opened and the stand is released from the fingerboard. The stand then is moved towards the well center by the pipe racker. The pipe racker then stabs the joint of tubular into the stump of the tubulars being supported in the rotary table by the slips.

Further an iron roughneck is used to connect tubulars together, i.e., spin the connection together and apply the required torque to make up or break out the connection.

As described above, a riser running tool is used to pick up and lay down riser joints from and to the riser catwalk machine, and a riser spider is used to support the weight of the riser when the riser is being placed in a well center. In various implementations of riser spider, spider dogs are extended to provide a support structure for the riser and retracted to allow the riser to be lowered into the well. Further, in some configurations, a manipulator arm is used to support and guide riser and other tubulars as they are being moved from the catwalk machine to the well center.

In various embodiments, a time progress for various well construction operations is configured to be determined by a controller and provided to a human operator. This operational data is then used by a suitable optimization system to optimize the well construction while maintaining the safety of the well construction.

Figure 29:
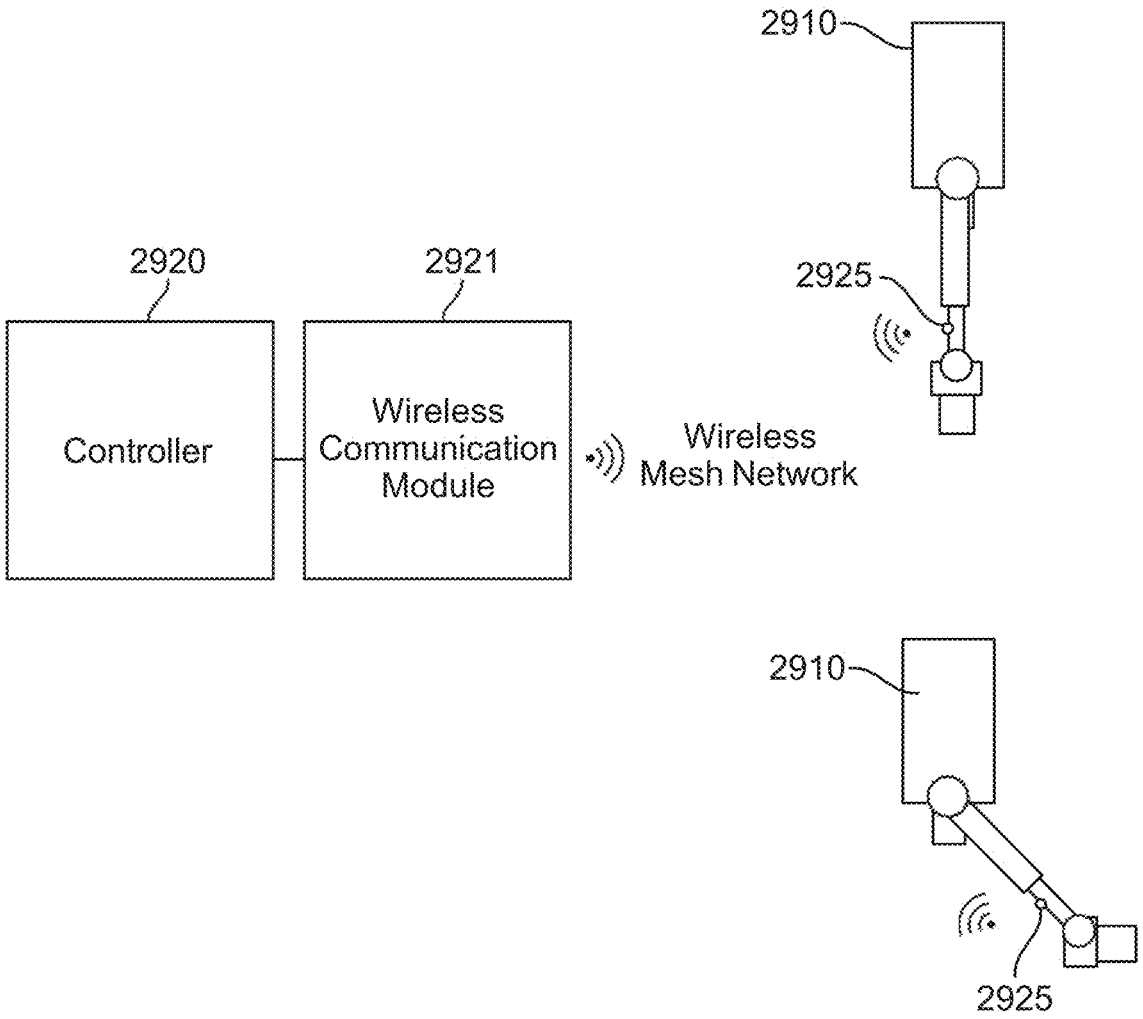
FIG. 29 is an example of a system having a controller for controlling a riser running tool according to an embodiment.
Figure 30:
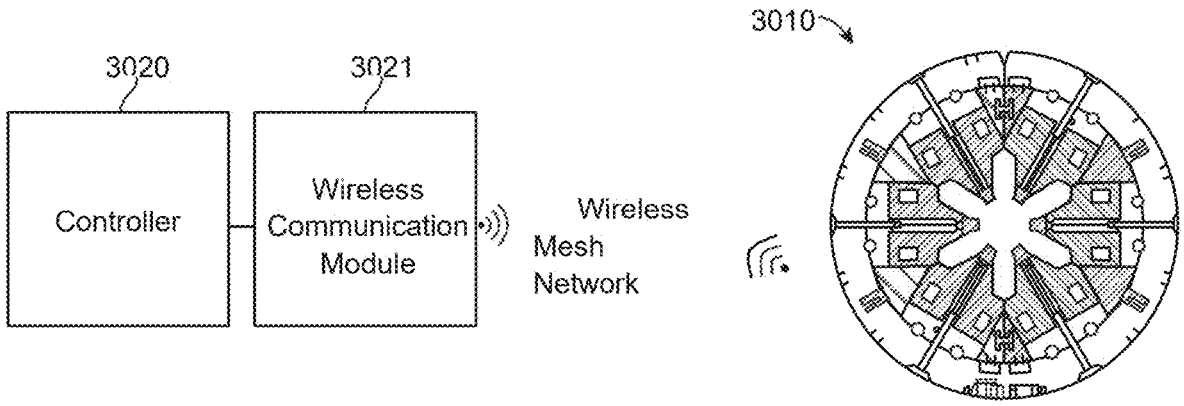
FIG. 30 is an example of a system having a controller for controlling a riser spider according to an embodiment.
Figure 31:
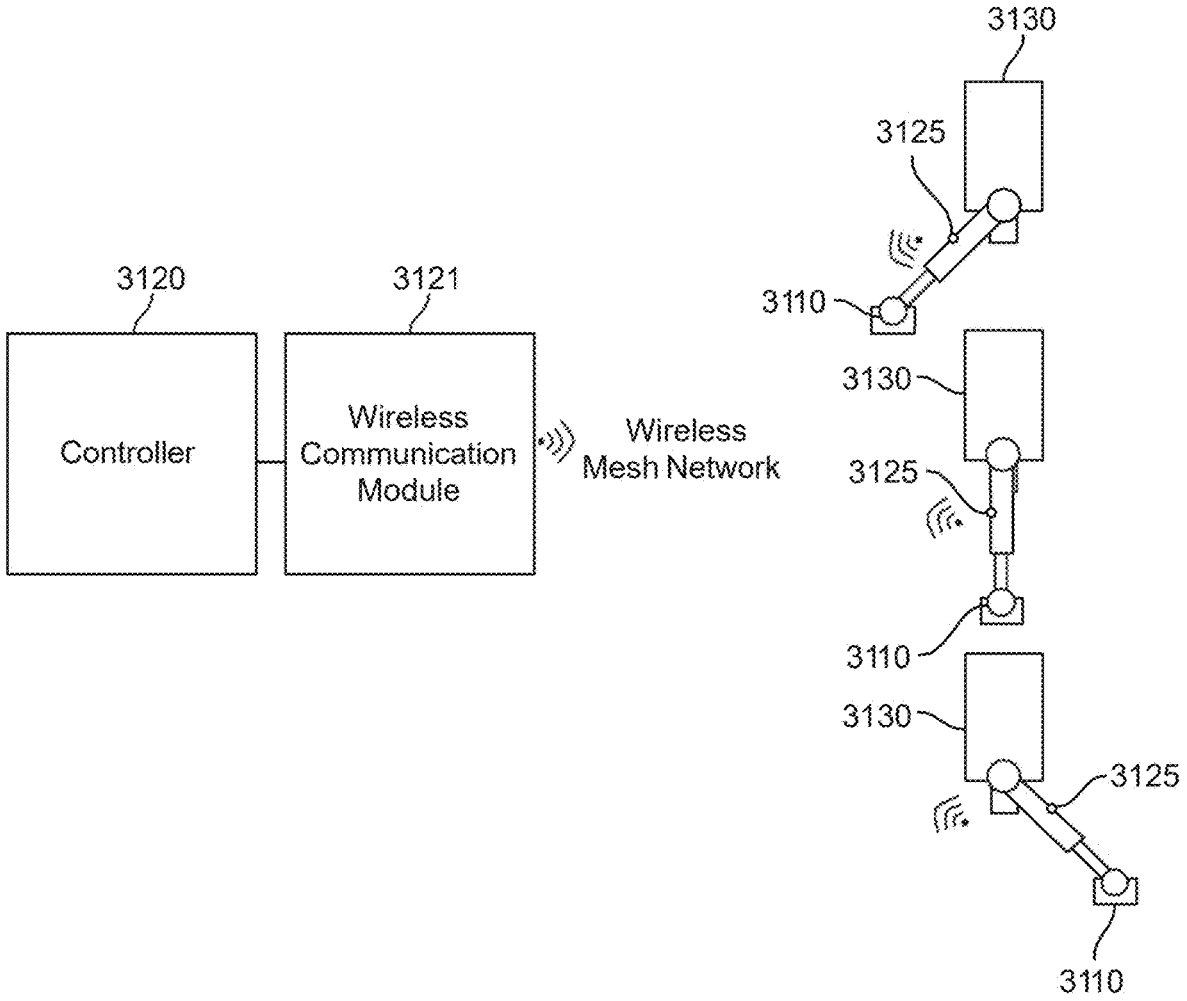
FIG. 31 is an example of a system having a controller for controlling a drilling elevator according to an embodiment.

FIGS. 29-31 show example embodiments of respective controllers 2920-3120 configured to control various equipment of a riser rig. In an example embodiment, as shown in FIG. 29, controller 2920 is configured to collect data from a sensor 2925 associated with riser running tool 2910. Sensor 2925 may be any suitable sensor for determining operations of tool 2910. For example, as described above, sensor 2925 may determine if a tilt angle of riser running tool 2910 is correct to latch to a riser joint. Further, sensor 2925 may determine if the riser joint is locked to riser running tool 2910.

FIG. 30 shows an example controller 3020 configured to control operations of a riser spider 3010, as described above. FIG. 31 shows an example controller 3120 configured to control operations (as described above, for example, in reference to FIGS. 22A-22B and 27A-27B) of a top drive 3130 and an elevator 3110 attached to top drive 3130, based on data received from a wireless sensor 3125. In various embodiments, controllers 2920-3120 are configured to communicate with various sensors of an automated drilling system via respective wireless communication modules 2921-3121.

In some embodiments, a human operator may assist an automated system for well construction when such assistance is needed (e.g., when the automated system does not correctly perform one or more operations of well construction). For instance, in an example embodiment, if the automated system does not recognize a correct position of a portion of a tubular segment (e.g., a stand of drill pipe) extending from a well center (herein, such portion is referred to as a stump), the human operator may be required to assist the automated system. For example, when a suitable sensor (e.g., a stick-up height sensor, such as stick-up height sensor 112) reports incorrect information (e.g., stick-up height sensor 112 reports an incorrect height for the stump), the human operator may pause and adjust the operation of the automated system. In an example embodiment, the incorrect height may be determined visually by the human operator or may be determined by use of other sensors (e.g., other sensors used for determining the height of the stump). In some cases, the human operator is authorized to take control over the well construction equipment. For example, human operator is configured to take control over operations of an iron roughneck or over operations of a pipe racker. It should be noted that the human operator may take control of any other suitable equipment, such as an elevator used for transporting the tubular segment, bails for tilting the elevator, or any other equipment. After determining the correct information needed to proceed to a next step of well construction (e.g., after determining the correct height of the stump), the human operator proceeds to the subsequent steps of the well construction. In an example embodiment, the human operator corrects the incorrect information and instruct the automated system to perform the subsequent steps of the well construction based on the corrected information. Alternatively, the human operator performs subsequent well construction operations manually, while investigating the cause of the incorrect data determined by the automated system. In an example embodiment, the cause for incorrect data may include environmental conditions (e.g., rain or wind), camera blockage, camera tilt, wet pipes, movements of a drill floor, errors associated with system calibration, and the like. Once the cause for the incorrect data is established (or assumed), the cause is removed, and sensors of the automated system are recalibrated to provide accurate data. Prior to using the automated system, the human operator confirms that the sensors are providing the accurate data. If the data received from sensors is correct and remains to be correct over a test time interval, the human operator instructs the automated system to resume well construction. Alternatively, if the data is not correct and/or does not remain accurate over the test interval of time, the human operator proceeds to perform well construction operations manually. For such a case, the human operator instructs an authorized technician to troubleshoot issues associated with the automated system not providing the accurate data.

When a sensor of the automated system is not performing accurately (e.g., when the sensor is not providing accurate data), a calibration process for the sensor is used and incudes mounting a new sensor (or remounting the existing sensor) and acquiring data from the sensor via a suitable interface. Further, the calibration process includes collecting data from the sensor as a human operator performs operations of well construction (e.g., determining a height of a stump locating in a well center, aligning an incoming tubular section with the stump, stabbing the stump with the incoming tubular section, and the like). In an example embodiment, the height of the stump is collected as a part of a calibration process. Alternatively, when calibrating other sensors (e.g., a bell guide clearance sensor), other data is collected (e.g., a height of the bell guide). In various embodiments, calibration may be done separately when tripping in (e.g., a process in which a tubular section is placed in a well) and when tripping out (e.g., a process in which a tubular section is taken out of a well).

Not limited by the systems and processes described above, the sensors described herein can be used in any other combinations for semi-automated or automated well construction. It should be appreciated that a list of processes described herein that can be automated is not exhausting and various other well construction processes may be automated using suitable sensors. For example, a tripping out process may be automated in a similar way as the tripping in process. An example tripping out process includes pulling out from a well a tubular (e.g., drill pipe, casing, tubing, or riser) and disassembling the tubular into segments (e.g., stands of drill pipe, casing, tubing, or riser). In some cases, the stands may be further disassembled into a plurality of joints. In the example embodiments, steps of tripping out may substantially reverse the steps used for tripping in tubular sections.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize or be able to ascertain using no more than routine experimentation, many equivalents to the specific inventive embodiments described herein. It is, therefore, to be understood that the foregoing embodiments are presented by way of example only and that, within the scope of the appended claims and equivalents thereto; inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of the present technology may be implemented using hardware, firmware, software or a combination thereof. For example, instructions to a controller, such as controller 120 may be implemented as a software. When implemented in firmware and/or software, the firmware and/or software code can be executed on any suitable processor or collection of logic components, whether provided in a single device or distributed among multiple devices.

In this respect, various inventive concepts may be embodied as a computer readable storage medium (or multiple computer readable storage media) (e.g., a computer memory, one or more floppy discs, compact discs, optical discs, magnetic tapes, flash memories, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the invention discussed above. The computer readable medium or media can be transportable, such that the program or programs stored thereon can be loaded onto one or more different computers or other processors to implement various aspects of the present invention as discussed above.

The terms "program" or "software" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present invention need not reside on a single computer or processor, but may be distributed in a modular fashion amongst a number of different computers or processors to implement various aspects of the present invention.

Computer-executable instructions may be in many forms, such as program modules, executed by one or more computers or other devices. Generally, program modules include routines, programs, objects, components, data structures, etc. that perform particular tasks or implement particular abstract data types. Typically, the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

Also, various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

The terms "substantially," "approximately," and "about" used throughout this Specification and the claims generally mean plus or minus 10% of the value stated, e.g., about 100 would include 90 to 110.

As used herein in the specification and in the claims, the terms "target" and "control target" are used interchangeably.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A system for automating stand building during a well construction operation, comprising:

a plurality of sensors that includes:

a catwalk machine cart position sensor disposed on a catwalk machine cart and configured to detect a position of the catwalk machine cart relative to at least one of a well center or an elevator;

a catwalk machine tail in arm position sensor disposed on a catwalk machine tail in arm and configured to detect a position of the catwalk machine tail in arm, wherein a combination of the catwalk machine cart position sensor and the catwalk machine tail in arm position sensor is configured to provide a position and/or height of a first drill pipe joint;

an elevator tilt angle sensor disposed on an elevator and configured to detect a position and/or angle of the elevator;

an elevator latch status sensor disposed on the elevator and configured to detect whether an elevator latch is open or closed;

a power slips sensor disposed on a power slips and configured to detect whether the power slips is open or closed; and a stick-up height sensor disposed on or around a drill floor and configured to detect a height from the drill floor to a tool joint; and a controller in communication with the plurality of sensors and configured to receive a signal from each sensor and, based on the received signal from each sensor, determine and provide commands to at least one of the catwalk machine cart, the catwalk machine tail in arm, the elevator, the elevator latch, the iron roughneck, the drawworks, the power slips, or the first drill pipe joint, the controller being configured to:

(a) confirm, using data received from the elevator tilt angle sensor, that the elevator is at a correct angle to receive the first drill pipe joint, (b) following confirmation that the elevator is at the correct angle to receive the first drill pipe joint, command the elevator to close the elevator latch on the first drill pipe joint, (c) command a drawworks to raise the first drill pipe joint, (d) command at least one of the elevator or the catwalk machine tail in arm to guide the first drill pipe joint to the well center, (e) confirm, using data received from the power slips sensor, that the power slips is open, (f) command the elevator to lower the first drill pipe joint into the power slips, (g) command the power slips to close after the first drill pipe joint is put in place into the well center, and (h) confirm, using data received from the power slips sensor, that the power slips is closed.

2. The system of claim 1, wherein the controller is further configured to:

command the elevator to close the elevator latch on a second drill pipe joint, command the drawworks to raise the second drill pipe joint, and command the elevator to lower the second drill pipe joint to stab with the first drill pipe joint.

3. The system of claim 1, wherein the controller is further configured to command an iron roughneck to rotate the second drill pipe joint relative to the first drill pipe joint.

* * * * *